United States Patent [19]

Ukai et al.

[11] Patent Number: 4,965,170

[45] Date of Patent: Oct. 23, 1990

[54] SILVER HALIDE PHOTOGRAPHIC MATERIAL AND METHOD FOR FORMING SUPER HIGH CONTRAST IMAGES THEREWITH

[75] Inventors: Toshinao Ukai; Kazuhiro Shirasu; Koki Nakamura; Keizo Koya; Masahiro Okada; Kazunobu Katoh, all of Kanagawa, Japan

[73] Assignee: Fuji Photo Film Co., Ltd., Kanagawa, Japan

[21] Appl. No.: 489,872

[22] Filed: Mar. 6, 1990

Related U.S. Application Data

[63] Continuation of Ser. No. 160,970, Feb. 26, 1988, abandoned.

[30] Foreign Application Priority Data

Feb. 26, 1987 [JP] Japan ..... 62-43704
May 28, 1987 [JP] Japan ..... 62-133014

[51] Int. Cl.[5] ..... G03C 1/10

[52] U.S. Cl. ..... 430/264; 430/435; 430/507; 430/559; 430/955; 430/958

[58] Field of Search ..... 430/264, 557, 559, 955, 430/958, 435

[56] References Cited

U.S. PATENT DOCUMENTS

| | | | |
|---|---|---|---|
| 4,135,929 | 1/1979 | Fernandez et al. | 430/958 |
| 4,343,893 | 10/1982 | Donald et al. | 430/370 |
| 4,477,556 | 10/1984 | Van de Sande et al. | 430/559 |
| 4,542,092 | 9/1985 | Toya et al. | 430/510 |
| 4,551,423 | 11/1988 | Koyama et al. | 430/223 |
| 4,609,610 | 9/1986 | Dunlap et al. | 430/218 |
| 4,783,396 | 11/1988 | Nakamura et al. | 430/353 |
| 4,830,957 | 5/1989 | Sato et al. | 430/562 |

FOREIGN PATENT DOCUMENTS

| | | |
|---|---|---|
| 198438 | 10/1986 | European Pat. Off. . |
| 0220746 | 5/1987 | European Pat. Off. . |
| 945542 | 1/1964 | United Kingdom . |

*Primary Examiner*—Paul R. Michl
*Assistant Examiner*—Janet C. Baxter
*Attorney, Agent, or Firm*—Sughrue, Mion, Zinn, MacPeak & Seas

[57] ABSTRACT

A silver halide photographic material comprising a support having thereon at least one silver halide emulsion layer, said emulsion layer or at least one of other hydrophilic colloid layers containing a compound represented by formula (I):

$$PWR\text{-}(Time)_t\text{-}LA \qquad (I)$$

wherein PWR represents a group which undergoes reduction to release $(Time)_tLA$; Time represents a group which release LA upon reaction following release of $(Time)_tLA$ from PWR; t represents an integer of 0 or 1; and LA represents a group having a maximum light absorption in a wavelength range of 310 nm or more. In a preferred embodiment, one of said other hydrophilic colloid layers substantially free of the compound represented by formula (I) is provided between said at least one silver halide emulsion layer in said silver halide photographic material and one of said other hydrophilic colloid layers containing the compound represented by formula (I), and at least one of these hydrophilic colloid layers or at least one other of said other hydrophilic colloid layers contains a hydrazine derivative. A process for the formation of an ultra-high contrast image, which comprises exposing the above-described silver halide photographic material to light, and then developing the silver halide photographic material with a developing solution having a pH of 11.0 to 12.3 and containing 0.15 mol/l or more of sulfite ions.

18 Claims, No Drawings

SILVER HALIDE PHOTOGRAPHIC MATERIAL AND METHOD FOR FORMING SUPER HIGH CONTRAST IMAGES THEREWITH

This is a continuation of Application No. 07/160,970 filed Feb. 26, 1988 now abandoned.

FIELD OF THE INVENTION

The present invention relates to a silver halide photographic material which comprises at least one layer containing a novel light-absorbing compound which can be readily incorporated in a light-sensitive material layer and can be decolored so that the light-sensitive material does not suffer from stain by residual color upon development.

BACKGROUND OF THE INVENTION

It has been a conventional practice that a silver halide photographic material comprises a light-absorbing compound incorporated in a silver halide emulsion layer or other hydrophilic colloid layers to absorb light of a specific wavelength for the purpose of adjusting sensitivity, color temperature of light, or sensitivity balance in a multilayer color light-sensitive material, improving safelight safety, or inhibiting halation or light-fog due to static electricity.

When a silver halide photographic material comprising a hydrophilic colloid layer such as a light-sensitive silver halide emulsion layer provided on a support is imagewise exposed to light to record images on the light-sensitive silver halide emulsion layer, it is necessary to control the spectral composition of the light which is incident upon the silver halide emulsion layer to improve the photographic sensitivity. This is normally accomplished by incorporating a dye capable of absorbing light having a wavelength range which is not required by the light-sensitive silver halide emulsion layer in a hydrophilic colloid layer positioned farther from the support than the light-sensitive silver halide emulsion layer so that a filter layer is provided, whereby only light having a desired wavelength range is transmitted.

In particular a silver halide photographic material for the use in a photoengraving process, more particularly a daylight light-sensitive material, comprises a dye absorbing ultraviolet rays or visible light incorporated in a light-sensitive layer or a layer provided between the light source and the light-sensitive layer to improve the stability to safelight.

Alternatively, such a dye is incorporated in a hydrophilic colloid layer provided between the light-sensitive silver halide emulsion layer and the support to inhibit halation.

The dye which can be used for such a purpose must satisfy various requirements. For example, such a dye must be easily decolored and eluted from the silver halide photographic material upon photographic development so that stain caused by residual color after the development can be inhibited. Such a dye must not exert adverse effects such as fog and desensitization on the photographic emulsion. Such a dye also must not be diffused into other layers from the layer colored thereby. Furthermore, such a dye must have an excellent absorption spectral characteristic depending on the purpose of the light-sensitive material. Moreover, such a dye must have an excellent stability in a silver halide photographic material or solution with time without deterioration.

Efforts have been heretofore made to find dyes satisfying these requirements. Many dyes have been proposed. Examples of such dyes include pyrazoloneoxonol dyes as described in British Pat. No. 506,385, oxonol barbiturate dyes as described in U.S. Pat. No. 3,247,127, azo dyes as described in U.S. Pat. No. 2,390,707, styryl dyes as described in U.S. Pat. No. 2,255,077, hemioxanol dyes as described in British Pat. No. 584,609, melocyanine dyes as described in U.S. Pat. No. 2,493,747, cyanine dyes as described in U.S. Pat. No. 2,843,486, and methylene type benzylidene dyes as described in U.S. Pat. No. 4,420,555.

If the layer containing the above described dye serves as a filter layer or antihalation layer, it is necessary that the layer be selectively colored and the other layers not be substantially colored. If the dye colors the other layers, it not only exerts an adverse spectral effect on the other layers but also inhibits its effects of providing a filter layer or antihalation layer. Also, if a dye incorporated in a particular layer for the purpose of inhibiting irradiation is diffused into and colors the other layers, the same problems as describe above are found.

Further, in a light-sensitive material for printing, when a dye in diffused into a light-sensitive silver halide emulsion layer, a problem which influences tone variability occurs.

Generally, the term "image conversion" for printing means a step in which variable density which is continuously varied is converted into variable dot area. But the image conversion is not always carried out faithfully to a draft, and the modification in which gradiation is softened or hardened is usually carried out in the image conversion in order to meet requirements for obtaining a good texture or gloss of photography. The modification for the gradiation at step of the contact work is carried out by further increasing an exposure amount over a standard exposure At this time, the facility of modification in qradiation is called "tone variability". The modification in gradiation shows an increase of 5 to 10% in dot area over 50% of dot area due to the standard exposure That is, a 55 to 60% of dot area is obtained by the modification. Accordingly, it is desired that the modification is carried out in an exposure amount of about from three to five times as large as standard exposure. That is, if the tone is varied by small variation of an exposure amount, a control of the modification is difficult, and if the tone is varied by large variation of an exposure amount, the time for the modification is long.

It has heretofore been known to localize a so called acidic dye containing sulfo group or carboxy group in a particular layer by means of a mordant in order to solve these problems.

Examples of such a mordant which has been proposed include ethylenically unsaturated compound polymers containing a dialkylaminoalkylester residual group as described in British Pat. No. 685,475, products of a reaction of polyvinylalkyl ketone with aminoguanidine as described in British Pat. No. 850,281, and a vinylpyridine polymer and vinylpyridinium cation polymer as described in U.S. Pat. Nos. 2,548,564, 2,484,430, 3,148,061, and 3,756,814. In order to effectively mordant the above described acidic dye, a cationic mordant containing secondary and tertiary amino groups, a nitrogen-containing heterocyclic group, and a quaternary cationic group thereof in a polymer is used.

However, such a cationic mordant is disadvantageous in that it causes static interaction with gelatin commonly used as a hydrophilic colloid and a surface active agent containing an alcoholate group, carboxylate group, sulfonate group, or sulfate group commonly used as a coating aid, thereby deteriorating the coating properties.

Such a cationic mordant is also disadvantageous in that when it is used in a color light-sensitive material, it may deteriorate desilverability or lower the sensitivity of adjusting the emulsion layer.

It has been proposed to use a large amount of such a mordant to prevent the above described acidic dye from diffusing into the other layers. However, this approach is disadvantageous in that it is impossible to fully inhibit such diffusion and the layer in which the dye is incorporated must be thick, resulting in poor sharpness.

Furthermore, it is a common practice in the art that a light-sensitive material for the use in making photoengraving is subjected to reduction with a reducing solution to adjust density and gradation. This reducing solution contains a water-soluble iron complex as a reducing agent. Therefore, if the above described cationic mordant is used in the light-sensitive material, it is statically bonded to the iron complex, and this iron complex causes a yellow stain.

SUMMARY OF THE INVENTION

Therefore, an object of the present invention is to provide a silver halide photographic material which comprises at least one layer which is colored by a dye and inhibits the dye from being diffused into the other layers, wherein the dye is decolored and eluted from the silver halide photographic material upon photographic development to substantially inhibit stain after the development.

An another object of the present invention is to provide a silver halide photographic material which comprises at least one layer colored by a dye inhibiting interaction with gelatin and a coating aid and having the desired coating properties.

A further object of the present invention is to provide a silver halide photographic material which exhibits an improved desilverability and inhibits reduction in the sensitivity of adjusting the emulsion layer.

A still another object of the present invention is to provide a silver halide photographic material which can inhibit color stain due to a reducing solution upon reduction treatment.

A still further object of the present invention is to provide a silver halide photographic material excellent in stability with time.

These and other objects of the present invention will become more apparent from the following detailed description and examples.

More specifically, these and other objects of the present invention are accomplished with a silver halide photographic material comprising a support having thereon at least one silver halide emulsion layer, the emulsion layer or at least one of other hydrophilic colloid layers containing a compound represented by formula (I):

$$\text{PWR}—(\text{Time})_t\text{LA} \qquad \text{(I)}$$

wherein PWR represents a group which undergoes reduction to release $(\text{Time})_t\text{LA}$; Time represents a group which releases LA upon reaction following release of $(\text{Time})_t\text{LA}$ from PWA; t represents an integer of 0 or 1; and LA represents a group having a maximum light absorption in a wavelength range of 310 nm or more.

In a preferred embodiment, one of the other hydrophilic colloid layers substantially free of the compound represented by formula (I) is provided between the at least one silver halide emulsion layer in the silver halide photographic material and one of the other hydrophilic colloid layers containing the compound represented by formula (I), and at least one of these hydrophilic colloid layers or at least one other of the other hydrophilic colloid layers contains a hydrazine derivative.

The present invention also provides a process for the formation of an ultrahigh contrast image, which comprises exposing the above-described silver halide photographic material to light, and then developing the silver halide photographic material with a developing solution having a pH of 11.0 to 12.3 and containing 0.15 mol/l or more of sulfite ion.

DETAILED DESCRIPTION OF THE INVENTION

In the silver halide photographic material of the invention, when the compound represented by formula (I) is incorporated in a hydrophilic colloid layer, a hydrophilic colloid layer substantially free of a compound represented by formula (I) may be provided between the hydrophilic colloid layer containing the compound represented by formula (I) and at least one silver halide emulsion layer, and at least one of these hydrophilic colloid layers or other hydrophilic colloid layers may contain a hydrazine derivative therein.

The present invention will be further described with reference to the compound of formula (I) to be used in the present invention.

PWR will be first described in detail.

PWR may correspond to a portion containing an electron accepting center and an intramolecular nucleophilic substitution reaction center in a compound which undergoes an intramolecular nucleophilic substitution reaction after being reduced to release a photographic reagent as described in U.S. Pat. Nos. 4,139,389, and 4,139,379, and Japanese Patent Application (OPI) No. 185,333/84 (the term "OPI" as used herein means an "unexamined published Japanese patent application") or may correspond to a portion containing an electron accepting quinoid center and a carbon atom which connects this center to a photographic reagent in a compound which undergoes an intramolecular electron migration reaction after being reduced to release the photographic reagent as described in U.S. Pat. No. 4,232,107, and Japanese Patent Application (OPI) Nos. 101,649/84, and 88,257/86. Alternatively, PWR may correspond to a portion containing an aryl group substituted by an electrophilic group and an atom (e.g., sulfur atom, carbon atom or nitrogen atom) which connects the aryl group to a photographic reagent in a compound which undergoes cleavage of a single bond after being reduced to release the photographic reagent as described in U.S. Pat. Nos. 4,343,893 and 4,619,884 and Japanese Patent Application (OPI) No. 142530/81. Furthermore, PWR may correspond to a portion containing a nitro group and a carbon atom which connects the nitro group to a photographic reagent in a nitro compound which releases the photographic reagent after accepting electrons as described in U.S. Pat. No. 4,450,223 or may correspond to a portion containing a diaminaldinitro portion and a carbon atom which connects the diaminaldinitro portion to a photographic reagent in a dinitro compound which causes $\beta$-separation of the photographic reagent after accepting electrons as described in U.S. Pat. No. 4,609,610. However, in order to accomplish the objects of the present invention more sufficiently, the compound represented by formula (I) is preferably one represented by formula (II):

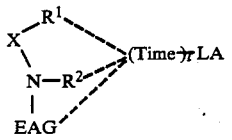

(II)

wherein

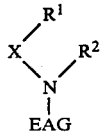

corresponds to PWR in the formula (I).

(Time)$_i$LA is bonded to at least one of $R^1$, $R^2$ and EAG.

X represents an oxygen atom (—O—), sulfur atom (—S—), or a nitrogen-containing group

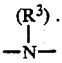

EAG represents a group which accepts electrons from a reducing substance and is bonded to a nitrogen atom. EAG is preferably a group represented by formula [A] or [B]:

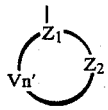

[A]

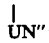

[B]

In the formula [A], $Z_1$ represents

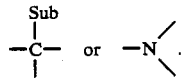

Vn′ represents an atomic group which forms a 3- to 8-membered ring together with $Z_1$ and $Z_2$. The suffix n′ represents an integer of 3 to 8, with the proviso that $V_3$, $V_4$, $V_5$, $V_6$, $V_7$ and $V_8$ are $—Z_3—$, $—Z_3—Z_4—$, $—Z_3—Z_4—Z_5—$, $—Z_3—Z_4—Z_5—Z_6—$, $—Z_3—Z_4—Z_5—Z_6—Z_7$, and $—Z_3—Z_4—Z_5—Z_6—Z_7—Z_8—$, respectively.

$Z_2$ to $Z_8$ each represents

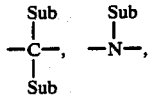

—O—, —S—, or $—SO_2—$. Sub represents a mere bond ($\pi$ bond or $\sigma$ bond), hydrogen atom or substituent as described below. The groups represented by Sub may be the same or different or may be bonded to each other to form a 3- to 8-membered saturated or unsaturated carbon ring or heterocyclic ring. In the formula [A], Sub is selected such that the sum of Hammett's substituent constant $\sigma p$ of the substituent is +0.09 or more, preferably +0.3 or more, and particularly +0.45 or more.

Preferred examples of the substituents represented by Sub include a substituted or unsubstituted alkyl group such as a methyl group, an ethyl group, a sec-butyl group, a t-octyl group, a benzyl group, a cyclohexyl group, a chloromethyl group, a dimethylaminomethyl group, an n-hexadecyl group, a trifluoromethyl group, a 3,3,3-trichloropropyl group, and a methoxycarbonylmethyl group; a substituted or unsubstituted alkenyl group such as a vinyl group, a 2-chlorovinyl group, ana a 1-methylvinyl group; a substituted or unsubstituted alkynyl group such as an ethynyl group or 1-propynyl group; a cyano group; a nitro group; a halogen atom such as a fluorine atom, chlorine atom, bromine atom, and iodine atom; a substituted or unsubstituted heterocyclic residual group such as a 2-pyridyl group, a 1-imidazolyl group, a benzothiazole-2-il group, a morpholino group, and a benzooxazole-2-il group; a sulfo group; a carboxyl group; a substituted or unsubstituted aryloxycarbonyl or alkoxycarbonyl group such as a methoxycarbonyl group, an ethoxycarbonyl group, a tetradecyloxycarbonyl group, a 2-methoxyethylcarbonyl group, a phenoxycarbonyl group, a 4-cyanophenylcarbonyl group, and a 2-chlorophenoxycarbonyl group; a substituted or unsubstituted carbamoyl group such as a carbamoyl group, a methylcarbamoyl group, a diethylcarbamoyl group, a methylhexadecylcarbamoyl group, a methyloctadecylcarbamoyl group, a phenylcarbamoyl group, a 2,4,5-trichlorophenylcarbamoyl group, an N-ethyl-N-phenylcarbamoyl group, and a 3-hexadecylsulfamoylphenylcarbamoyl group; a hydroxy group; a substituted or unsubstituted azo group such as a phenylazo group, a p-methoxyphenylazo group, and a 2-cyano-4-methanesulfonylphenylazo group; a substituted or unsubstituted aryloxy or alkoxy group such as a methoxy group, an ethoxy group, a dodecyloxy group, a benzyloxy group, a phenoxy group, a 4-methoxyphenoxy group, a 3-acetylaminophenoxy group, a 3-methoxycarbonylpropyloxy group, and a 2-trimethylammonioethoxy group; a sulfino group; a sulfeno group; a mercapto group; a substituted or unsubstituted acyl group such as an acetyl group, a trifluoroacetyl group, an n-butyloyl group, a t-butyloyl group, a benzoyl group, a 2-carboxybenzoyl group, a 3-nitrobenzoyl group, and a formyl group; a substituted or unsubstituted aryl or alkylthio group such as a methylthio group, an ethylthio group, a t-octylthio group, a hexadecylthio group, a phenylthio group, a 2,4,5-trichlorothio group, a 2-methoxy-5-t-octylphenylthio group, and a 2-acetylaminophenylthio group; a substituted or unsubstituted aryl group such as a phenyl group, a naphthyl group, a 3-sulfophenyl group, a 4-methoxyphenyl group, and a 3-lauroylaminophenyl group; a substituted or unsubstituted sulfonyl group such as a methylsulfonyl group, a chloromethylsulfonyl group, an n-octylsulfonyl group, an n-hexadecylsulfonyl group, a sec-octylsulfonyl group, a p-toluenesulfonyl group, a 4-chlorophenylsulfonyl group, a 4-dodecylphenylsulfonyl group, a 4-dodecyloxyphenylsulfonyl group, and a 4-nitrophenylsulfonyl group; a substituted or unsubstituted sulfinyl group such as a methylsulfinyl group, a dodecylsulfinyl group, a phenylsulfinyl group, and a 4-nitrophenylsulfinyl group; a substituted or unsubstituted amino group such as a methylamino group, a diethylamino group, a methyloctadecylamino group, a phenylamino group, an ethylphenylamino group, a 3-tetradecylsulfamoylphenylamino group, an acetylamino group, a trifluoroacetylamino group, an N-hexadecylacetylamino group, an N-methylbenzoylamino group, a methoxycarbonylamino group, a phenoxycarbonylmethyl group, an N-methoxyacetylamino group, an amidinoamino group, a phenylaminocarbonylamino group, a 4-cyanophenylaminocarbonylamino group, an N-ethylethoxycarbonylamino group, an N-methyldodecylsulfonylamino group, an N-(2-cyanoethyl)-p-toluenesulfonylamino group, a hexadecylsulfonylamino group, and a trimathylammonio group; a substituted or unsubstituted sulfamoyl group such as a dimethylsulfamoyl group, a hexadecylsulfamoyl group, a sulfamoyl group, a methyloctadecylsulfamoyl group, a methylhexadecylsulfamoyl group, a 2-cyanoethylhexadecylsulfamoyl group, a phenylsulfamoyl group, an N-(3,4-dimethylphenyl)-N-octylsulfamoyl group, a dibutylsulfamoyl group, a dioctadecylsulfamoyl group, and a bis(2-methoxycarbonylethyl)sulfamoyl group; a substituted or unsubstituted acyloxy group such as an acetoxy group, a benzoyloxy group, a decyloyloxy group, and a chloroacetoxy group; and a substituted or unsubstituted sulfonyloxy group such as a methylsulfonyloxy group, a p-toluenesulfonyloxy group, and a p-chlorophenylsulfonyloxy group. These groups each preferably contains 0 to 40 carbon atoms, and more preferably 0 to 20 carbon atoms.

In the formula [B], n'' represents an integer of 1 to 6, with the proviso that $U_1$, $U_2$, $U_3$, $U_4$, $U_5$, and $U_6$ are $-Y_1$, $-Y_1-Y_2$, $-Y_1-Y_2-Y_3$, $-Y_1-Y_2-Y_3-Y_4$, $-Y_1-Y_2-Y_3-Y_4-Y_5$, and $-Y_1-Y_2-Y_3-Y_4-Y_5-Y_6$, respectively.

$Y_1$ to $Y_6$ each represents

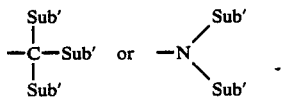

in which Sub' represents a mere bond ($\sigma$ bond or $\pi$ bond) or a substituent represented by Sub in the formula [A]. In the formula [B], Sub' is selected such that the sum of Hammett's substituent constant $\sigma p$ of the substituent is +0.09 or more, preferably +0.3 or more, particularly +0.45 or more.

Specific examples of EAG include an aryl group substituted by at least one electrophilic group such as a 4-nitrophenyl group, a 2-nitro-4-N-methyl-N-octadecylsulfamoylphenyl group, a 2-N,N-dimethylsulfamoyl-4-nitrophenyl group, a 2-cyano-4-octadecylsulfonylphenyl group, a 2,4-dinitrophenyl group, a 2,4,6-tricyanophenyl group, a 2-nitro-4-N-methyl-N-octadecylcarbamoylphenyl group, a 2-nitro-5octylthiophenyl group, a 2,4-dimethanesulfonylphenyl group, a 3,5-dinitrophenyl group, a 2-chloro-4-nitro-5-methylphenyl group, a 2-nitro-3,5-dimethyl-4-tetradecylsulfonylphenyl group, a 2,4-dinitronaphthyl group, a 2-ethylcarbamoyl-4-nitrophenyl group, a 2,4-bis-dodecylsulfonyl-5-trifluoromethylphenyl group, a 2,3,4,5,6-pentafluorophenyl group, a 2-acetyl-4-nitrophenyl group, a 2,4-diacetylphenyl group, and a 2-nitro-4-trifluoromethylphenyl group; a substituted or unsubstituted heterocyclic group such as a 2-pyridyl group, a 2-pyradyl group, a 5-nitro-2-pyridyl group, a 5-N-hexadecylcarbamoyl-2-pyridyl group, a 4-pyridyl group, a 3,5-dicyano-2-pyridyl group, a 5-dodecylsulfonyl-2-pyridyl group, a 5-cyano-2-pyradyl group, a 4-nitrothiophene-2-il group, a 5-nitro-1,2-dimethylimidazole-4-il group, a 3,5-diacetyl-2-pyridyl group, and a 1-dodecyl-5-carbamoylpyridinium-2-il group; substituted or unsubstituted quinones such as a 1,4-benzoquinone-2-il group, a 3,5,6-trimethyl-1, a 4-benzoquinone-2-il group, a 3-methyl-1,4-naphthoquinone-2-il group, a 3,6-dimethyl-5-hexadecylthio-1,4-benzoquinone-2-il group, and a 5-pentadecyl-1,2-benzoquinone-4-il group; a nitroalkyl group such as a 2-nitro-2-propyl group; a nitroalkenyl group such as a 2-nitroethenyl group; and a monovalent group of an -diketo compound such as a 2-oxopropanoyl group.

$R^1$, $R^2$ and $R^3$ each represents a group other than a hydrogen atom or a mere bond ($\sigma$ bond or $\pi$ bond).

$R^1$ and $R^3$ each is preferably a substituted or unsubstituted alkyl group, aryl group, heterocyclic residual group, acyl group, or sulfonyl group. These groups each preferably contains 0 to 20 carbon atoms.

$R^2$ is preferably a substituted or unsubstituted acyl group or sulfonyl group, having preferably 0 to 20 carbon atoms. $R^1$, $R^2$ and $R^3$ may be bonded to each other to form a 5- to 8-membered ring.

In order to accomplish the objects of the present invention, more sufficiently, the compound represented by formula (II) is preferably one represented by formula (III):

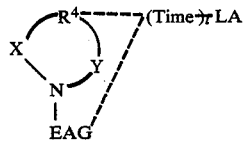

(III)

wherein

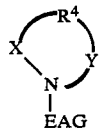

corresponds to PWR. $(Time)_t$LA is bonded to at least one of $R^4$ and EAG. In the portion in the formula (III) corresponding to PWR, Y represents a divalent connecting group which is preferably

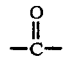

or $-SO_2-$, X represents —O—, —S—, or

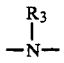

as described above. X preferably represents an oxygen atom (—O—).

$R^4$ represents an atomic group which is bonded to X and Y to form a nitrogen-containing 5- to 8-membered mono or condensed heterocyclic ring.

Preferred examples of the portion represented by

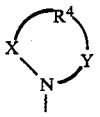

will be hereinafter. These examples also show the position at which time LA is bonded to the portion represented by

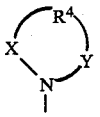

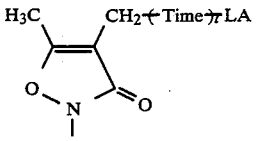

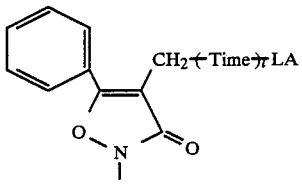

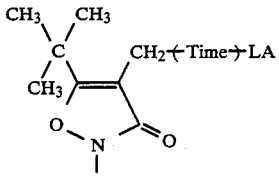

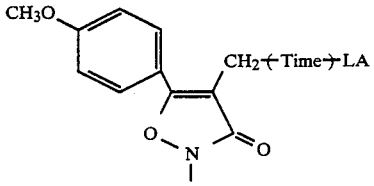

-continued

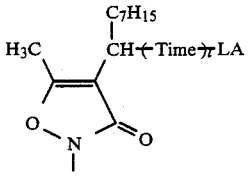

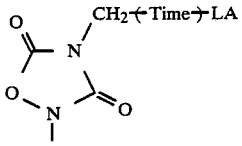

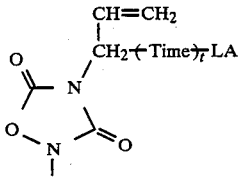

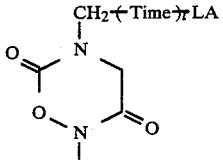

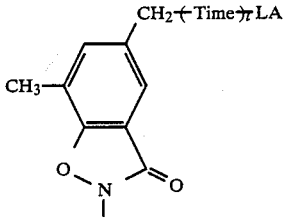

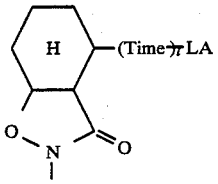

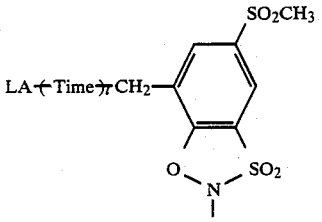

-continued

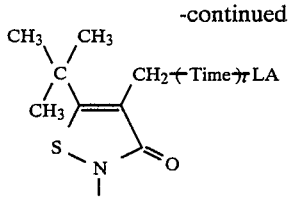

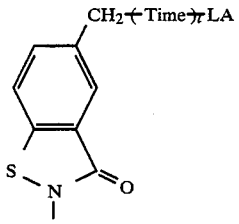

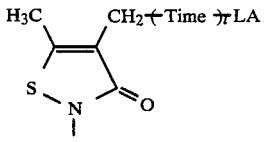

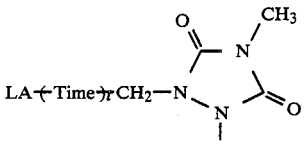

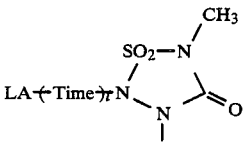

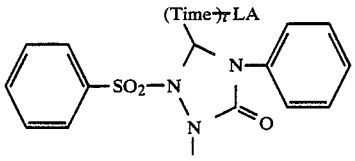

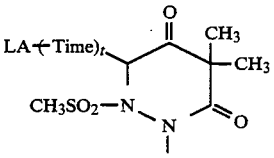

-continued

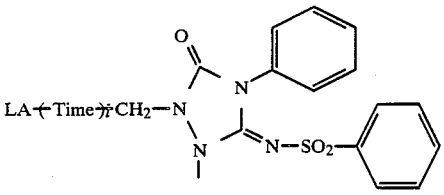

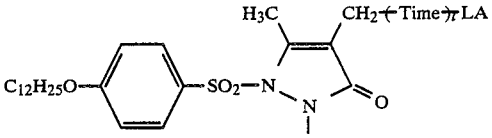

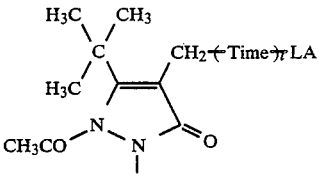

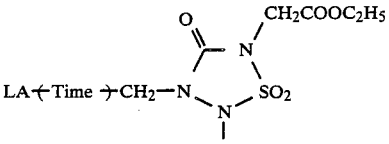

Time, in the formula (I), (II), and (III),represents a group which releases LA by a reaction triggered by the cleavage of the N-X bond.

The suffix t represents an integer of 0 or 1. when t is 0, Time represents a mere bond.

Examples of the groups represented by Time in the formula (I), (II) and (III) include those described as Time in Japanese Patent Application (OPI) No. 236,659/86.

Examples of groups which may be preferably used as Time in formulae (I), (II), and (III) of the present invention will be shown hereinafter. In the present compound, the mark (*) indicates the position at which the group (Time) is bonded to PWR, and the mark (*) (*) indicates the position at which the group (Time) is bonded to LA.

(1)

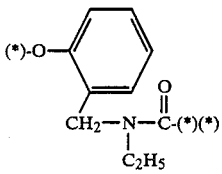

-continued
(2)
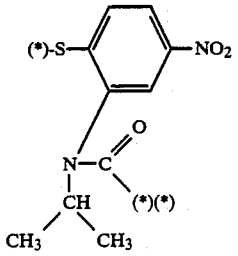
(3)
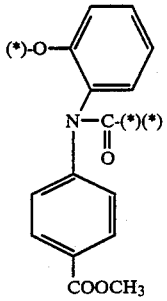
(4)
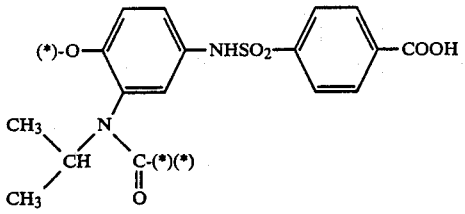
(5)
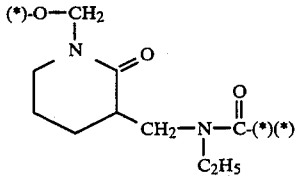
(6)
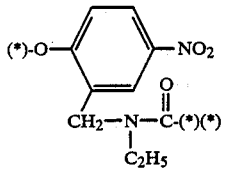
(7)
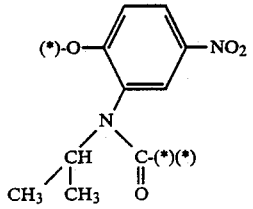
(8)
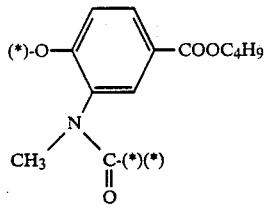

-continued
(9)
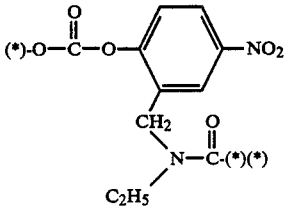
(10)
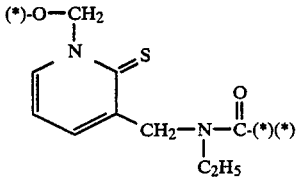
(11)
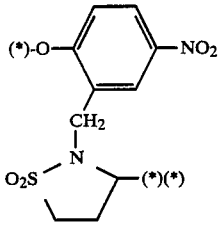
(12)
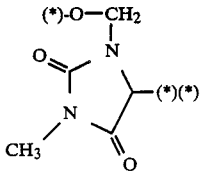
(13)
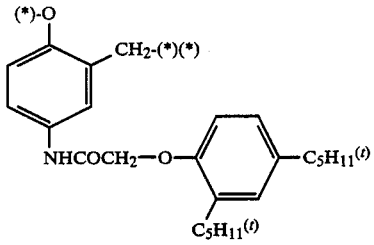
(14)
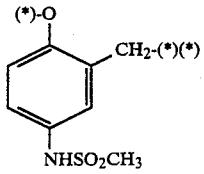
(15)
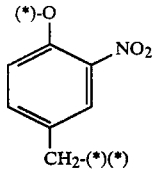

-continued
(16)
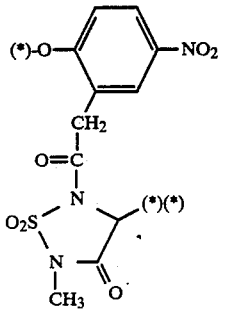
(17)
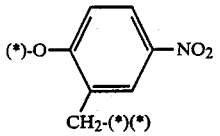
(18)
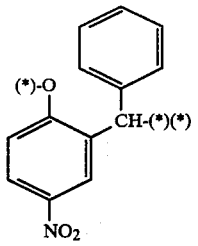
(19)
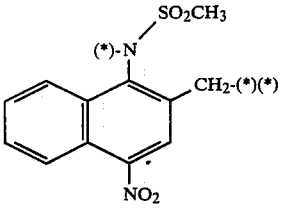
(20)
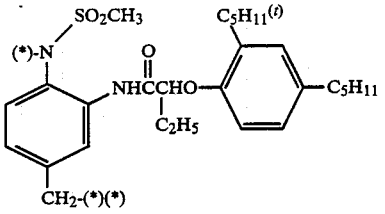
(21)
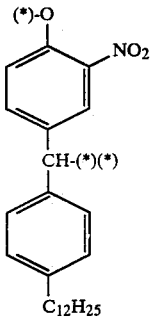

-continued
(22)
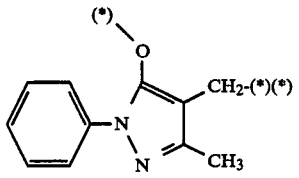
(23)
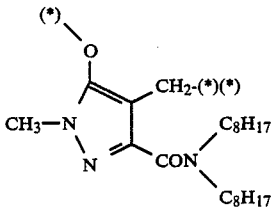
(24)
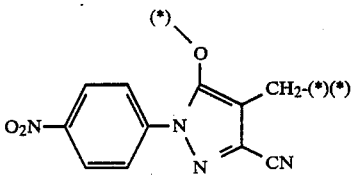
(25)
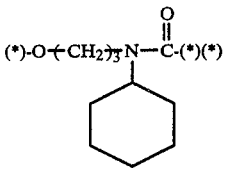
(26)
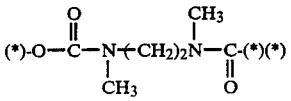
(27)
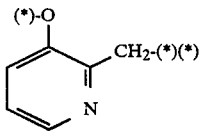
(28)
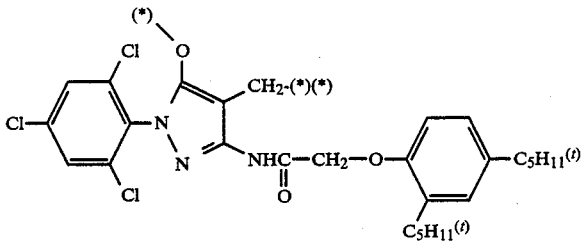
(29)
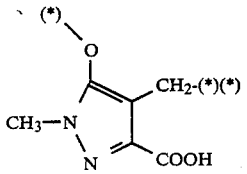
(30)
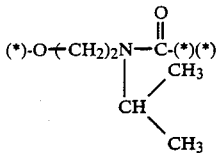

-continued
(31)
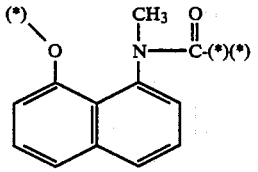
(32)
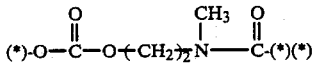
(33)
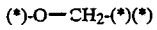
(34)
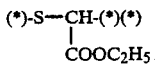
(35)
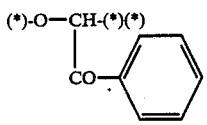
(36)
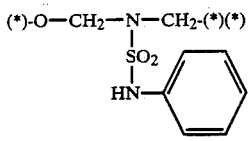
(37)
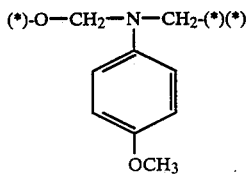
(38)
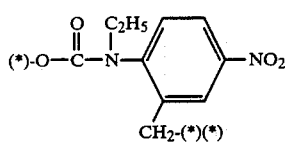
(39)
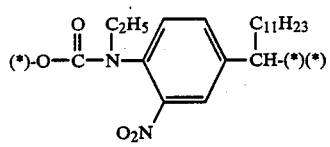
(40)
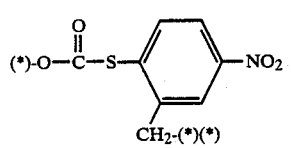
(41)
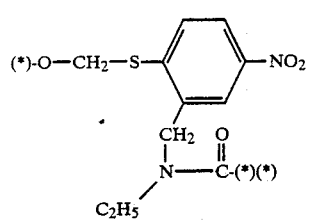

-continued (42)

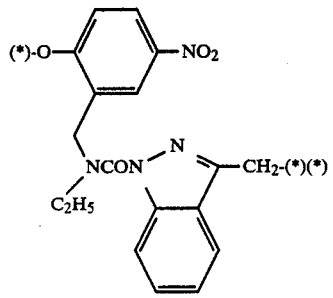

LA represents a group having the maximum absorption in a wavelength range of 310 nm or more which is a dye used in a silver halide photographic material.

Examples of such a dye include an arylidene dye, styryl dye, butadiene dye, oxonol dye, cyanine dye, melocyanine dye, hemicyanine dye, diarylmethane dye, triarylmethane dye, azomethine dye, azo dye, metal chelate dye, anthraquinone dye, stilbene dye, chalcone dye, and indophenol dye.

Specific examples of compounds of the formula (I) which can be used in the present invention will be shown hereinafter, but the present invention should not be construed as being limited thereto.

I-1
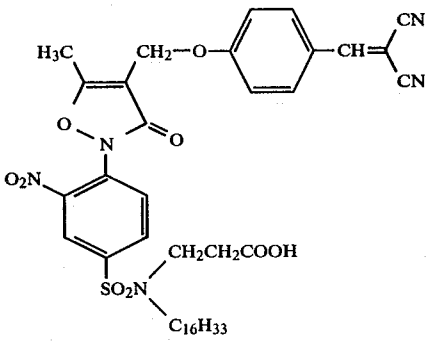
I-2
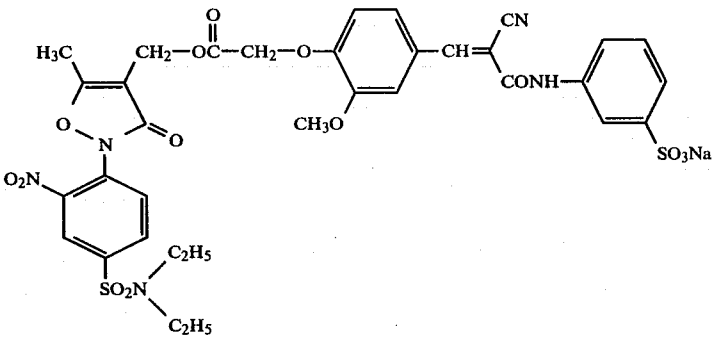
I-3
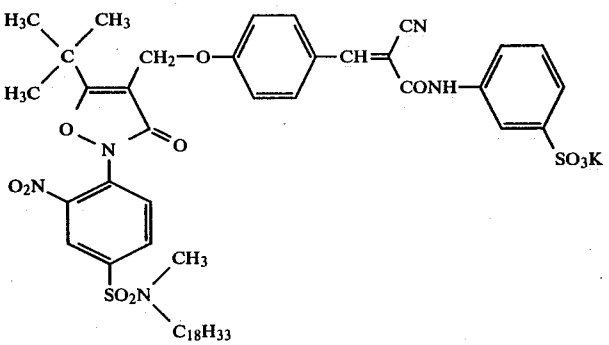

-continued
I-4
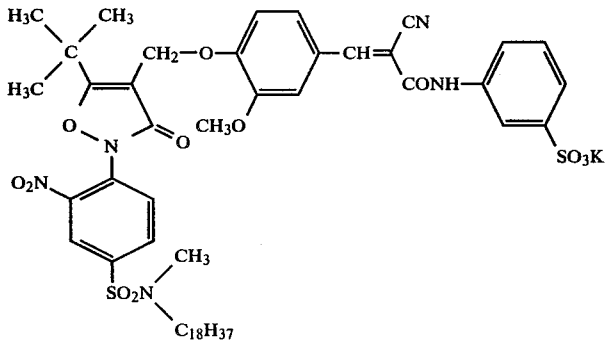
I-5
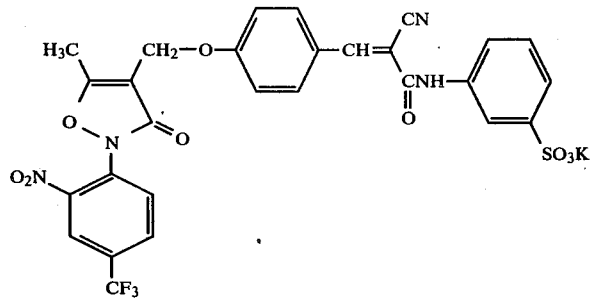
I-6
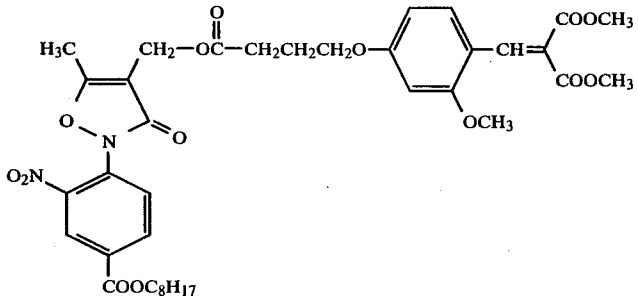

-continued
I-7
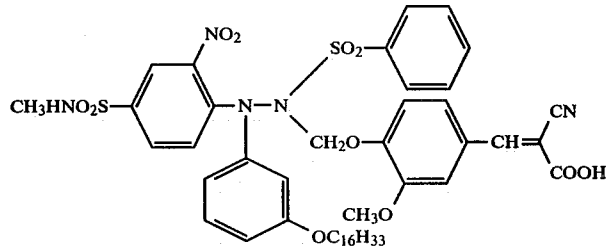
I-8
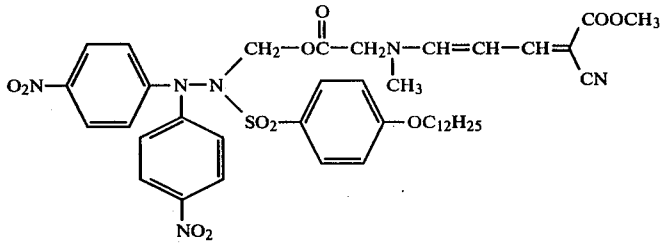
I-9
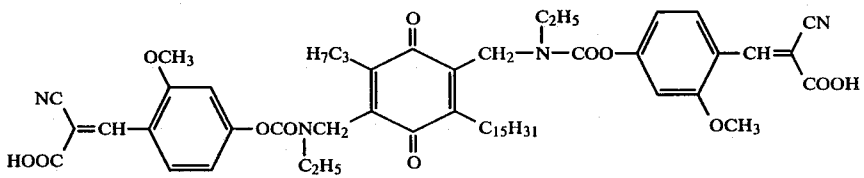
I-10
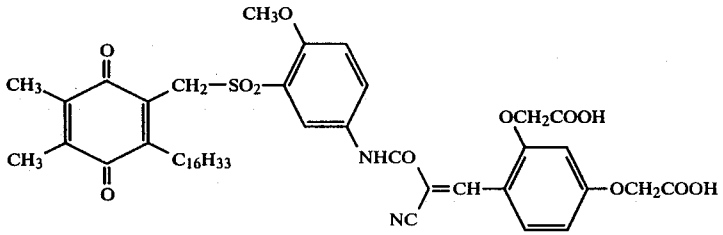

-continued
I-11
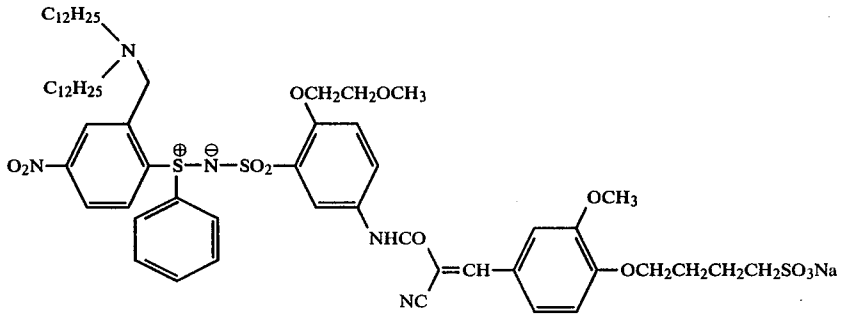
I-12
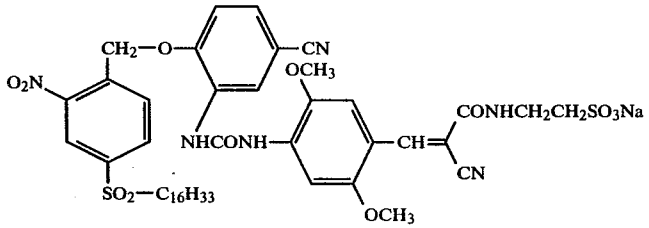
I-13
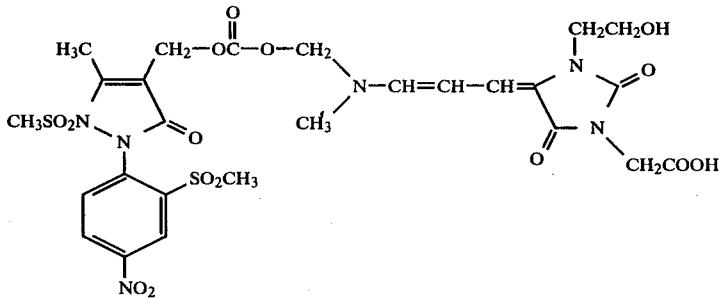

-continued
I-14
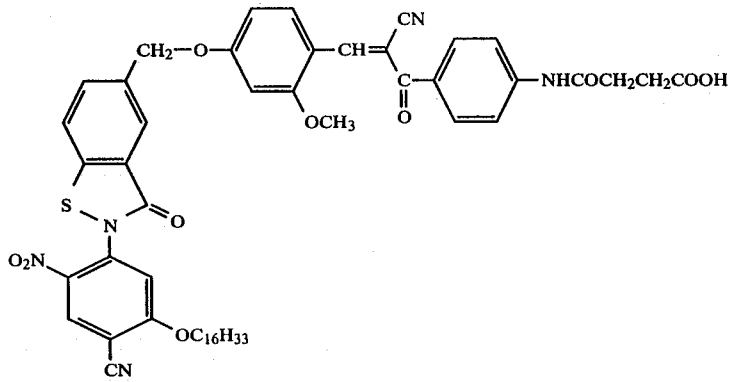
I-15
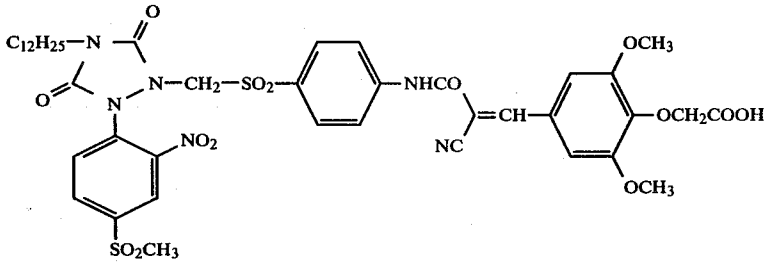
I-16
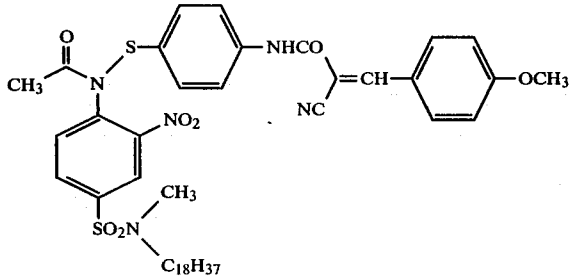

-continued
I-17
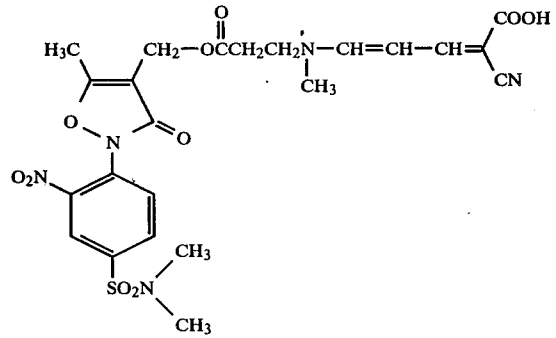
I-18
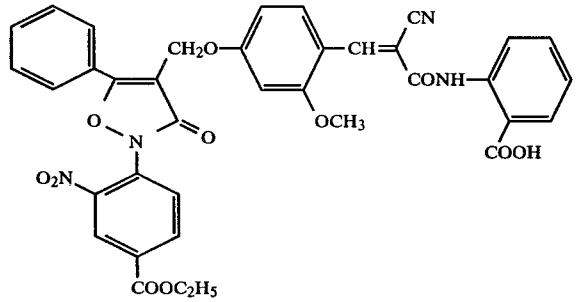
I-19
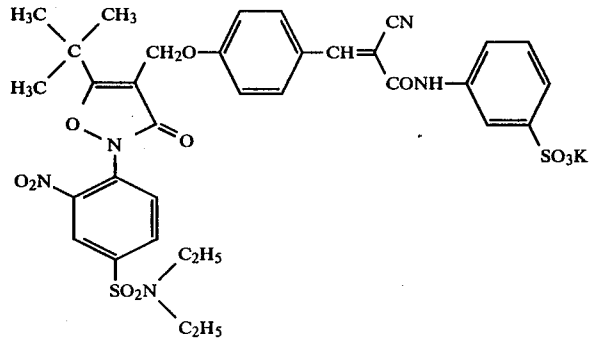

-continued
I-20
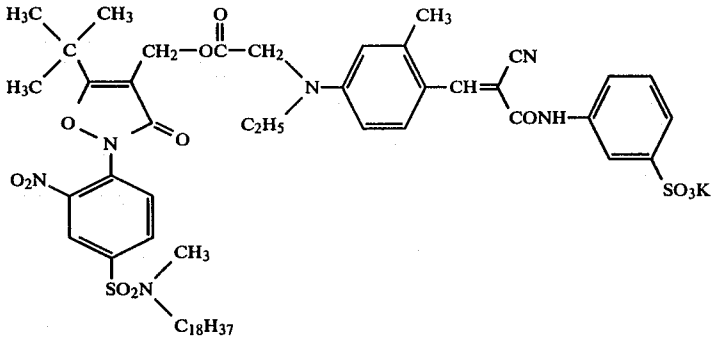
I-21
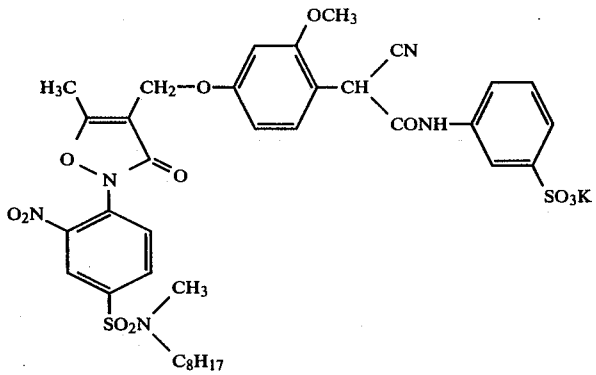
I-22
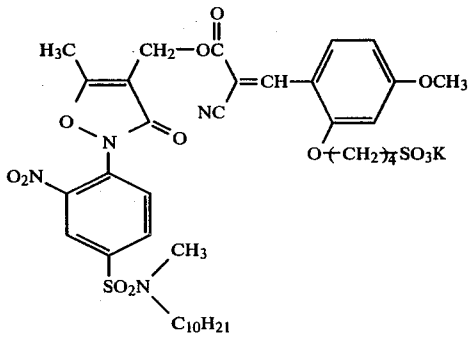

-continued
I-23
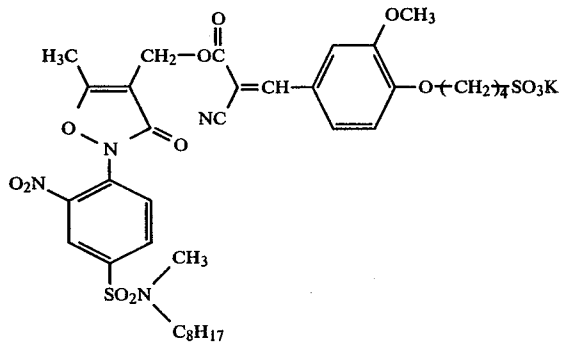
I-24
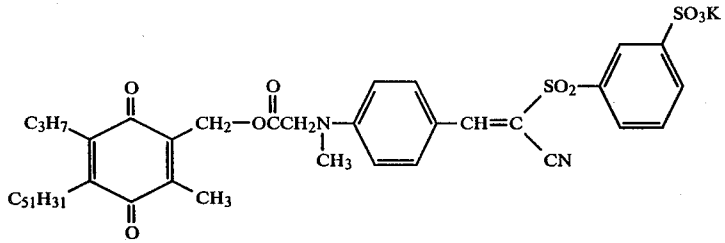
I-25
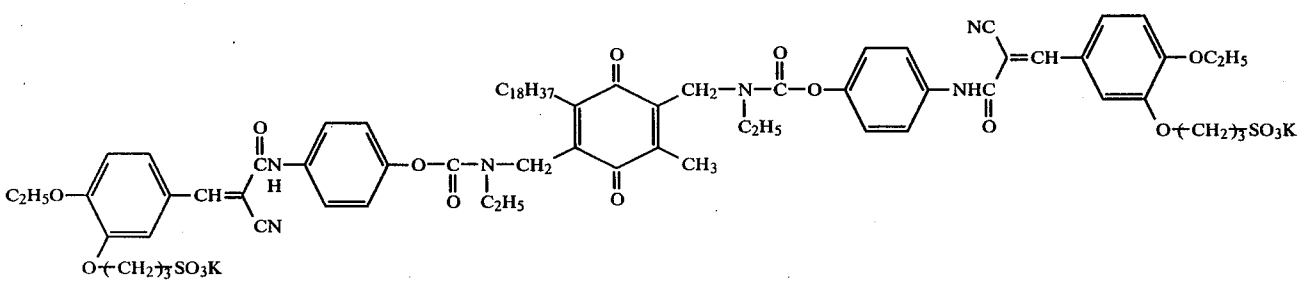

-continued
I-26
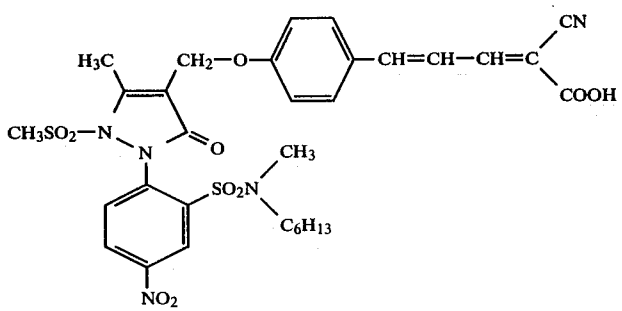
I-27
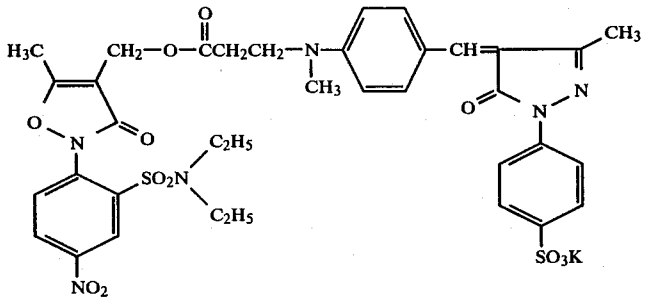
I-28
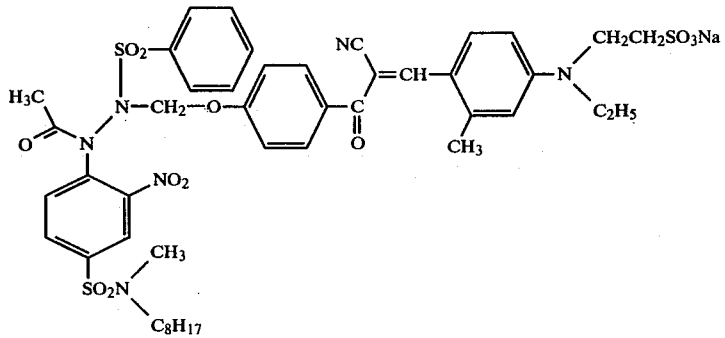

-continued
I-29
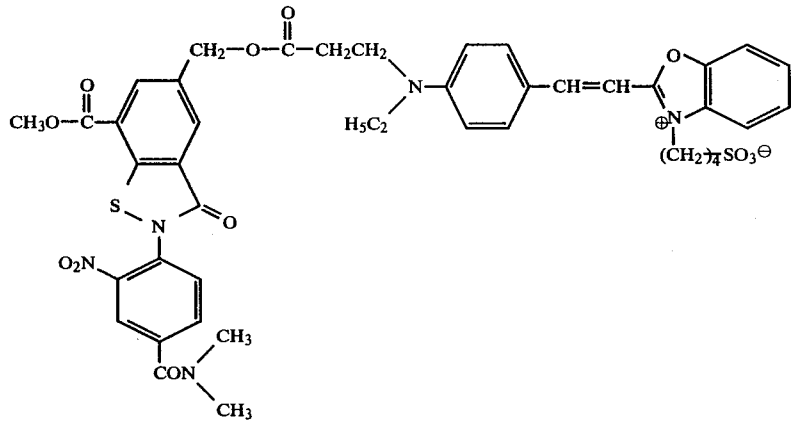
I-30
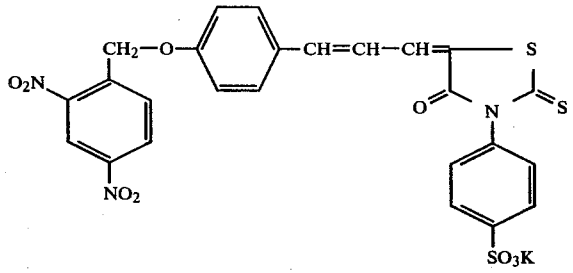
I-31
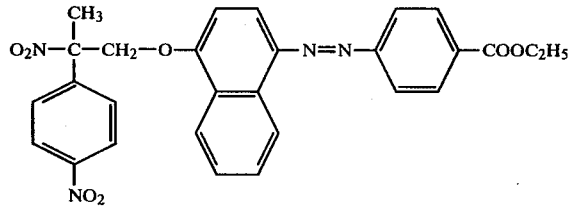

-continued
I-32
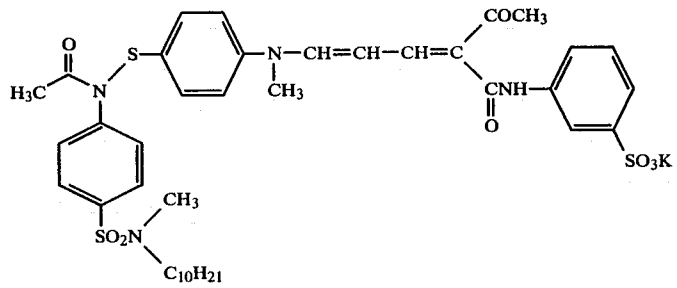
I-33
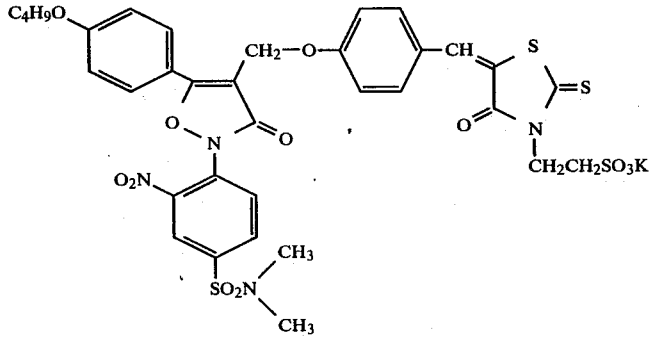
I-34
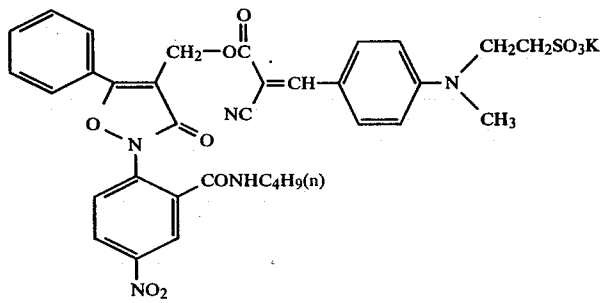

-continued
I-35
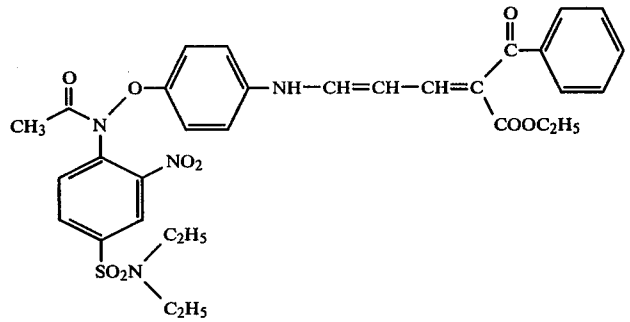
I-36
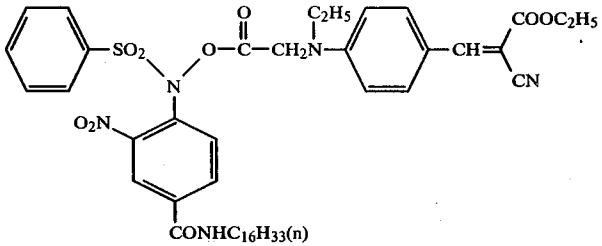
I-37
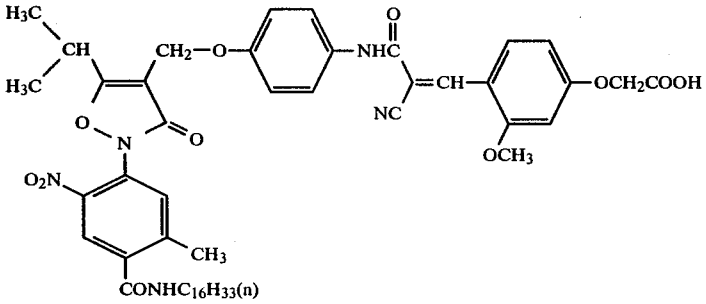

-continued
I-38
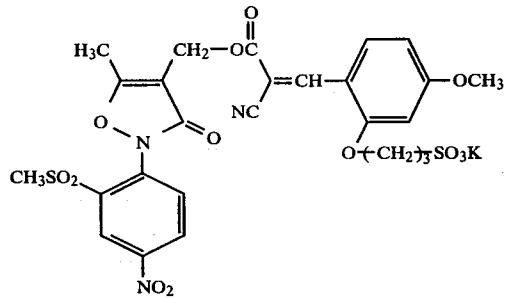
I-39
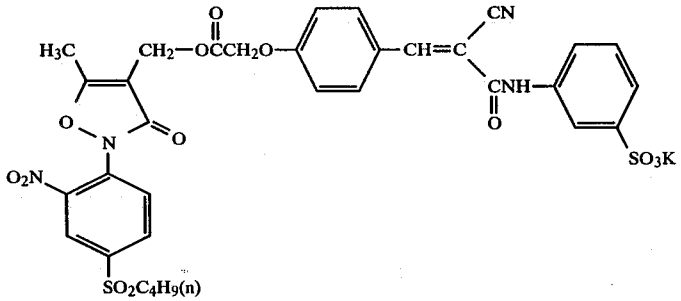
I-40
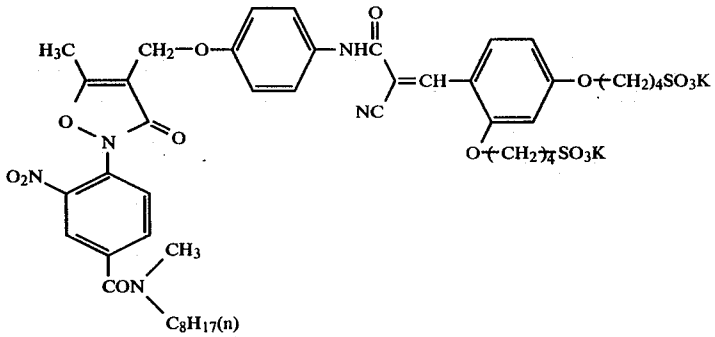

-continued
I-41
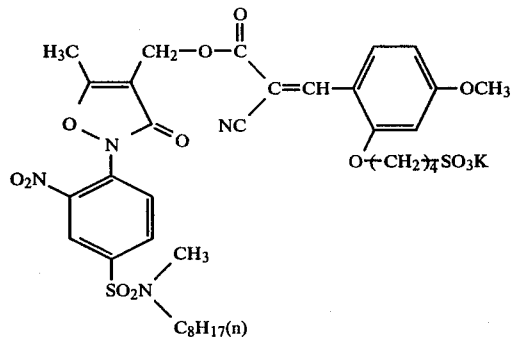
I-42
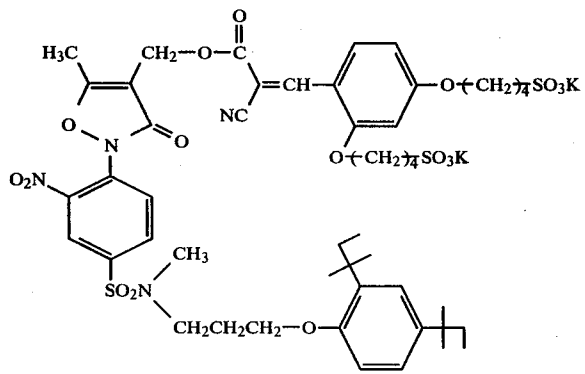

-continued
I-43
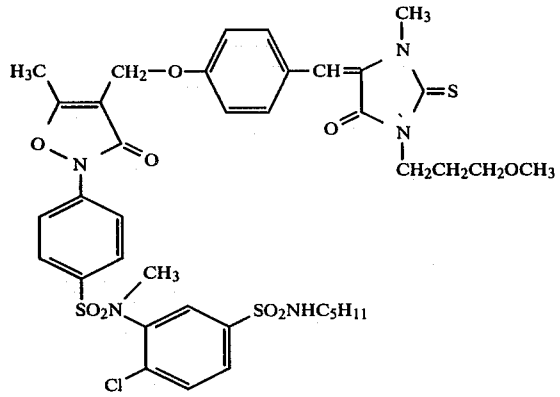
I-44
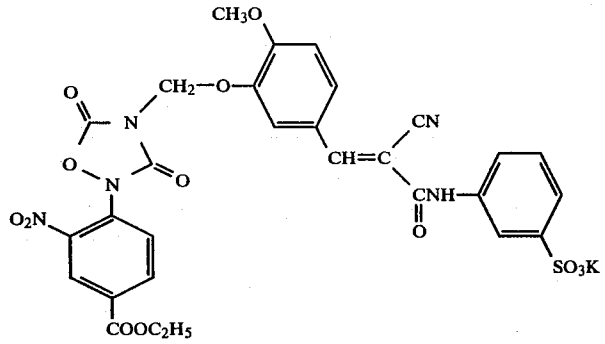
I-45
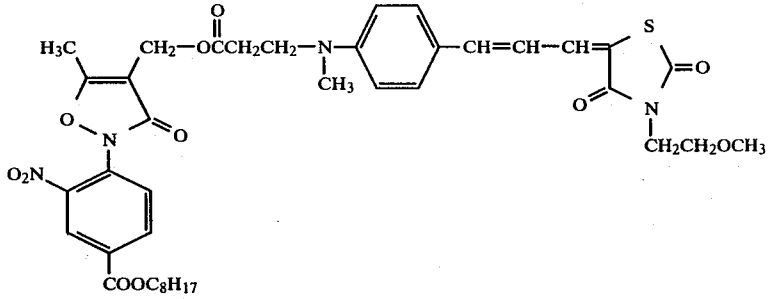

-continued
I-46
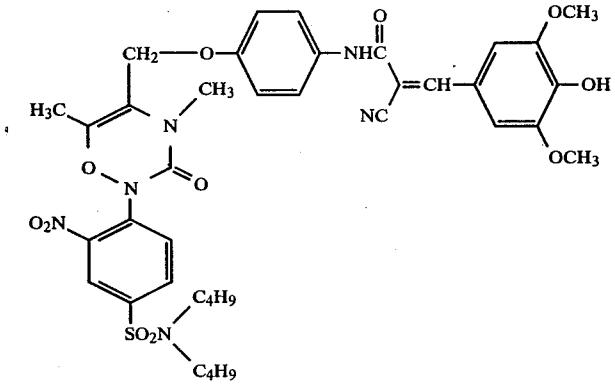
I-47
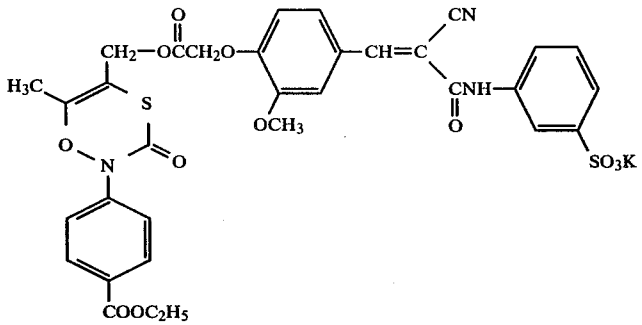
I-48
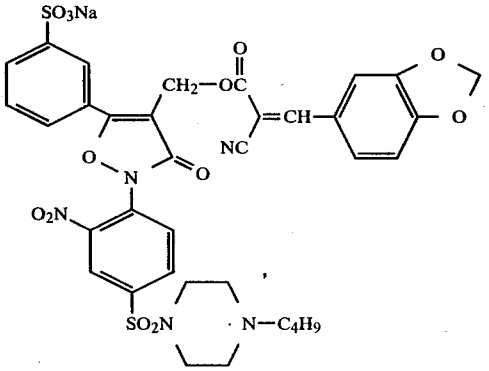

-continued
I-49
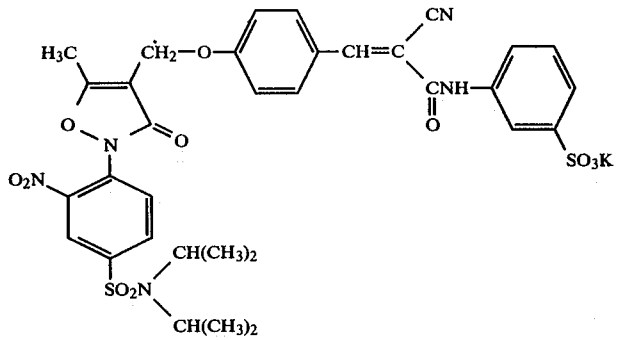
I-50
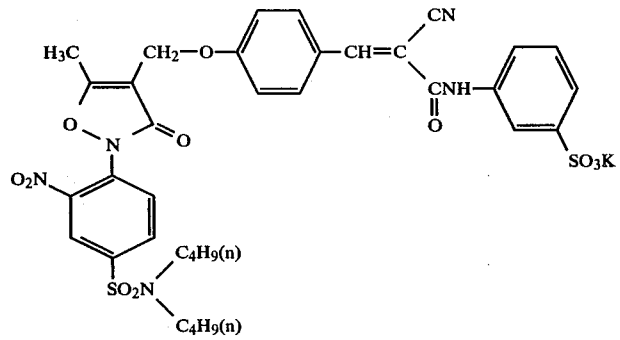
I-51
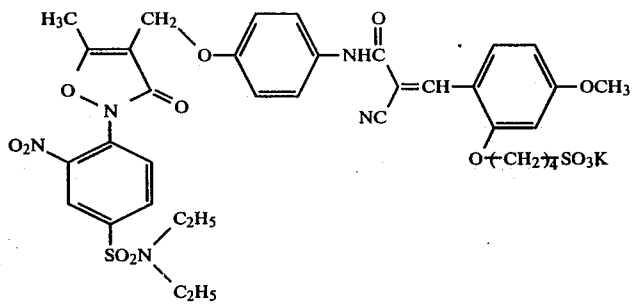

-continued
I-52
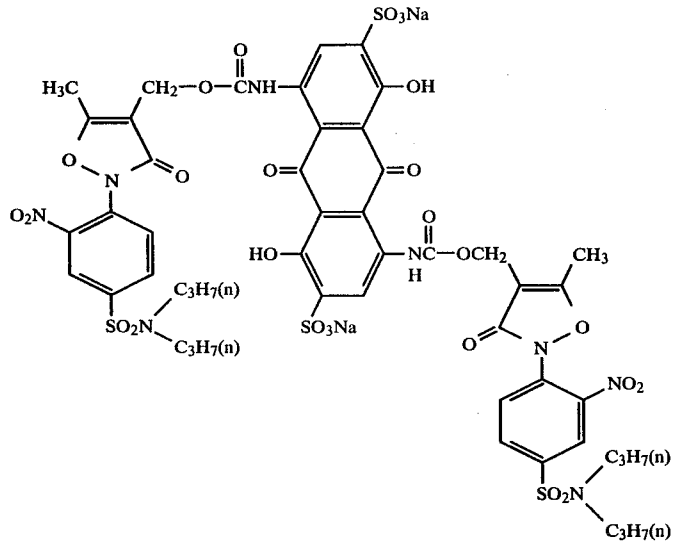
I-53
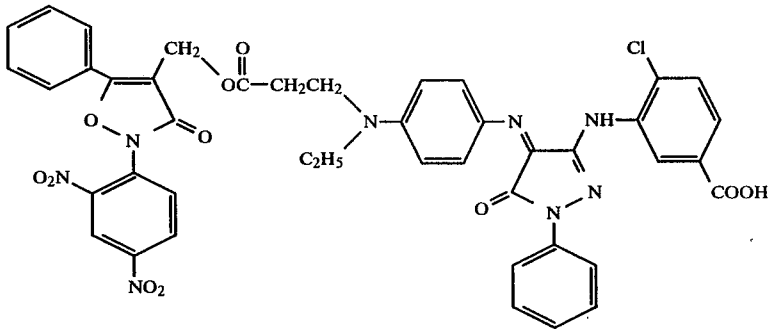

-continued
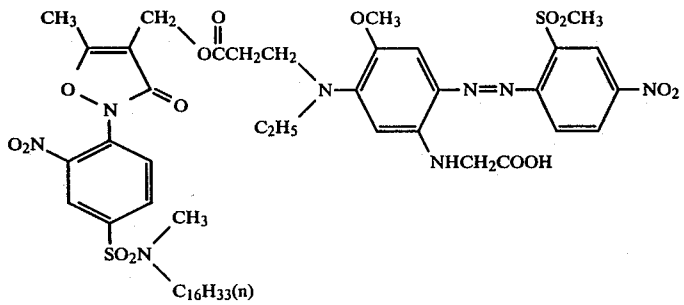
I-54
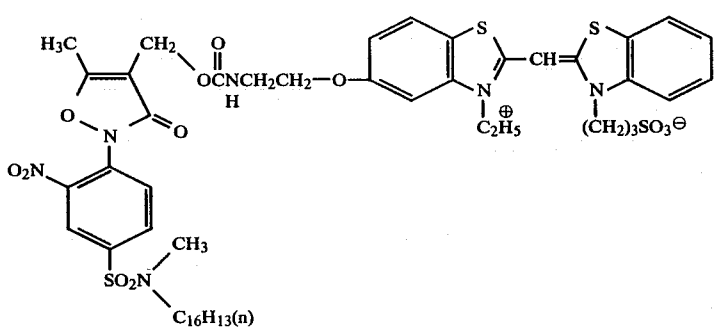
I-55
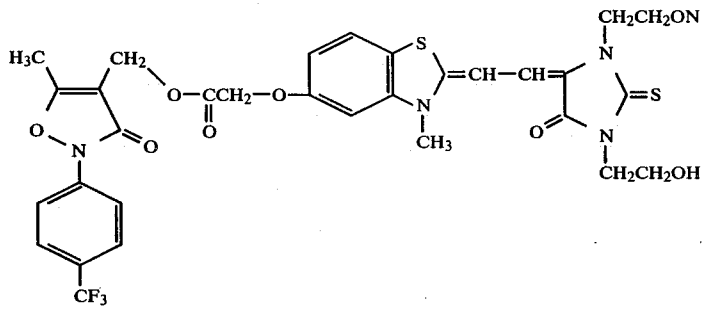
I-56

-continued
I-57
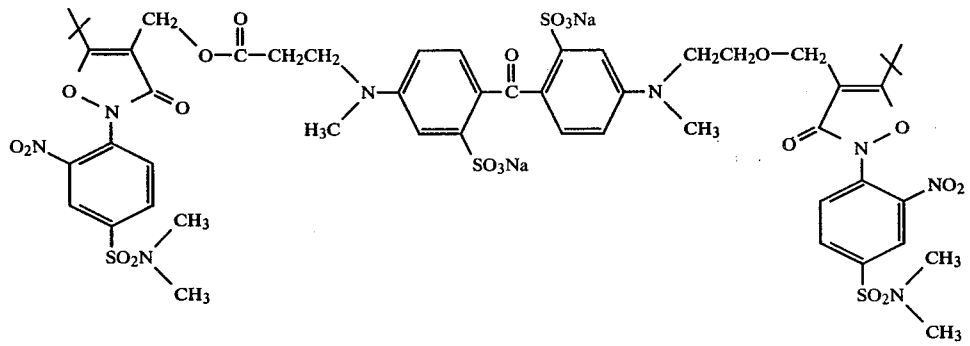
I-58
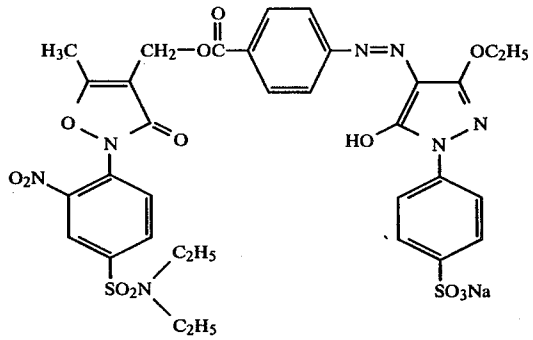
I-59
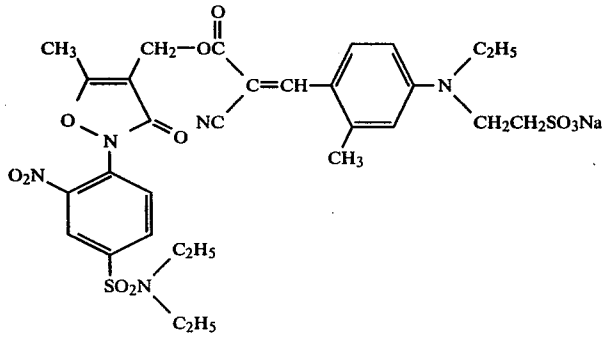

-continued
I-60
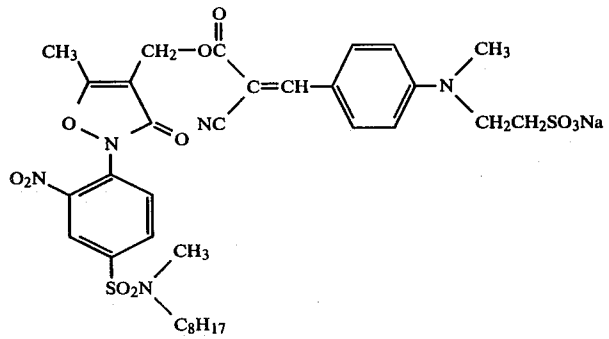
I-61
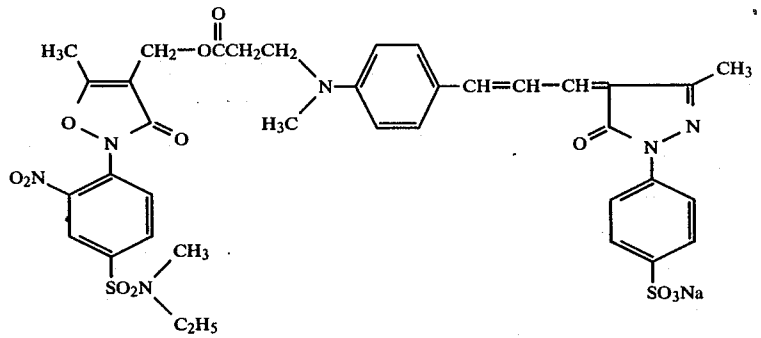
I-62
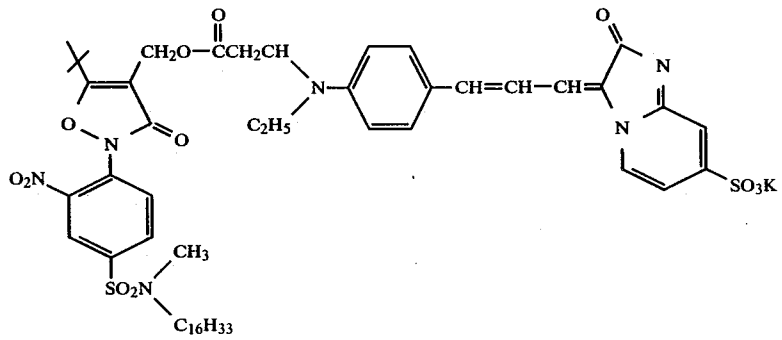

-continued
I-63
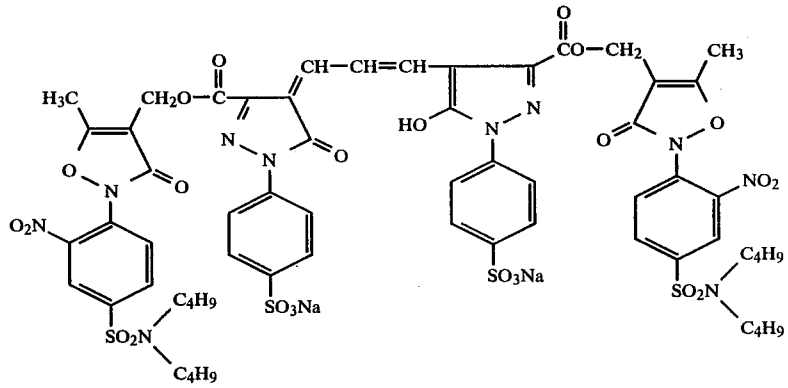
I-64
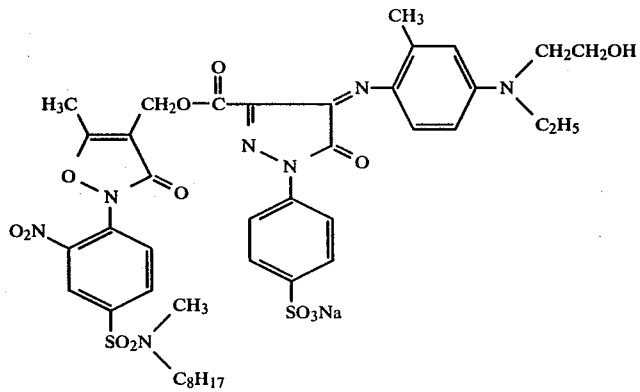

-continued
I-65
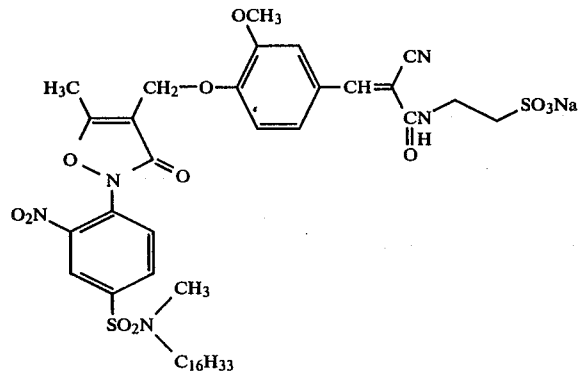
I-66
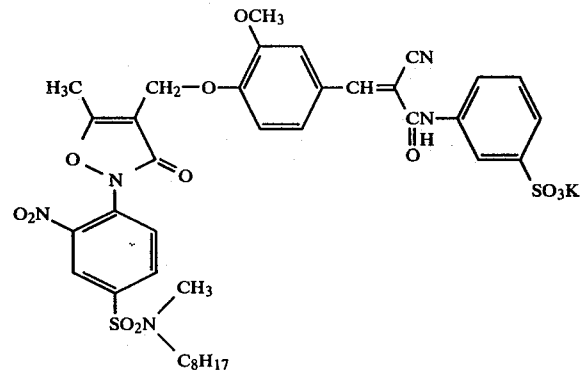

-continued
I-67
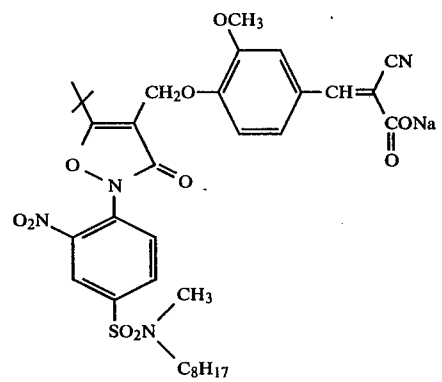
I-68
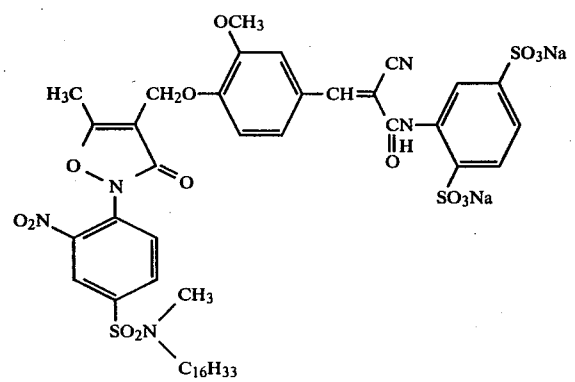

-continued
I-69
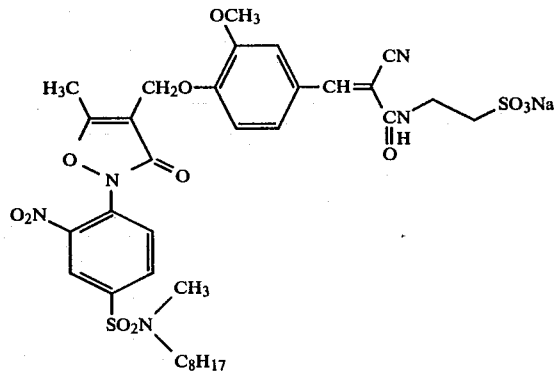
I-70
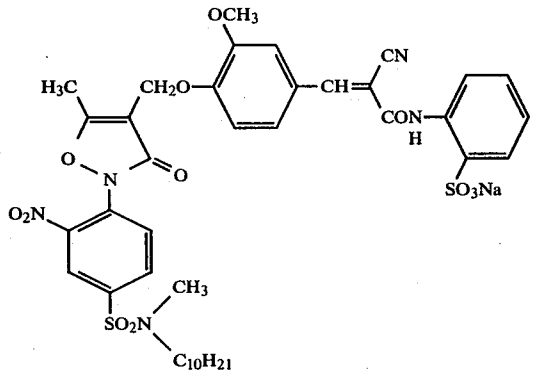
I-71
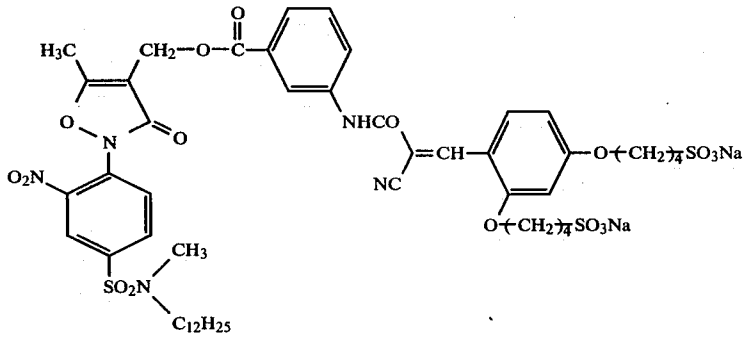

-continued
I-72
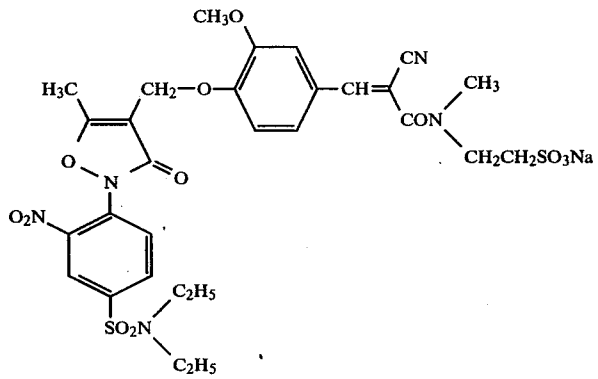
I-73
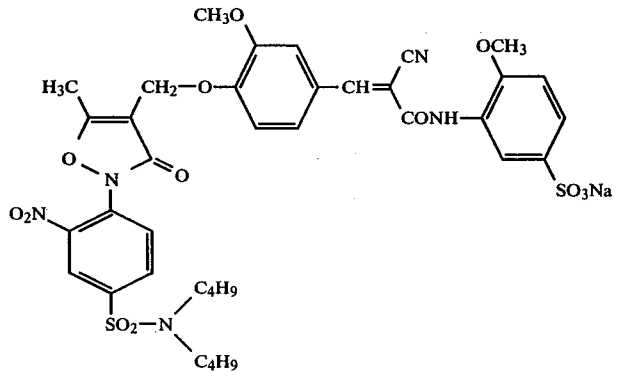

-continued
I-74
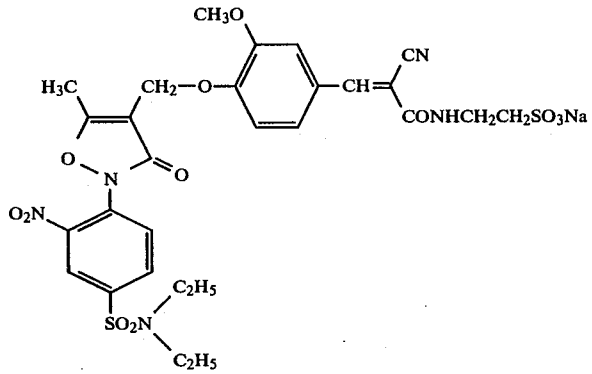
I-75
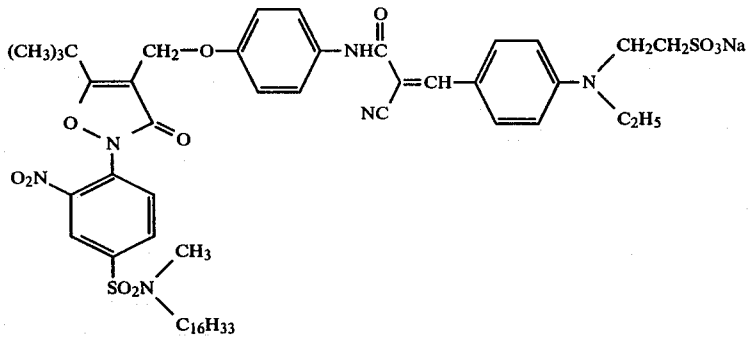
I-76
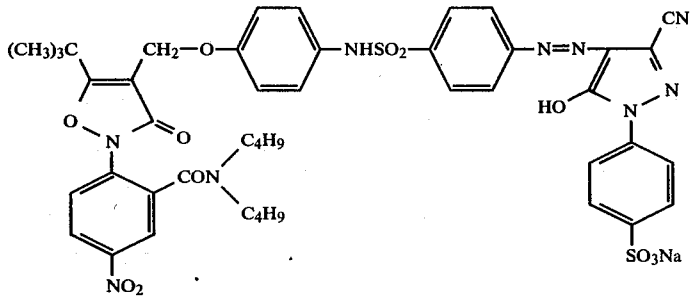

-continued
I-77
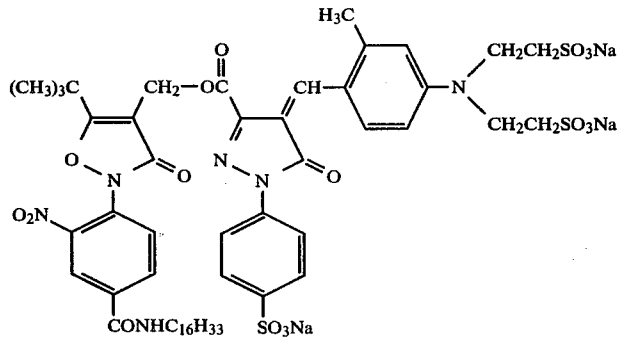
I-78
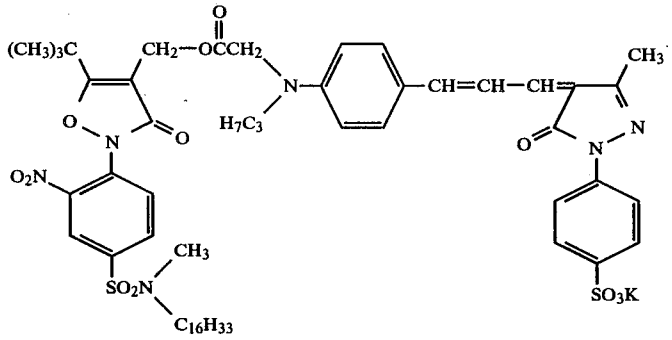
I-79
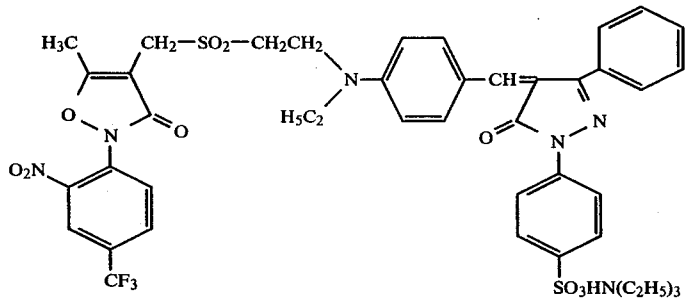

-continued
I-80
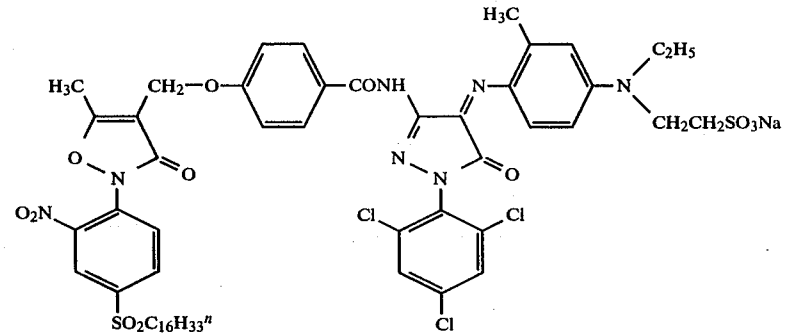
I-81
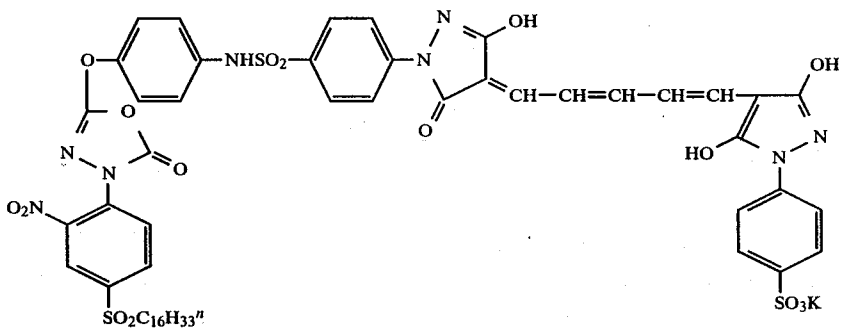
I-82
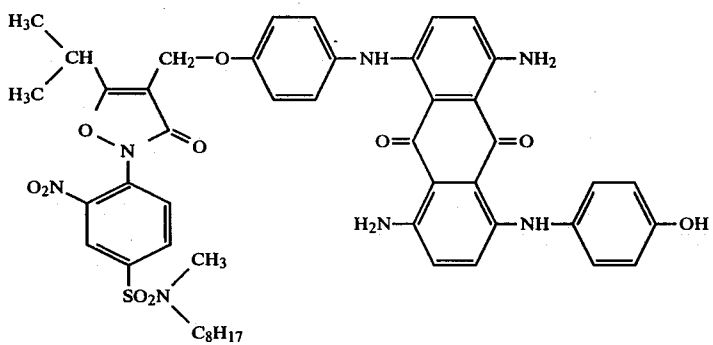

-continued
I-83
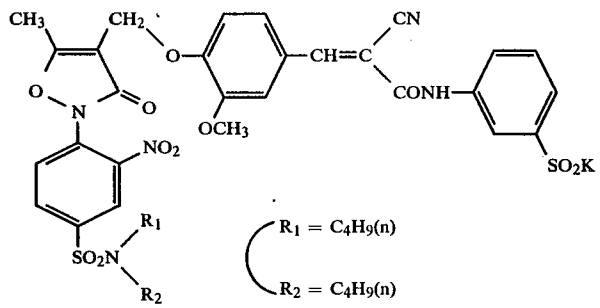
I-84
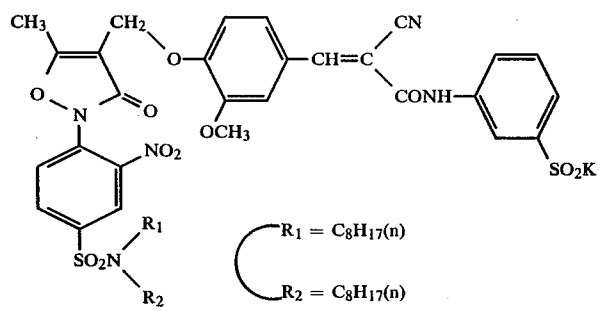
I-85
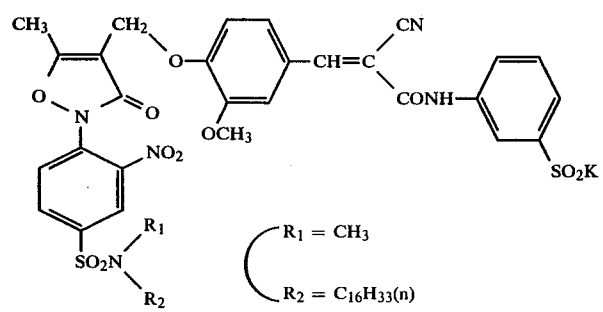

-continued
I-86
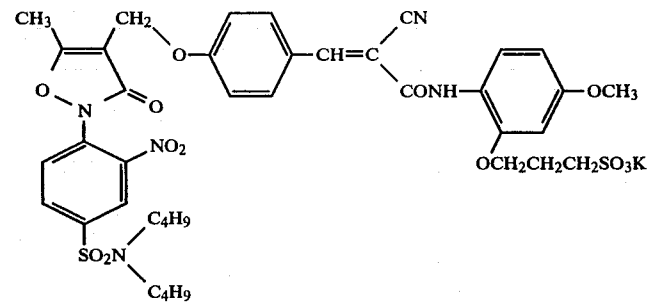
I-87
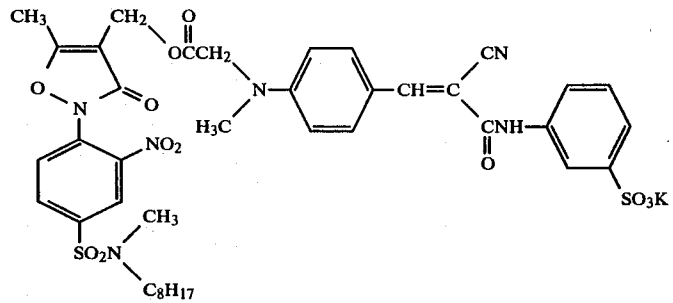
I-88
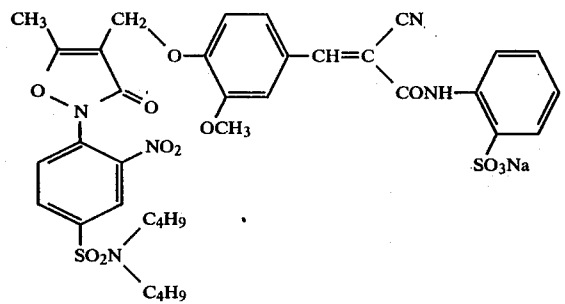

-continued
I-89
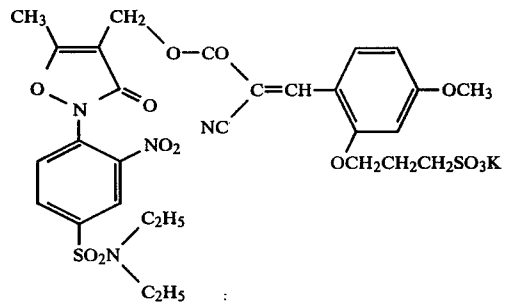
I-90
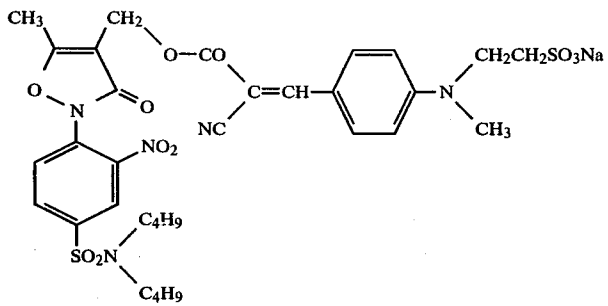
I-91
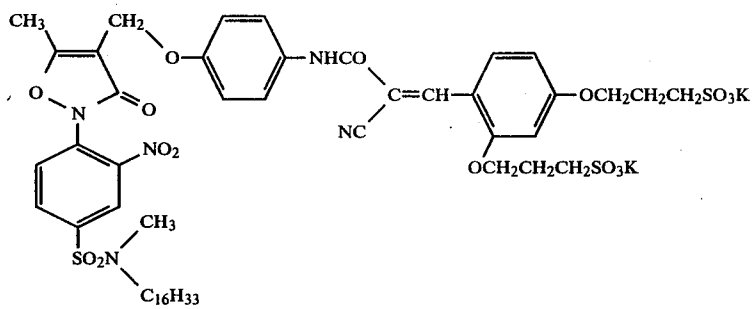

-continued
I-92
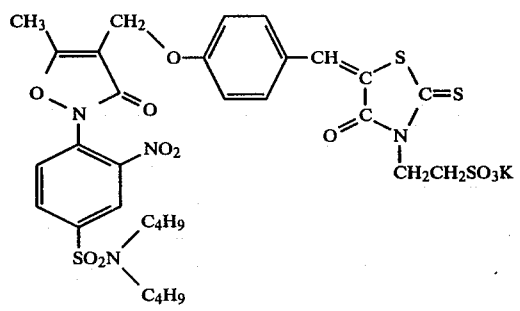
I-93
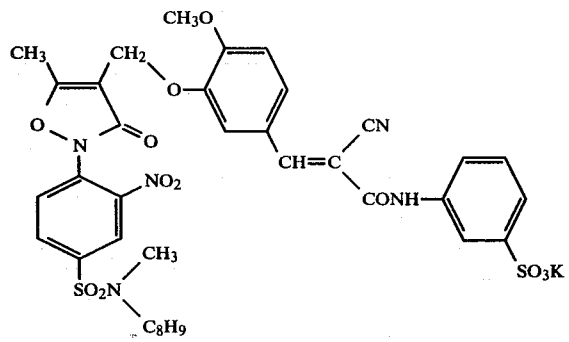
I-94
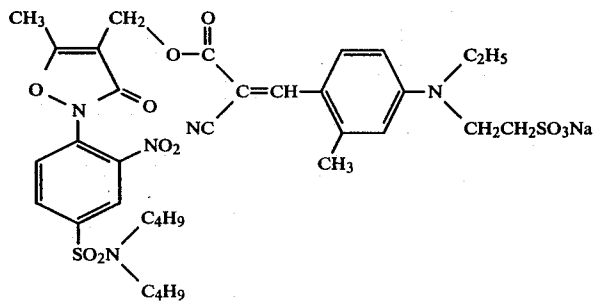

-continued
I-95
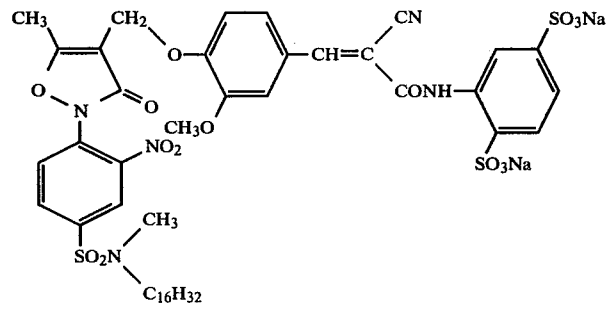
I-96
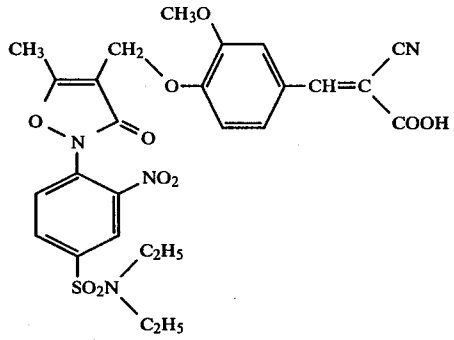
I-97
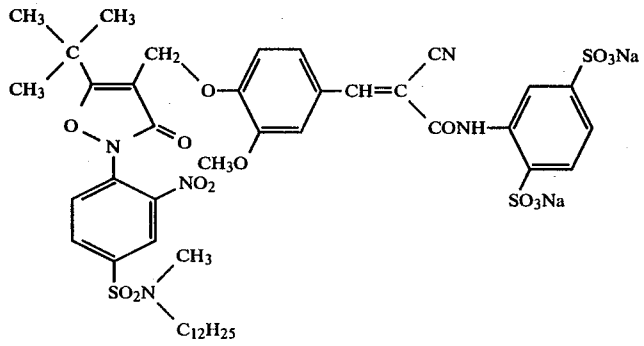

-continued
I-98
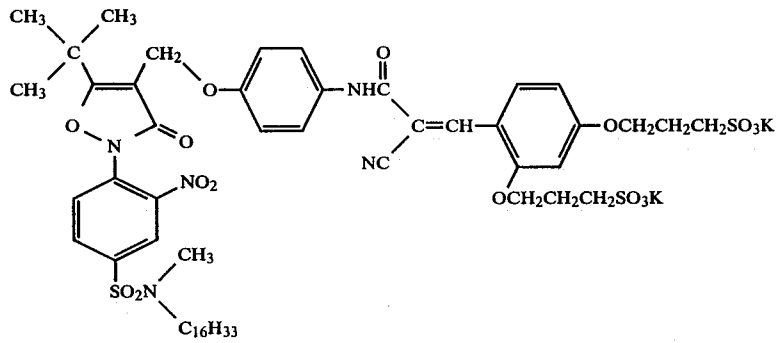
I-99
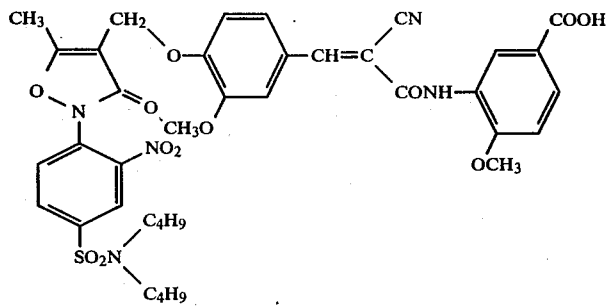
I-100
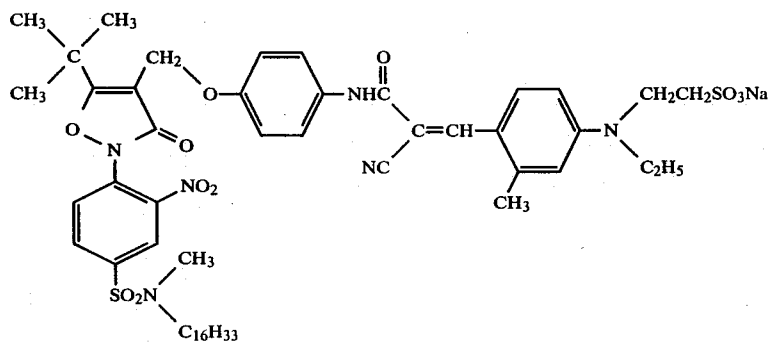

-continued
I-101
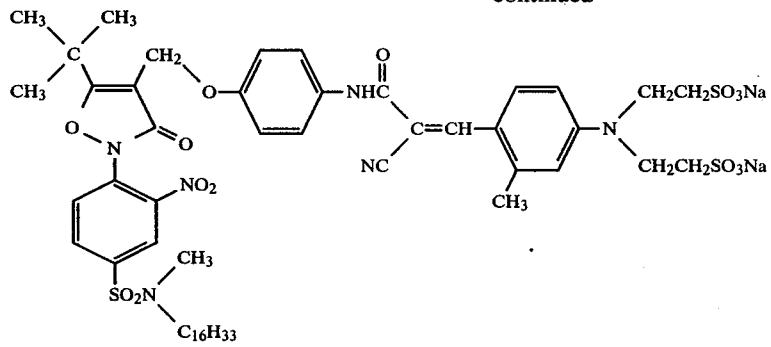
I-102
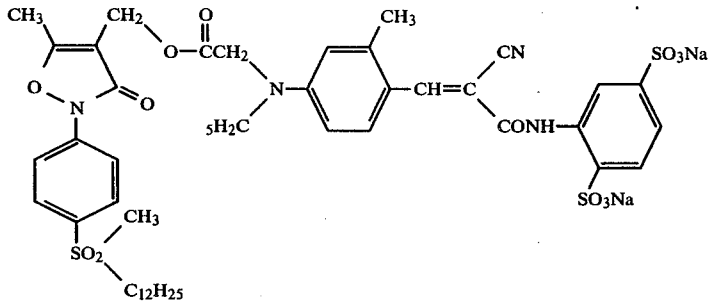

The compound of the present invention can be easily synthesized by bonding a dye to be released to the PWR in accordance with processes for the synthesis of compounds as described in U.S. Pat. Nos. 4,139,389, 4,139,379, 4,232,107, 4,343,893, 4,619,884, 4,450,223, and 4,609,610, Japanese Patent Application (OPI) Nos. 185,333/84, 101,649/84, 215,270/87, and 88,257/86, and Japanese Patent Application No. 244,873/85 (corresponding to U.S. patent application Ser. No. 925,350 filed on Oct. 30, 1986).

For easy understnaidng of the synthesis of the compound of the present invention, specific examples of synthesis of the present compound will be described hereinafter.

Synthesis Example 1: Synthesis of Compound 3

1-(1): Synthesis of 4-chloro-3-nitro-N-methyl-N-octadecylbenzenesulfonamide 100 g of 4-chloro-3-nitrobenzenesulfonylchloride was dissolved in 300 m( of chloroform. The solution was cooled to a temperature of 0° C. A chloroform solution of 84.3 g of methyloctadecylamine was added dropwise to the solution. 39.5 g of triethylamine was added dropwise to the admixture while the temperature was kept at from 0° to 10° C. The reaction was allowed to continue for 1 hour after the dropwise addition. Chloroform was then removed from the reaction system. 500 ml of methanol was added to the reaction system. The admixture was heated to cause dissolution. The reaction system was then allowed to cool. As a result, crystallization occurred.

The crystals ware filtered off under reduced pressure, and dried. Yield: 109 g (71.2%), m.p. 86°–87° C.

1-(2): Synthesis of 5-t-butyl-2-(4-N-methyl-N-octadecylsulfamoyl-2-nitrophenyl)-3-isooxazolone 600 g of 4-chloro-3-nitro-N-methyl-N-octadecylbenzensulfonamide, 202 g of 5-t-butyl-3-hydroxyisoxazole [see page 75 of Japanese Patent Application Ser. No. 925,350 filed on Oct. 30, 1986)], and 200 g of pottassium carbonate were mixed with 1.8 l of dimethylsulfoxide. The reaction system was carried out at a temperature of 65° C. for 6 hours. The reaction solution was poured into ice water. The resulting crystals were filtered off under reduced pressure, washed with water, and dried. Yield: 709 g (98.0%), m.p. 68°–69° C.

1-(3): Synthesis of 5-t-butyl-4-chloromethyl-2-(4-N-methyl-N-octadecylsulfamoyl-2-nitrophenyl)-3-isoxazolone 650 g of isoxazolone obtained in process 1-(2), 200 g of zinc chloride, 200 g of paraformaldehyde, and 3 l of acetic acid were mixed. The admixture was then heated under reflux with hydrogen chloride gas bubbled thereinto for 10 hours. After being cooled, the reaction solution was poured into water. The resulting crystals were recovered and recrystallized from a mixture of acetonitrile/methanol having a mixing ratil of ¼. Yield: 579 g (82.4%), m.p. 55°–56° C.

1-(4): Synthesis of 5-t-butyl-4-(4-formylphenoxy)-methyl-2-[(2-nitro-4-N-methyl-N-octadecylsulfamoyl)-phenyl]-3-isoxazolone 12.4 g of the chloride obtained in process 1-(3) were dissolved in 150 ml of acetone. 2.7 g of 4-hydroxybenzaldehyde, 0.5 g of sodium iodide and 3 g of potassium carbonate were added to the solution. The reaction system was then heated under reflux for 5 hours. Inorganic materials were filtered off with suction. The filtrate was dried. The residue was recrystallized from methanol. Yield: 10.2 g (67.6%), m.p. 60°–61° C.

1-(5): Synthesis of Exemplary Compound 3

7.5 g of aldehyde obtained in process 1-(4) was added to 100 ml of methanol. 3.1 g of potassium 3-cyanoacetamidebenzene sulfonate and 1 g of ammonium acetate were added to the admixture. The reaction system was heated under reflux for 6 hours. As the reaction proceeded, the solid was dissolved in the solution. After the reaction was completed, the reaction system was cooled. The solvent was removed under reduced pressure. The residue was purified by silica gel column chromatography with a chloroform-methanol solvent. Yield: 5.0 g 49.3%), $\lambda_{max}^{CHCl_3}$: 345.6 nm, $\epsilon_{max}^{CHCl_3}$: $3.10 \times 10^4$.

SYNTHESIS EXAMPLE 2

Synthesis of Compound 19

2-(1): Synthesis of 5-t-butyl-4(4-formylphenoxy)-methyl-2-(2-nitro-4-diethylsulfamoylphenyl)-3-isoxazolone 5-t-Butyl-4(4-formylphenoxy)methyl-2-(2-nitro-4-diethylsulfamoylphenyl)-3-isoxazolone was synthesized in the same manner as in the processes 1-(1) to 1-(4) except that methyloctadecylamine was replaced by diethylamine in process 1-(1) of Synthesis Example 1. m.p. 144-145° C.

2-(2): Synthesis of Exemplary Compound 19

13.0. g of aldehyde obtained in process 2-(1) was added to 150 m( of methanol. 7.5 g of potassium (3-cyanoacetamide) benzenesulfonate and 1 g of ammonium acetate were added to the admixture. The reaction system was heated under reflux for 8 hours. After the reaction was completed, the solvents was removed under normal pressure. The residue was purified by silica gel column chromatography with a chloroform-methanol solvent. Yield:

13.0 g (67.0%), $\lambda_{max}^{CHCl_3}$: 345.2 nm, $\epsilon_{max}^{CHCl_3}$: $2.86 \times 10^{-4}$.

SYNTHESIS EXAMPLE 3

Synthesis of Compound 20

3-(1): Synthesis of 5-t-butyl-4-[N-ethyl-N-(4-formyl-3-methylphenyl)aminoacetoxymethyl]-2-[(2-nitro-4-N-methyl-N-octadecylsulfamoyl)phenyl]-3-isoxazolone 6.2 g of the chloride obtained in Synthesis Example 1-(3) was dissolved in 70 ml of dimethylsulfoxide. 2.7 g of 4-(N-methyl-N-carboxymethylamino)-2-methylbenzaldehyde, 1.7 g of potassium carbonate, and 0.4 g of sodium iodide were added to the solution. The reaction system was carried out at room temperature for 6 hours. Water was added to the reaction solution. The aqueous mixture was extracted with ethyl acetate. The organic phase thus extracted was washed with water two times. The solvent was removed under reduced pressure. The residue was crystallized from methanol and a small amount (i.e., about 1% per mixture of methanol and acetonitrile) of acetonitrile. Yield: 7.2 g (85.8%).

3-(2): Synthesis of Exemplary Compound 20

5.5 g of the aldehyde obtained in process 3-(1), 2.2 g of potassium 3-cyanoacetamidebenzenesulfonate, and 0.7 g of ammonium acetate were mixed with 100 ml of methanol. The admixture was heated under reflux for 3 hours. The solvent was removed under reduced pressure The residue was purified by silica gel column chromatography with a methanolchloroform solvent. Yield: 4.0 g (56.2%), $\lambda_{max}^{CHCl_3}$: 425.8 nm, $\epsilon_{max}^{CHCl_3}$: $3.73 \times 10^4$.

The compound of the formula (I) to be used in the present invention may be incorporated in the layer in an appropriate amount depending on the purpose. However, the present compound of the formula (I) is preferably used in an amount such that the optical density ranges from 0.05 to 3.0. The specific amount of the dye varies depending on kinds of dye. However, the amount of the dye to be used in the present invention is preferably in the range of $1\times10^{-3}$ g/m$^2$ to 3.0 g/m$^2$, and particularly preferably $1\times10^{-}$g/m$^2$ to 1.0 g/m$^2$.

The present compound of the formula (I) can be incorporated in a silver halide emulsion layer or a hydrophilic colloid layer by various known methods.

For example, the present compound may be dissolved or dispersed in gelatin in the form of a solution in a suitable solvent such as alcohol (e.g., methanol, ethanol, and propanol), acetone, methylethylketone, methyl cellosolve, dimethyl formamide, cyclohexanone, and ethyl acetate or in the form of a finely oil-dropwise emulsified dispersion of such a solution in a high boiling oil. As such an oil, there can be used suitable known oils such as tricresyl phosphate, diethyl phthalate, dibutyl phthalate, and triphenyl phosphate.

Alternatively, as described in U.S. Pat. No. 4,512,969, Japanese Patent Application (OPI) No. 59,943/76, and Japanese Patent Publication No. 39,853/76, the present compound may be dissolved in an organic solvent miscible with water. The solution is mixed with a polymer latex capable of swelling in the organic solvent. At least, a part of the organic solvent is removed from the mixture to form a stable dispersion which can be used in the present invention.

Also, an aqueous dispersion of the present invention may be formed by means of a medium dispersing machine such as ball mill and colloid mill. The aqueous dispersion of the present compound is then mixed with an aqueous solution of gelatin before the use. In this case, as dispersing aids there may be effectively used various well-known surface active agents. Examples of such surface active agents are described in Japanese Patent Publication No. 39,853/76.

The present compound of the formula (I) may be incorporated in an interlayer, a light-sensitive layer, a protective layer, an overcoat layer, etc. Preferably, it may be incorporated in a light-insensitive hydrophilic colloid layer (e.g., surface protective layer) provided outside a light-sensitive layer farthest from the support or a light-insensitive hydrophilic colloid layer provided between the support and a light-sensitive layer nearest to the support.

If the present light-sensitive material comprises two or more light-sensitive layers, a hydrazine derivative may be incorporated in a light-sensitive layer which substantially influences an image and the compound of the formula (I) may be incorporated in the other light-sensitive layer which contributes less to the formation of an image.

The layer containing the present compound of the formula (I) is decomposed and eluted mainly by hydroquinone, sulfite, or alkali in the developing solution upon the development. This prevents the photographic image from being colored or stained.

As the hydrophilic colloid, gelatin may particularly preferably be used. As gelatin, there may be used various known gelatins such as lime-processed gelatin, acid processed gelatin, and other gelatins produced by different preparation methods. Alternatively, these gelatins may be chemically modified, e.g., phthalated or sulfonylated before the use. These gelatins may be optionally desalted before the use.

The mixing ratio of the present compound of the formula (I) and gelatin varies depending on the structure and added amount of the compound to be used in the present invention and is preferably in the range of $1/10^3$ to $\frac{1}{3}$, and more preferably in the range of 1/100 to 1/1.

The present compound may be used for a protective layer to impart safelight safety to the light-sensitive material, may be used as a filter dye in a filter layer such as a yellow filter layer, may be used as an antihalation dye in an antihalation layer, or may be used as an antiirradiation dye in an emulsion layer.

Preferably, the compound of the formula (I) is incorporated in an antihalation layer located between the protective layer or the support and the emulsion layer.

Examples of hydrazine derivatives which can be used in the present invention include hydrazine derivatives comprising sulfinyl groups as described in U.S. Pat. No. 4,478,928 and those represented by formula (IV):

$$R_0\text{—NHNH—CHO} \qquad \text{(IV)}$$

wherein $R_0$ represents an aliphatic group or aromatic group.

In the formula (IV), the aliphatic group represented by $R_0$ is preferably an aliphatic group having from 1 to 30 carbon atoms, and particularly a straight-chain, branched or cyclic alkyl group having from 1 to 20 carbon atoms. Such a branched alkyl group may be cyclized so as to form a saturated heterocyclic ring containing one or more hetero atoms therein. This alkyl group may also contain a substituent such as an aryl group, an alkoxy group, a sulfoxy group, a sulfonamide group, and a carbonamide group.

Examples of such a substituent include a t-butyl group, an n-octyl group, a t-octyl group, a cyclohexyl group, a pyrrolidyl group, an imidazolyl group, a tetrahydrofuryl group, and a morpholino group.

In the formula (IV), the aromatic group represented by $R_0$ is a monocyclic or bicyclic aryl group, or an unsaturated heterocyclic group. The unsaturated heterocyclic group may be condensed with a monocyclic or bicyclic aryl group to form a heteroaryl group.

Examples of such an aromatic group represented by $R_0$ include a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring. Particularly preferred are those containing a benzene ring.

Particularly preferred among the groups represented by $R_0$ is an aryl group.

The aryl group or aromatic group represented by $R_0$ may contain substituents.

Typical examples of such substituents include a straight-chain, branched or cyclic alkyl group preferably containing 1 to 20 carbon atoms, an aralkyl group which is monocyclic or bicyclic containing 1 to 3 carbon atoms in the alkyl portion, an alkoxy group preferably containing 1 to 20 carbon atoms, a substituted amino group preferably substituted by an alkyl group containing from 1 to 20 carbon atoms, an acylamino group preferably containing 2 to 30 carbon atoms, a sulfonamide group preferably containing 1 to 30 carbon atoms, and a ureido group preferably containing 1 to 30 carbon atoms.

$R_0$ in the formula (IV) may comprise a ballast group commonly used in an immobile photographic additive such as a coupler incorporated therein. Such a ballast group is a group containing 8 or more carbon atoms relatively inert to photographic properties and may be selected from an alkyl group, an alkoxy group, a phenyl group, an alkylphenyl group, a phenoxy group, an alkylphenoxy group, etc.

$R_0$ in the formula (IV) may comprise a group which increases adsorption to the surface of silver halide grain incorporated therein. Examples of such an adsorption group include those described in U.S. Pat. No. 4,385,108 such as a thiourea group, a heterocyclic thioamide group, a mercaptoheterocyclic group, and a triazole group.

The synthesis of these compounds can be accomplished by any suitable method as described in Japanese Patent Application (OPI) Nos. 20,921/78, 20,922/78, 66,732/78, and 20,318/78.

In the present invention, when the compound represented by formula (IV) is incorporated in a photographic material, it is preferably incorporated in a silver halide emulsion layer. However, it may be incorporated in other light-insensitive hydrophilic colloid layers such as a protective layer, interlayer, filter layer, and antihalation layer. Particularly, when the compound to be used is water-soluble, it may be added to a hydrophilic colloid solution in the form of an aqueous solution. When the compound to be used in sparingly soluble in water, it may be added to a hydrophilic colloid solution in the form of solution of an organic solvent miscible with water such as an alcohol, an ester and a ketone. When the compound to be used is incorporated in a silver halide emulsion layer, it may be added to the layer during any period between from the beginning of chemical ripening and before coating, preferably between after the completion of chemical ripenign and before coating. Particularly, the compound may be preferably added to a coating solution prepared for coating.

The optimum amount of the present compound of the formula (IV) to be incorporated may be preferably selected depending on grain diameter of grains contained in the silver halide emulsion, composition of the silver halide emulsion, process and extent of chemical ripening, relationship between the layer for containing the compound to be incorporated and the silver halide emulsion layer, type of anti-fogging compound to be used, etc. The method for the selection of the optimum amount of the present compound of the formula (IV) is well-known to those skilled in the art. In general, the present compound of the formula (IV) may be preferably used in an amount of $1\times10^{-6}$ to $1\times10^{-1}$ mol, and particularly preferably $1\times10^{-5}$ to $4\times10^{-2}$ mole per 1 mole of silver halide.

Specific examples of the compound of the formula (IV), hydrazine compound containing a sulfinyl group, and other compounds to be used in the present invention, will be shown hereinafter, but the present invention should not be constructed as being limited thereto.

(IV-1)

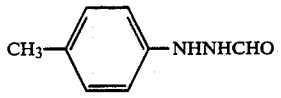

(IV-2)

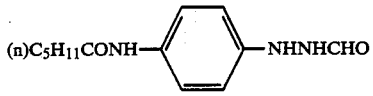

(IV-3)

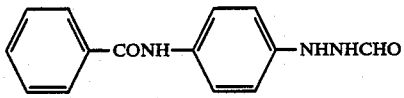

(IV-4)

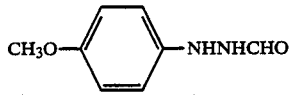

(IV-5)

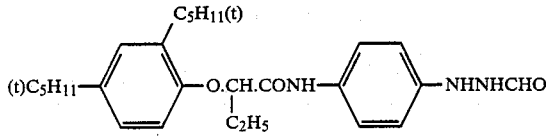

(IV-6)

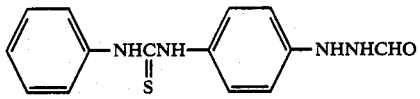

-continued
(IV-7)
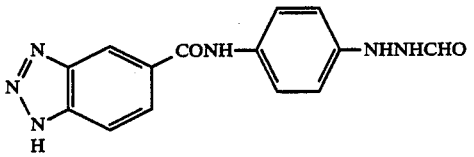
(IV-8)
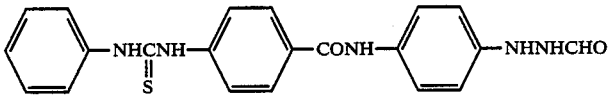
(IV-9)
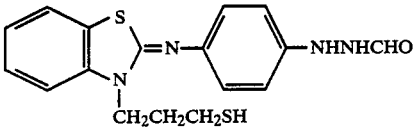
(IV-10)
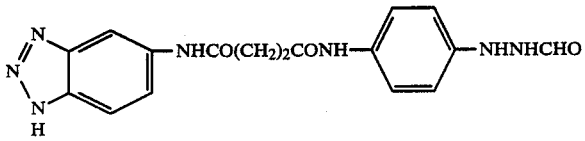
(IV-11)
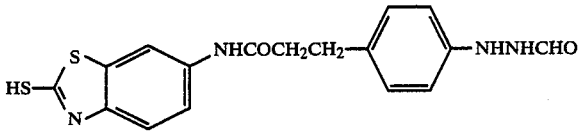
(IV-12)
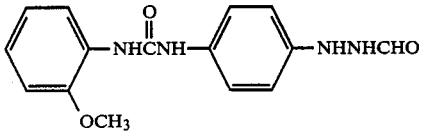
(IV-13)
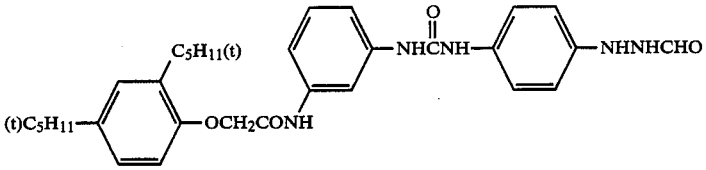
(IV-14)
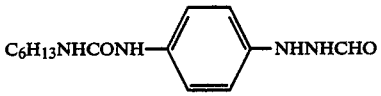
(IV-15)
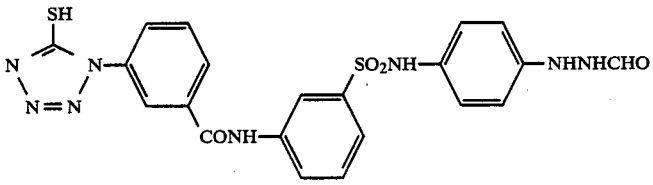
(IV-16)
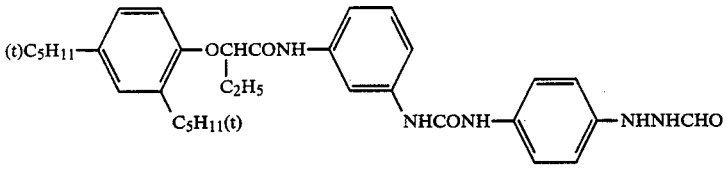

-continued
(IV-17)
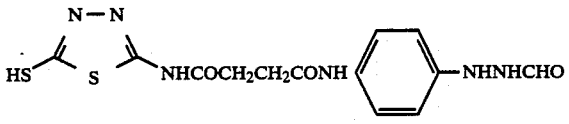
(IV-18)
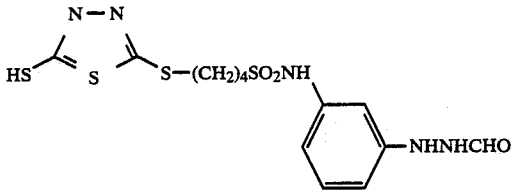
(IV-19)
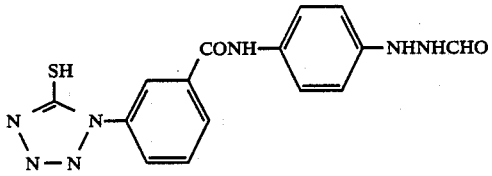
(IV-20)
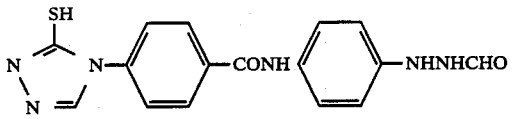
(IV-21)
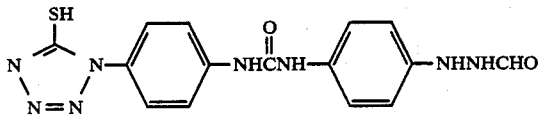
(IV-22)
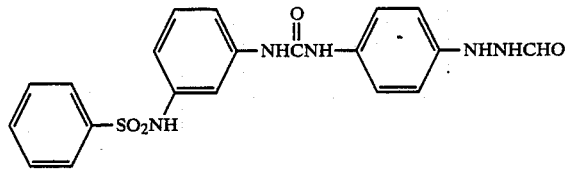
(IV-23)
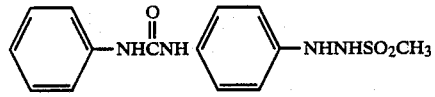
(IV-24)
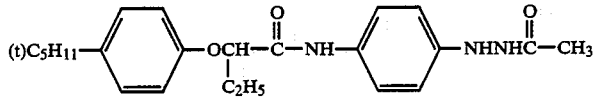
(IV-25)
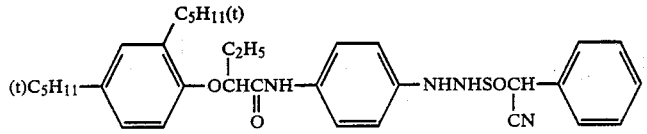
(IV-26)
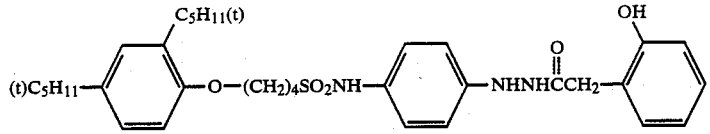

-continued (IV-27)

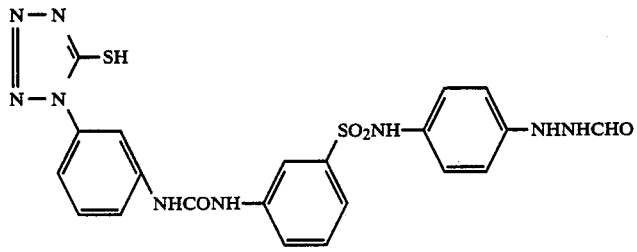

(IV-28)

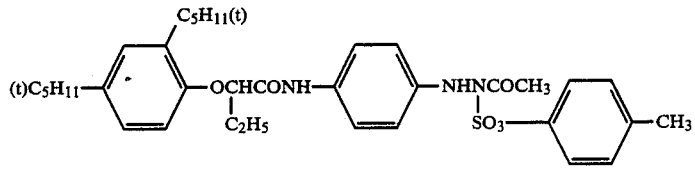

(IV-29)

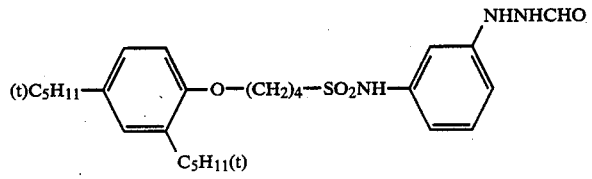

(IV-30)

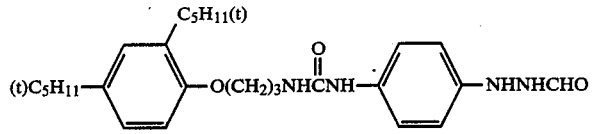

(IV-31)

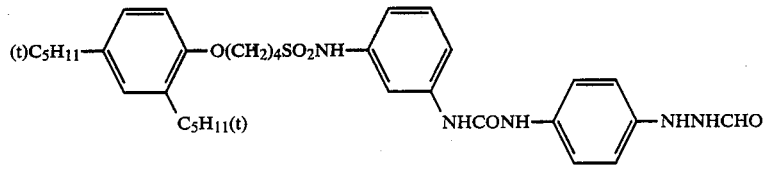

Other examples of hydrazine derivatives which can be used in the present invention include those described in *Research Disclosure,* RD No. 23,516, pages 346, November 1983 and reference cited therein, U.S. Pat. Nos. 4,080,207, 4,269,929, 4,276,364, 4,278,748, 4,385,108, 4,459,347, 4,560,638, and 4,478,928, British Patent No. 2,011,391B, and Japanese Patent Application (OPI) No. 179,734/85.

Further examples of hydrazine derivatives which can be used in the present invention include nucleating agents as described in Japanese Patent Application No. 67,508/87, 67,509/87, and 67,510/87.

The hydrophilic colloid layer (hereinafter referred to as "interlayer") substantially free of the compound represented by formula (I) may advantageously comprise gelatin. However, such an interlayer may comprise other hydrophilic colloids. Examples of such hydrophilic colloids include protein such as gelatin derivatives, graft polymers of gelatin with other high molecular compounds, albumin, and casein; cellulose derivatives such as hydroxyethyl cellulose, carboxymethyl cellulose, and cellulose sufuric ester; sugar derivatives such as sodium alginate; and various synthetic hydrophilic high molecular compounds such as polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole, and other monomer and copolymers.

Further, an inter gelatin layer is interposed between one of said other hydrophilic colloid layers containing the compound of the formula (I) and the lightsensitive emulsion layer which contains a hydrazine derivatives.

As gelatin, there may be used an acid-processed gelatin besides a lime-processed gelatin. Alternatively, hydrolyzates of gelatin or enzymatic decomposition products of gelatin may be used.

The interlayer may be preferably used in a thickness of 0.1 to 5.0 μm and particularly 0.2 to 2.0 μm. The interlayer may further comprise various additives described below incorporated therein. Examples of such additives include a development accelerator, a polymer latex, a water-soluble dye, a stabilizer, a crosslinking agent, and a coating aid.

The terminology "substantially free of the compound represented by formula (I)" as used herein means that the compound by formula (I) is contained in an amount which does not substantially influence the gradiation of emulsion (i.e., the $\gamma$ value is 10 or less).

The silver halide to be used in the present silver halide emulsion may be any one of silver chloride, silver bromide, silver bromochloride, silver bromoiodide, and silver bromochloroiodide.

The silver halide grain to be contained in the photographic emulsion may have a regular crystal structure such as a cube, an octahedron, a tetradecahedron, and a rhombic dodecahedron, an irregular crystal structure such as a sphere and a tabular shape, or a composite thereof. Alternatively, the silver halide grain may have a mixture of these crystal structures. Furthermore, the silver halide grain may have an epitaxial structure.

The crystal structure of the present silver halide grain may be uniform phase or may be two or more phases that the halide composition differs between the inner portion and the outer portion thereof. Moreover, the silver halide grain may be of the surface latent image type in which latent images are formed mainly in the surface portion thereof (e.g. negative type emulsion) or of the internal latent image type in which latent images are formed mainly in the interior thereof (e.g., internal latent image type emulsion and previously fogged direct reversal type emulsion).

The grain size of the silver halide grain is generally preferably in the range of 0.01 to 4.0 μm and particularly preferably in the range of 0.02 to 0.04 μm for graphic arts light-sensitive material or 0.2 to 3.0 μm for general light-sensitive material for use in photographing or X-ray film. In the present invention, it is particularly preferably in the range of 0.02 to 0.15 μm.

The preparation of the photographic emulsion to be used in the present invention can be accomplished by any suitable method as described in P. Glafkides, *Chimie et Physique Photographique*, published by Paul Montel Co., 1967, G. F. Duffin, *Photographic Emulsion Chemistry*, published by Focal Press, 1966, and V. L. Zelkman et al, *Making and Coating Photographic Emulsion*, published by Focal Press, 1964.

Cadmium salts, zinc salts, thallium salts, iridum salts or complex salts thereof, rhodium salts or complex salts thereof, or iron salts or complex salts thereof may be present at the process of formation or physical ripening of the silver halide grain.

The present silver halide emulsion may optionally be subjected to chemical sensitization. Such a chemical sensitization can be accomplished by any suitable method as described in H. Frieser, editor, *Die Grundlagen der Photographischen Prozesse mit Silberhalogeniden* published by Akademische Verlagesgessellschafte, pp. 675–734, 1968.

Particularly, a sulfur sensitization process using a sulfur-containing compound capable of reacting with active gelatin or silver (e.g., thiosulfate, thiourea, mercapto compounds, and rhodanine), a reduction sensitization process using a reducing substance (e.g., stannous salts, amines, hydrazine derivatives, formamidinesulfinic acid, and silane compounds), and a noble metal sensitization process using a noble metal compound (e.g., a gold complex and a complex of the group VIII metals such as Pt, Ir, and Pd) may be used alone or in combination.

The present photographic emulsion may contain various compounds in order to inhibit fogging during the preparation, preservation or photographic processing of a light-sensitive material or stabilize the photographic properties thereof. Examples of such compounds include those known as antifoggants and stabilizers. Specific examples of such antifoggants and stabilizers include azoles such as benzothiazolium salts, nitroindazoles, thiazoles, benzotriazoles, and benzimidazoles (particularly nitro- or halogen-substituted); heterocyclic mercapto compounds such as mercaptothiazoles, mercaptobenzothiazoles, mercaptobenzimidazoles, mercaptothiadiazoles, mercaptotetrazoles (particularly 1-phenyl-5-mercaptotetrazole), and mercaptopyrimidines; heterocyclic mercapto compounds containing water-soluble groups such as carboxyl groups and sulfon groups; thioketone compounds such as oxazoline thione; azaindenes such as tetraazaindenes (particularly 4-hydroxy-substituted (1,3,3a,7)tetrazaindene; benzenethiosulfonic acid; benzenesulfinic acid; and hydroquinone and derivatives thereof.

The present silver halide photographic emulsion may contain color couplers such as a cyan coupler, a magenta coupler, and a yellow coupler, and a compound for dispersing the coupler therein.

Particularly, the present silver halide photographic emulsion may contain a compound which may undergo an oxidation coupling with an aromatic primary amine developing agent (e.g., phenylenediamine derivatives and aminophenol derivatives) to color upon color development. Examples of magenta couplers include a 5-pyrazolone coupler, pyrazolobenzimidazole coupler, cyanoacetyl coumarone coupler, and open-chain acylacetonitrile coupler. Examples of yellow couplers include an acylacetamide coupler (e.g., benzoylacetanilides, and pivaloylacetanilides). Examples of cyan couplers include a naphthol coupler and phenol coupler. These couplers are preferably nondiffusion couplers containing a hydrophobic group called a ballast group in the molecules. These couplers may be either two or four-equivalent per silver ion. Alternatively, these couplers may be colored couplers having the effect of correcting colors or couplers which release a development inhibitor upon development (i.e. DIR coupler).

In addition to such a DIR coupler, the present silver halide photographic emulsion may contain a colorless DIR coupler which undergoes a coupling reaction to produce a colorless product and release a development inhibitor.

The present photographic emulsion may contain polyalkylene oxide or its ether, ester or amine derivatives, thioether compounds, thiomorpholines, quaternary ammonium salt compounds, urethane derivatives, urea derivatives, innidazole derivatives, 3-pyrazolidones, hydroquinone, or its derivative for the purpose of increasing sensitivity, increasing contrast or accelerating development.

The present silver halide photographic emulsion may further comprise a known water-soluble dye other than the dyes disclosed herein (e.g. an oxonol dye, a hemioxonol dye, a melocyanine dye and a benzylidene dye) as a filter dye or for the purpose of inhibiting irradiation or other various purposes. As a spectral sensitizer, there may be further used a known cyanine dye, melocyanine dye, or hemicyanine dye, other than the dyes disclosed herein.

The present light-sensitive material may further comprise various additives such as a discoloratinn inhibitor, a color anti foggant, a ultraviolet absorber and a protective colloid (e.g., gelatin). Specific examples of such additives are described in Research Disclosure, RD No. 17,643, Vol. 176 (1978, XII).

An ultrahigh-contrast negative light-sensitive material for use in graphic art may contain a hydrazine derivative as described in U.S. Pat. Nos. 4,224,401, 4,168,977, 4,166,742, 4,311,781, 4,272,606, 4,211,857, and 4,243,739.

A particularly preferred hydrazine derivative is represented by the following formula:

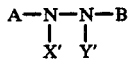

wherein A represents an aliphatic group or aromatic group; B represents a formyl group, an acyl group, an alkyl or arylsulfonyl group, an alkyl or arylsulfinyl group, a carbamoyl group, an alkoxy or aryloxycarbonyl group, a sulfinamoyl group, an alkoxysulfonyl group, a thioacyl group, a thiocarbamoyl group, a sulfanyl group, or a heterocyclic group; and X' and Y' each represents a hydrogen atom at the same time or one of X' and Y' represents a hydrogen atom and the other represents a substituted or unsubstituted alkylsulfonyl group, arylsulfonyl group, or acyl group.

A photographic light-sensitive material for use in the graphic arts, particularly for use in a bright place, may contain an organic desensitizer. A particularly preferred desensitizer contains at least one water-soluble group or alkali-dissociating group.

Specific examples of such an organic desensitizer are described in Japanese Patent Application No. 205,603/86.

A light-sensitive material containing such a hydrazine derivative preferably comprises a compound as disclosed in Japanese Patent Application (OPI) Nos. 77,616/78, 37,732/79, 137,133/78, 140,340/85, and 14,959/85, and Japanese Patent Application Nos. 205,603,86, 271,113/86, 2,528,461/86, and 280,998/86.

The present photographic light-sensitive material may preferably comprise a nitron and its derivatives as described in Japanese Patent Application (OPI) Nos. 76,743/85, and 87,322/85, a mercapto compound as described in Japanese Patent Application (OPI) No. 80,893/85, a heterocyclic compound, a complex salt of a heterocyclic compound with silver (e.g., 1-phenyl-5-mercaptotetrazole silver) as described in Japanese Patent Application (OPI) No. 164,735/82, or the like.

The photographic emulsion layer or other hydrophilic colloid layers in a light-sensitive material prepared according to the present invention may contain various surface active agents for the purpose of aiding coating, improving sliding properties and photographic properties (e.g., development acceleration, high contrast, and sensitization), antistatic treatment, preventing adhesion, emulsion dispersion, or like purposes.

Specific examples of surface active agents which can be used in the present invention include nonionic surface active agents such as saponin (steroid system), alkyleneoxide derivatives (e.g., polyethylene glycol, polyethylene glycol/polypropylene glycol condensates, polyethylene glycol alkyl ethers, polyethylene glycol alkyl arylethers, polyethyleneoxide addition products of silicone), and alkylesters of sugar; anionic surface active agents such as alkylsulfonate, alkylbenzenesulfonate, alkylnaphthalene-sulfonate, alkyl sulfuric esters, N-acyl-N-alkyl taurines, sulfosuccinic esters, and sulfoalkylpolyoxyethylenealkylphenyl ethers; amphoteric surface active agents such as alkylbetaines, and alkylsulfobetaines, and cathionic surface active agents such as aliphatic or aromatic quaternary ammonium salts, pyridinium salts, and imidazolium salts.

Particularly preferred among these surface active agents are anions such as saponin, sodium dodecylbenzenesulfonate, sodium di-2-ethylhexyl-o-sulfosuccinate, sodium p-octylphenoxyethoxyethoxyethanesulfonate, sodium dodecylsulfate, sodium triisopropylnaphthalenesulfonate, and sodium N-methyl-oleoiltaurine; cations such as dodecyltrimethyl ammonium chloride, N-oleoil-N',N'N'-trimethylammoniodiaminopropane bromide, and dodecylpyridium chloride; nonions such as betaines such as N-dodecyl-N,N-dimethylcarboxybetaine and N-oleil-N,N-dimethylsulfobutylbetaine, polyoxyethylenecetylether (polymerization degree n=10), polyoxyethylene-p-nonylphenolether (polymerization degree=25), and bis (1-polyoxyethylene-oxy-2,4-di-tpentylphenyl) ethane (polymerization degree=15).

Preferred examples of antistatic agents which can be used in the present invention include fluorine-containing surface active agents such as potassium perfluorooctanesulfonate, sodium N-propyl-N-perfluorooctanesulfonylglycine, sodium N-propyl-N-perfluorooctanesulfonylaminoethyloxypolyoxyethylenebutanesulfonate (n=3), N-perfluorooctanesulfonyl-N',N'N'-trimethylammoniodiaminopropane chloride, and N-perfluorodecanoylaminopropyl-N,N'-dimethyl-N'-carboxybetaine; nonionic surface active agents as described in Japanese Patent Application (OPI) Nos. 80,848/85, and 112, 144/86, 172,343/87, and 173,456/87; nitrates of alkaline metals, and electrically-conductive tin oxide, tinc oxide, palladium pentaoxide, and composite oxides obtained by doping these oxides with antimony.

The surface layer of the present photographic light-sensitive material may comprise a sliding agent such as a silicone compound as described in U.S. Pat. Nos. 3,489,576, and 4,047,958, colloidal silica as described in Japanese Patent Publication No. 23,139/81, parafin wax, higher aliphatic esters, and starch derivatives.

The hydrophilic colloid layer of the present photographic light-sensitive material may comprise as a plasticizer a polyol such as trimethylolpropane, pentanediol, butanediol, ethylene glycol, and glycerine. Furthermore, the hydrophilic colloid layer of the present photographic light-sensitive material may preferably contain a polymer latex for the purpose of improving pressure resistance. As a polymer, there may be preferably used homopolymers of acrylic alkylesters or copolymers of acrylic alkylesters, with acrylic acid, styrene-butanediene copolymers, or polymers or copolymers made of polymers containing active methylene groups.

The present photographic emulsion and light-insensitive hydrophilic colloid may contain an inorganic or organic film hardener As such a film hardener, there may be used alone or in combination an active vinyl compound such as 1,3,5-triacryloilhexahydro-s-triazine, bis(vinylsulfonyl)methylether, and N,N'-methylenebis-[β-(vinylsulfonyl)propionamide]; an active halogen compound such as 2,4-dichloro-6-hydroxy-s-triazine; a mucohalogenic acids such as mucochloric acid; an N-carbamoylpyridinium salt such as (1-morpholinocarbonyl-3-pyridinio)methanesulfonate; and a haloamidinium salt such as 1-(1-chloro-1-pyridinomethylene)pyrrolidinium, and 2-naphthalenesulfonate. Particularly preferred examples of such a film hardener include active vinyl compounds as described in Japanese Patent Application (OPI) Nos. 41,220/78, 57,257/78, 162,546/84, and 80,846/85, active halides as described in U.S. Pat. No. 3,325,287, and polymer hardening agents as described in Japanese Patent Application (OPI) No. 66841/81, British Pat. No. 1,322,971 and U.S. Pat. No. 3,671,256.

A finished emulsion may be coated onto a proper support such as baryta paper, resin coating paper, synthetic paper, triacetate film, polyethyleneterephthalate film; other plastic base; or glass plate.

Examples of the present silver halide photographic material include color positive film, color paper, color negative film, color reversal film optionally containing coupler, photographic light-sensitive materials for use in photoengraving such as lith film and lith duplicate film, light-sensitive materials for use in a cathode ray tube display such as light-sensitive materials for use in emulsion X-ray recording, and direct and indirect photographing materials using a screen, light-sensitive materials for a silver salt diffusion transfer process, light-sensitive materials for a color diffusion transfer process, emulsions for use in a silver dye bleach process, and light-sensitive materials for heat development as described in U.S. Pat. No. 4,500,626, Japanese Patent Application (OPI) Nos. 133,449/85, and 218,443/84, and Japanese Patent Application No. 79,709/85.

In order to obtain photographic images, the exposure of the light-sensitive material to light can be accomplished by any ordinary method. Particularly, as a light source there can be used any one of natural light (sunlight), a halogen lamp, a tungsten lamp, a fluorescent lamp, a mercury vapor lamp, a xenon arc lamp, a carbon arc lamp, a xenon flash lamp, and a cathode ray tube flying spot. Further, the exposure time can be in the range of 1/1,000 second to 1 second as used in ordinary cameras. However, the exposure time may be optionally shorter than 1/1,000 second. For example, if a xenon flash lamp or cathode ray tube is used, the exposure time can be in the range of $1/10^4$ second to $1/10^{06}$ second. Additionally, the exposure time may be longer than 1 second. The spectral composition of the light to be used can be optionally adjusted by means of a proper color filter. A laser can also be used for the exposure of the light-sensitive material Alternatively, light released from a fluorescent substance excited by electron rays, X-rays, $\gamma$-rays, $\alpha$-rays, or the like may be used for exposure of the light-sensitive material.

The photographic processing of the light-sensitive material prepared according to the present invention can be accomplished by any suitable known method and processing solution as described in *Research Disclosure,* RD No. 176 (page 28–30, December, 1978). The photographic processing may be either black-and-white photographic processing in which silver images are formed or color photographic processing in which dye images are formed depending on the purpose. The pH value of the developing solution to be used depends on the type of photographic processing (i.e., black-and-white or color development), type of developing agent contained therein, type of light-sensitive material to be processed, or the like. In general, it is often in the range of 9 to 12.5. The processing temperature is generally selected between 18° C. and 50° C. However, it may be lower than 18° C. or higher than 50° C.

Particularly, a developing solution with a pH value of 11.0 to 12.3 containing 0.15 mol/l or more of sulfite ions as described in U.S. Pat. Nos. 4,224,401, 4,168,977, and 4,166,742 or a developing solution as described in Japanese Patent Application (OPI) No. 258,537/85 and U.S. Pat. No. 4,269,929 may be preferably used in the present invention.

The present invention will be further illustrated in the following examples, but the present invention should not be construed as being limited thereto.

Unless otherwise indicated, all ratios, percentages, etc., are by weight.

EXAMPLE 1

Preparation of Emulsion A

An aqueous solution of silver nitrate and an aqueous solution of sodium chloride containing ammonium hexachlorinated rhodiumate (III) in an amount of $2.5\times10^{-5}$ mol per mol of silver were mixed with each other in a gelatin solution having a temperature of 35° C. by a double jet method in such a manner that the pH value thereof was adjusted to 2.3 so that a monodisperse emulsion of silver chloride grain having an average grain size of 0.1 $\mu$m was prepared.

After the formation of grains, a flocculation process well-known in the art was used to remove soluble salts from the emulsion. 4-Hydroxy-6-methyl-1,3,3a,7-tetraazaindene and 1-phenyl-5-mercaptotetrazole were added to the emulsion as stabilizers. The amount of gelatin and silver contained in 1 Kg of the emulsion were 55 g and 105 g, respectively. (Emulsion A)

Preparation of light-sensitive material

A nucleating agent (Compound IV-30) and an organic desensitizer represented by the undermentioned formulae were added to Emulsion A in amounts of 20 mg and 2 mg per 1 g of silver, respectively.

Nucleating agent

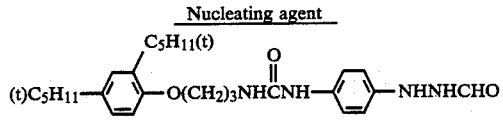

Organic desensitizer

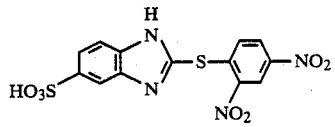

Furthermore, sodium 2,4-dichloro-6-hydroxy-1,3,5-triazine was added to the admixture as a film hardener. The silver halide emulsion thus prepared was then coated onto a transparent polyethyleneterephthalate support in an amount of 3.5 g per $m^2$ in terms of silver. A protective layer containing gelatin (1.3 g/$m^2$) and the present compound (I-19)(0.1 g/$m^2$) were coated onto the silver halide emulsion layer. The coat was dried. (Sample 1)

The preparation of Compound I-19 was carried out as follows:

A solution of 4.9 g of Compound 19 dissolved in 39 ml of methylethylketone was mixed with 260 g of a 5.0% (weight) aqueous gelatin solution with stirring at a temperature of 45° C. As a result, a slightly emulsified dispersion was obtained.

COMPARATIVE EXAMPLE 1

(1) A comparative sample A was prepared in the same manner as in Example 1 except that Compound I-19 was excluded.

(2) Comparative Sample B was prepared in the same manner as in Example 1 except in that Compound I-19 was replaced by a water-soluble ultraviolet absorber of the undermentioned formula in an amount of 0.05 g/$m^2$. The absorber of the undermentioned formula was added in the form of an aqueous solution.

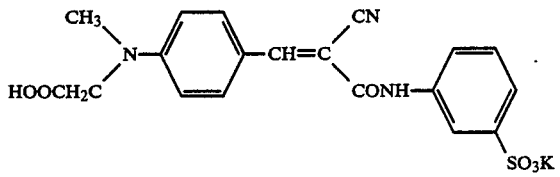

Evaluation of properties (1) These three samples were exposed to light through an optical wedge by means of a Dainippon Screen Co., Ltd.'s daylight printer P-607. These samples thus exposed were then developed with a developing solution having the undermentioned composition at a temperature of 38° C. for 20 seconds, fixed by an ordinary method, washed with water, and dried. Both Comparative Sample B and Sample 1 were low in the UV optical density of the highlight portion as Comparative Sample A, and thus completely decolored.

| Composition of developing solution | |
|---|---|
| Hydroquinone | 35.0 g |
| N-methyl-p-aminophenol (½ sulfate) | 0.8 g |
| Sodium hydroxide | 13.0 g |
| Tribasic potassium phosphate | 74.0 g |
| Potassium sulfite | 90.0 g |
| Tetrasodium ethylenediaminetetraacetate | 1.0 g |
| Potassium bromide | 4.0 g |
| 5-Methylbenzotriazole | 0.6 g |
| 3-Diethylamino-1,2-propanediol | 15.0 g |
| Water to make | 1 l |
| pH | 11.5 |

The sensitivity of Comparative Sample B and the present sample 1 could be reduced by 0.4 and 0.5 with respect to that of Comparative Sample A in terms of the value of log E, respectively. In practical use, the sensitivity of Sample B and Sample 1 were in the optimum range.

(2) Test on safelight safety

These three samples were tested for safety time under a UV cut fluorescent lamp [FLR-40SW-DLX-NU/M manufactured by Toshiba Co., Ltd.] with 400 lux as a safelight. Comparative Sample A showed 10 minutes of safety, Comparative Sample B showed 20 minutes of safety, and the present sample 1 showed 25 minutes of safety.

The results of the tests (1) and (2) show that the present compound 1 can effectively reduce the sensitivity to the optimum range and improve the safelight safety.

(3) Test on tone variability

These three samples were exposed to light through a flat net screen by means of the above described printer, and then developed in the same manner as in test (1). For each of these samples, the exposure time at which the net point area could be reversed in a proportion of 1/1 was determined. These samples were then exposed to light twice and four times the exposure time thus determined so that the expansion of the net point area was determined. The more the net point area is expanded, the better is the tone variability. The results are shown in Table 1. Table 1 shows that Comparative Sample B exhibits a remarkable drop in tone variability while the present sample 1 exhibits a high tone variability. This is because the dye used in Comparative Sample B is uniformly diffused between the layer in which it is incorporated and the light-sensitive emulsion layer due to its water solubility and diffusibility. Therefore, even if the exposure time is increased, the dye's anti-irradiation effect inhibits the increase in the net point area. In contrast, the present compound I-19 can remain fixed in the layer in which it is incorporated, providing a higher tone variability.

TABLE 1

| Tone variability (Represented by increase in net point area) | Douple Exposure | Quadruple Exposure |
|---|---|---|
| Comparative Sample A | +5% | +9% |
| Comparative Sample B | +2% | +4% |
| Present Sample 1 | +5% | +9% |

(4) Evaluation of stain by reducing solution

A strip of the present sample 1 which had been processed in test (3) was immersed in a Farmer's reducing solution prepared as described hereinafter at a temperature of 20° C. for 60 seconds, washed with water, and dried. As a result, the portion having 50% net point area was reduced to 33%. At the same time, stain was observed.

| Farmer's reducing solution | |
|---|---|
| 1st solution | |
| Water | 200 m |
| Sodium thiosulfate | 20 g |
| 2nd solution | |
| Water | 100 m |
| Red prussiate (Potassium ferricyanide) | 10 g |

The lst solution, the second solution and water were mixed in a proportion of 100 parts:5 parts:100 parts before use.

EXAMPLE 2

Samples 2a, 2b, 2c, 2d, 2e, 2f, 2g, and 2h were prepared in the same manner as in Example 1 except in that Compound I-19 was replaced by Compounds I-3, I-5, I-21, I-23, I-40, I-41, I-50, and I-51 in an amount of $1.26\times10^{-4}$ mol/m$^2$, respectively. These samples were evaluated in the same manner as in Example 1.

The results of the evaluation showed that these samples exhibit a proper decrease in the sensitivity to the optimum range, high safelight safety, and excellent tone variability. No stain was observed after processing with a reducing solution.

EXAMPLE 3

The present sample 3 was prepared in the same manner as in Example 1 except that Compound I-19 was replaced by an ultraviolet absorbing compound I-41 and a yellow compound I-59 in amounts of 0.1 g/m$^2$ and 0.15 g/m$^2$, respectively. Compound I-41 was used as an ultraviolet absorber for reducing the sensitivity to the optimem range. Compound I-59 had the maximum absorption at a wavelength of 430 nm and was used as a dye for inhibiting fog due to light from a safelight.

COMPARATIVE EXAMPLE 2

Comparative Sample C was prepared in the same manner as in Example 3 except that Compound I-59 was replaced by a conventional water-solutle safelight dye of the undermentioned formula having an amount of 0.1 g/m².

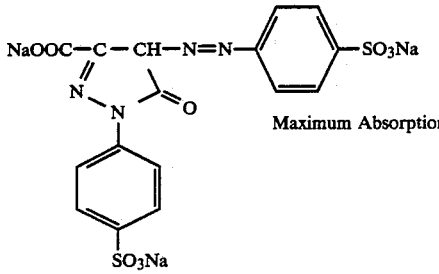

Maximum Absorption 430 nm

Evaluation of Present Sample 3 and Comparative Sample C

Present Sample 3 and Comparative Sample C were subjected to the tests (1) to (4) in the same manner as in Example 1. Both samples were completely decolored upon development. With respect to safelight safety, Comparative Sample C exhibited 50 minutes and Present Sample 3 exhibited 60 minutes. Both samples exhibited fairly improved safelight safety. Sample 3 showed a higher effect than the other with respect to safelight safety. With respect to tone variability, Table 2 shows that Comparative Sample C exhibits a remarkable decrease in tone variability while Present Sample 3 exhibits a high tone variability.

TABLE 2

| | Double Exposure | Quadruple Exposure |
|---|---|---|
| Comparative Sample C | +2% | +4% |
| Present Sample 3 | +5% | +9% |

The results show that both Compound I-41 and Compound I-59 can be well located in the layers in which they are incorporated to effectively shield the light and thereby reduce the sensitivity and improve safelight safety. At the same time, these compounds are not substantially diffused into other layers, exhibiting no effects of inhibiting tone variability.

No stain due to a reduced solution was observed.

EXAMPLE 4

Compound I-3 was dissolved in an oil and an auxiliary solvent. The solution obtained was then subjected to dispersion in gelatin by means of a homogenizer to prepare an emulsified dispersion. After emulsion dispersion, the dispersion was subjected to a noodle rinse. Water was then added to the dispersion to make 300 g. The composition of the emulsified dispersion was as follows:

| | |
|---|---|
| Gelatin (10 wt % aqueous solution) | 100 g |
| Sodium nonylphenylsulfonate | 0.5 g |
| Compound I-3 | 5.8 g |
| Tricresyl phosphate | 5.8 g |
| Cyclohexane | 26 ml |
| Ethyl acetate | 26 ml |
| Water to make | 300 g |

The emulsified dispersion thus prepared was then processed and tested in the same manner as in Example 1.

As a result, the emulsified dispersion showed excellent results as in Sample 1.

EXAMPLE 5

(1) Preparation of surface light-sensitive emulsion of tabular silver halide grain 30 g of gelatin, 10.5 g of potassium bromide, and 10 ml of a 0.5 wt % aqueous solution of thioether $HO—(CH_2)_2—S—(CH_2)_2—S—(CH_2)_2—OH$ were added to 1 l of water. 30 ml of a 0.88M aqueous solution of silver nitrate and 30 ml of a 0.88M aqueous solution of halide containing 0.075% thioether of the same kind and a 96/4 mixture (molar ratio) of potassium bromide and potassium iodide were simultaneously added to the admixture with stirring in a container which had been kept at a temperature of 72° C. (pAg 9.1; pH 6.5) in 15 seconds. 600 cc of a 1M aqueous solution of silver nitrate and 600 cc of a 1M aqueous solution of halide containing a 96/4 mixture (molar ratio) of potassium bromide and potassium iodide were simultaneously added to the admixture for 70 minutes to prepare an emulsion of tabular silver bromoiodide grain. The tabular silver halide grain had an average diameter of 2.0 μm, an average diameter/thickness ratio of 16 (accordingly, grain thickness is 0.12 μm), and a silver iodide content of 4.0 mol %. After being desalted, the emulsion was subjected to a chemical sensitization in combination with a sulfur sensitization. Sodium 3-[5-chloro-2-{2-[5-chloro-3-(3-sulfonatepropyl)benzoxazoline-2-ilidenemethyl]-1-butene}-3-benzoxazolio]propanesulfonate as a sensitizing dye and 4-hydroxy-6-methyl-1,3,3a-7-tetrazaindene as an antifoggant were added to the emulsion to prepare a green-sensitive silver bromoiodide emulsion B.

(2) Preparation of light-sensitive material

An antihalation layer was coated onto both sides of a 150-μm thick blue-colored polyethyleneterephthalate support in amounts of 0.08 to 0.15 g/ml on one side and 2.5 g/m² on the other. The antihalation layer (AH layer) contained the present compound and gelatin as shown in Table 3. A light-sensitive layer containing the above described emulsion B was coated onto both sides of the coated film in an amount of 2.5 g/m² for each side. Furthermore, a protective layer containing gelatin (1.3 g/m² for each side) and polymethylmethacrylate 0.7 g/m² for each side) as a matting agent was coated onto both sides of the coated film. (Samples 5-1 to 5-4)

(3) Comparative Example 3

Comparative Sample D was prepared in the same manner as in Example 5 except that a layer containing a mordant (1.0 g/m²) of the undermentioned formula and gelatin (2.0 g/m²) was used as an antihalation layer (AH layer) and a layer containing a dye (0.08 g/m²) of the undermentioned formula was used.

Mordant

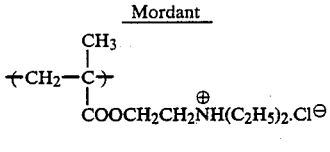

Dye

-continued

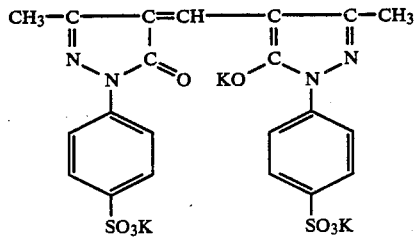

(4) Sensitometry and tone of image silver

These samples were then exposed to green light having a wavelength of 500 to 600 nm and an intensity peak at 545 nm through a continuous wedge, developed with a developing solution having the composition described below at a temperature of 35° C. for 2.5 seconds, fixed with the fixing solution described below, washed with water, and then dried.

| Developing solution | |
|---|---|
| Potassium hydroxide | 29.14 g |
| Glacial acetic acid | 10.96 g |
| Potassium sulfite | 44.20 g |
| Sodium bicarbonate | 7.50 g |
| Boric acid | 1.00 g |
| Diethylene glycol | 28.96 g |
| Ethylenediaminetetraacetic acid | 1.67 g |
| 5-Methylbenzotriazole | 0.06 g |
| 5-Nitroimidazole | 0.25 g |
| Hydroquinone | 30.00 g |
| 1-Phenyl-3-pyrazolidone | 1.50 g |
| Glutaraldehyde | 4.93 g |
| Sodium methabisulfite | 12.60 g |
| Potassium bromide | 7.00 g |
| Water to make | 1 l |
| pH | 10.25 |
| **Fixing solution** | |
| Ammonium thiosulfate | 200 g |
| Anhydrous sodium sulfite | 20 g |
| Boric acid | 8 g |
| Disodium ethylenediaminetetraacetate | 0.1 g |
| Aluminum sulfate | 15 g |
| Sulfuric acid | 2 g |
| Glacial acetic acid | 22 g |
| Water to make | 1 l |
| pH | 4.2 |

The photographic materials thus processed were measured for sensitometry. The results are shown in Table 3. In the table, the sensitivity value is represented as the common logarithm of the reciprocal of the exposure required to obtain a fog +0.3 density blackened by transmitting light with the value of Sample No. 5-1 as 1.00.

TABLE 3

| | Dye | | Relative sensitivity(ΔlogE) | |
|---|---|---|---|---|
| Sample No. | Type | Added Amount ($g/m^2$) | Fresh* | 40° C. 80% RH 3 days** |
| Present Sample 5-1 | I-62 | 0.08 | 1.00 | 0.93 |
| Present Sample 5-2 | I-62 | 0.15 | 0.98 | 0.90 |
| Present Sample 5-3 | I-63 | 0.10 | 1.04 | 0.97 |
| Present Sample 5-4 | I-64 | 0.10 | 0.96 | 0.91 |
| Comparative Sample D | — | — | 0.83 | 0.62 |

*Logarithmic value relative to fresh sensitivity of Sample 5-1 as 1.00.
**Value determined upon development after storage in a dark place at 40° C. and 80% RH for 3 days. (forced aging test).

Table 3 shows that Comparative Sample Dexhibits a big decrease in sensitivity, particularly upon the forced aging test at 40° C. and 80% RH while the present samples exhibit a small decrease in sensitivity. All these samples showed full decolorization of dyes.

EXAMPLE 6

(1) Preparation of light-sensitive silver halide emulsion

Potassium bromide, potassium iodide and silver nitrate were added to an aqueous solution of gelatin with vigorous stirring to prepare tabular silver bromoiodide grains having an average gradin diameter of 1 μm (AgI: 4 mol %). The emulsion thus prepared was then washed with water by an ordinary sedimentation method. The emulsion was chemically sensitized by a gold and sulfur sensitization method with chloroauric acid and sodium thiosulfate to prepare a light-sensitive silver bromoiodide emulsion C. A silver halide emulsion D (average grain diameter: 0.8 μm) and a silver halide emulsion E (average grain diameter: 0.6 μm) were then prepared in the same manner as the silver halide emulsion C except that different preparation temperatures (i.e., the emulsion D: 43° C. and the emulsion E: 41° C.) were used.

(2) Preparation of coated samples

Coated samples were prepared by coating the undermentioned layers on a triacetylcellulose support in sequence. As the support, there was used one having an optical density of 0.3. AH layer (antihalation layer): An AH layer comprising the present dyes shown in Table 4 and gelatin (2.5 $g/m^2$) was coated on the support. For comparative examples, a comparative sample E comprising only gelatin and free of dye was prepared, and a comparative sample F comprising the same AH layer as used in Comparative Example 3 was prepared.

1st emulsion layer: Emulsion C and Emulsion D as admixture were coated in amounts of 1.8 $g/m^2$ in terms of silver, respectively.

2nd emulsion layer: Emulsion E was coated in an amount of 1.8 $g/m^2$ in terms of silver.

The additives contained in these emulsion layers and the composition of the protective layer were as follows:

| Emulsion layer | |
|---|---|
| Binder: gelatin | 1.6 g/l g of Ag |
| Sensitizing dye: | 2.1 mg/l g of Ag |

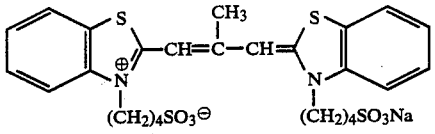

| | |
|---|---|
| Polyoxyethylene type surface active agent: $C_{18}H_{35}$-$(CH_2CH_2O)_{20}$-H | 5.2 mg/l g of Ag |
| Coating aid: Sodium dodecylbenzenesulfonate | 0.1 $mg/m^2$ |
| Potassium poly-p-styrenesulfonate | 1 $mg/m^2$ |
| **Surface protective layer** | |
| Binder: Gelatin | 0.7 $g/m^2$ |
| Coating aid: Sodium N-oleoil-N-methyltaurinate | 0.2 $mg/m^2$ |
| Matting agent: Finely divided polymethylmethacrylate particle (average particle size: 3 μm) | 0.13 $mg/m^2$ |

(3) Sensitometry

These samples were stored at a temperature of 25° C. and a relative humidity of 65% for 7 days after coating. These samples were then developed with a developing solution having the undermentioned composition at a temperature of 20° C. for 7 minutes, fixed with the undermentioned fixing solution, washed with water, and then dried. These samples thus processed were measured for MTF.

Measurement of MTF

The measurement of MTF was effected by means of a $400\times2\mu^2$ aparture. The evaluation of MTF was conducted by determination of the space frequency at which MTF was 0.5. MTF is described in detail in T. H. James, *The Theory of the Photographic Process* published by Macmillan, 1977.

| Developing solution | |
|---|---|
| Metol | 2 g |
| Sodium sulfite | 100 g |
| Hydroquinone | 5 g |
| Borx · 10 $H_2O$ | 2 g |
| Water to make | 1 l |
| **Fixing solution** | |
| Ammonium thiosulfate | 240.0 g |
| Sodium sulfite (anhydrate) | 15.0 g |
| Acetic acid (28%) | 48 ml |
| Sodium methaborate | 15 g |
| Potassium alum | 15 g |
| Water to make | 1.0 l |

The results are shown in Table 4. Table 4 shows that the present samples exhibit a small change in sensitivity and a high MTF value (high resolving power).

TABLE 4

| Sample No. | Dye Type | Dye Added Amount | Relative Sensitivity(ΔlogE) Fresh | Relative Sensitivity(ΔlogE) 40° C. 80% - RH 3 days | $MTF^{0.5}$ (piece/mm) |
|---|---|---|---|---|---|
| Present Sample | | | | | |
| 6-1 | I-62 | 0.15 | 0.99 | 0.96 | 29 |
| 6-2 | I-64 | 0.10 | 0.97 | 0.94 | 30 |
| Comparative Sample | | | | | |
| E | — | — | 1.00 | 0.98 | 21 |
| F | — | — | 0.81 | 0.48 | 30 |

EXAMPLE 7

Preparation of Emulsion F

An aqueous solution of silver nitrate and an aqueous solution of sodium chloride containing ammonium hexachlorinated rhodiumate (III) in an amount of $2.5\times10^{-5}$ mol per mol of silver were mixed with each other in a gelatin solution having a temperature of 35° C. in such a manner that the pH value thereof was adjusted to 2.3 to prepare a monodisperse emulsion of silver chloride grain having an average grain size of 0.1 μm.

After the formation of grains, soluble salts were removed by a flocculation process well-known in the art. 4-Hydroxy-6-methyl-1,3,3a-7-tetraazaindene and 1-phenyl-5-mercaptotetrazole were added to the emulsion as stabilizers. The amount of gelatin and silver contained in 1 Kg of the emulsion was 55 g and 105 g, respectively. (Emulsion F)

Preparation of light-sensitive material

A nucleating agent (Exemplary Compound IV-30) of the undermentioned formula and an organic desensitizer of the undermentioned formula were added to Emulsion F thus prepared in amounts of 20 mg/1 g of silver and 2 mg/1 g of silver, respectively Nucleating agent

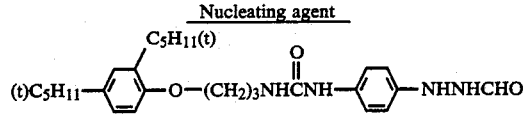

Organic desensitizer

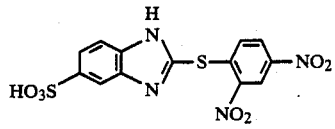

Furthermore, sodium 2,4-dichloro-6-hydroxy-1,3,5-triazine was added to the emulsion as a film hardener. The silver halide emulsion thus prepared was then coated into a transparent polyethyleneterephthalate support in an amount of 3.5 g/m² in terms of silver. An interlayer containing gelatin (0.8 g/m²) and polyethylacrylate latex (0.19 g/m²) was further coated onto the coated film. Moreover, a protective layer containing the present compound I-88 (0.1 g/m²) and gelatin (0.7 g/m²) and a polymethylmethacrylate particle having an average particle size of 2 μm (0.07 g/m²) as a matting agent was coated onto the coated film. The sample was then dried. (Sample 7)

Compound I-88 was used in the form of a gelatin dispersion prepared as follows: A solution of 4.9 g of the compound I-101 in 39 ml of methylethyl ketone was mixed with 260 g of a 5.0 wt % aqueous gelatin solution with stirring at a temperature of 45° C. to prepare a slightly emulsified dispersion.

COMPARATIVE EXAMPLE 4

Comparative Sample G was prepared in the same manner as in Example 7 except that the interlayer was excluded.

Evaluation of properties (1) These two samples were exposed to light through an optical wedge by means of a Dainippon Screen Co., Ltd.'s daylight printer P-607, developed with a developing solution having the undermentioned composition at a temperature of 38° C. for 20 seconds, fixed by an ordinary method, washed with water, and then dried. Both samples were fully decolored.

The results of the photographic properties are shown in Table 5. Table 5 shows that Sample 7 provides a higher contrast and a higher image density (Dmax) than Comparative Sample G.

TABLE 5

| Sample No. | Sensitivity | Dmax | Gradation (γ) |
|---|---|---|---|
| Sample 7 | 0 | 4.75 | 28.3 |
| Comparative Sample G | ±0 | 4.30 | 17.8 |

TABLE 5-continued

| Developing solution | |
|---|---|
| Hydroquinone | 35.0 g |
| N-methyl-p-aminophenol (½ sulfate) | 0.8 g |
| Sodium hydroxide | 18.0 g |
| 5-Sulfosalicylic acid | 75.0 g |
| Potassium sulfite | 110.0 g |
| Tetrasodium ethylenediaminetetraacetate | 1.0 g |
| Potassium bromide | 6.0 g |
| 2-Mercaptobenzimidazole-5-sulfonic acid | 0.3 g |
| Sodium 3-(5-mercaptotetrazole)benzene-sulfonate | 0.1 g |
| 3-Diethylamino-1,2-propanediol | 15.0 g |
| Water to make | 1 l |
| pH | 11.6 |

The sensitivity shown in the table is represented by the logarithm (logE) of the exposure at which a density of 1.5 is obtained. The value of the sensitivity shown in the table is the difference from the sensitivity of Sample 7 as reference.

Dmax: Dmax is represented by the density of the point having an exposure 0.5 lower than the sensitive point in terms of logE.

Gradation (γ): Gradation is represented by the slope of the line between the point having a density of 0.3 and the point having a density of 3.0 on the characteristic curve. The greater this value, the higher is the contrast.

(2) Comparative Sample G and Sample 7 were subjected to a forced aging at an elevated temperature and a high humidity. These samples thus aged were then exposed to light, and developed in the same manner as in the test (1).

The conditions for the forced aging were 3 days at 50° C. and 65% RH and 3 days at 50° C. and 75% RH.

The results are shown in Table 6. The table shows that Present Sample 7 exhibits less change in the sensitivity due to the forced aging than Comparative Sample G. Fr indicates the initial value of sensitivity before the forced aging.

TABLE 6

| | Sensitivity* | | |
|---|---|---|---|
| Sample No. | Fr | 50° C. 65% RH 3 days | 50° C. 75% RH 3 days |
| Sample 7 | 0 | +0.01 | +0.05 |
| Comparative Sample G | ±0 | +0.08 | +0.19 |

*The sensitivity is represented by logE of the difference from Fr of Sample 7 as reference.

EXAMPLE 8

Preparation of Emulsion H

An aqueous solution of silver nitrate and an aqueous solution of sodium chloride containing ammonium hexachlorinated rhodiumate (III) in an amount of $1.0\times10^{-4}$ mol per 1 mol of silver were mixed with each other by a double jet method in a gelatin solution having a temperature of 38° C. in such a manner that the pH thereof was adjusted to 5.8 to prepare a monodisperse emulsion of silver chloride grain having an average grain size of 0.08 μm.

After the formation of grains, soluble salts were removed by a flocculation well-known in the art. 4-Hydroxy-6-methyl-1,3,3a,7-tetraazaindene and 1-phenyl-5-mercaptotetrazole were added to the emulsion as stabilizers. The amount of gelatin and silver contained in 1 Kg of the emulsion were 55 g and 105 g, respectively. (Emulsion H)

Preparation of light-sensitive material

Two nucleating agents (Exemplary Compound IV-27 and Exemplary Compound IV-30) of the undermentioned formulae were added to Emulsion F thus prepared in amounts of 9 mg/m² and 7 mg/m², respectively.

Exemplary Compound IV-27

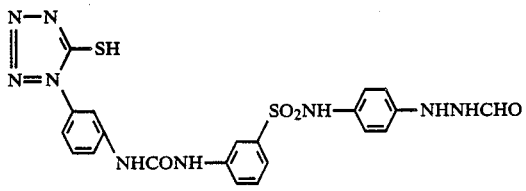

Exemplary Compound IV-30

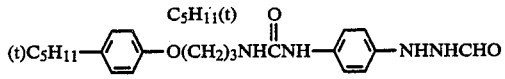

Furthermore, a polyethylacrylate latex (0.7 g/m²), a dye (0.5 g/m²) of the following formula:

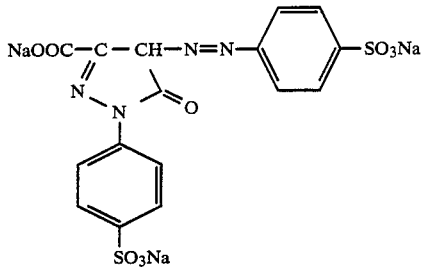

, a development accelerator (20 mg/m²) of the following formula:

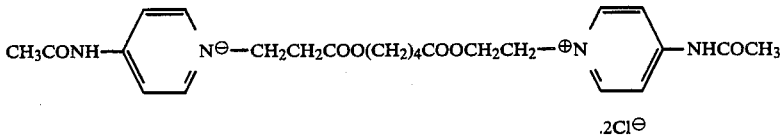

and sodium 2,4-dichloro-6-hydroxy-1,3,5-triazine as a film hardener were added to the emulsion. The silver halide emulsion was then coated onto a transparent polyethyleneterephthalate support in an amount of 3.5 g per m² in terms of silver. Furthermore, an interlayer containing gelatin (0.8 g/m²), a polyethylacrylate latex (0.19 g/m²), a development accelerator of the undermentioned formula (55 mg/m²), a hydrazine compound (Exemplary Compound IV-30) of the undermentioned formula (7 mg/m$^2$), and thioctic acid (6 mg/m$^2$) was coated onto the coated film.

Development accelerator

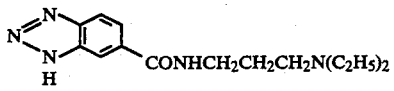

Hydrazine compound (IV-30)

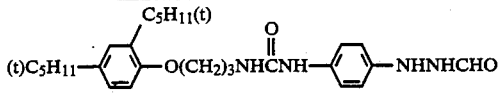

Moreover, a protective layer containing Present Compound I-88 (0.1 g/m$^2$), gelatin (0.7 g/m$^2$), and a polymethylmethacrylate particle having an average particle size of 2 μm (0.07 g/m$^2$) as matting agents was coated onto the coated film. The sample was then dried. (Sample 8)

As coating aids, there were used the following three surface active agents:

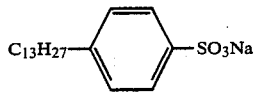

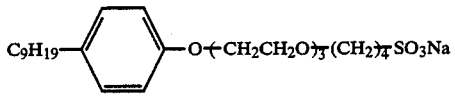

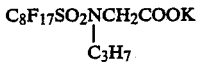

Evaluation of properties

The sample thus prepared was then measured for photographic properties and change in sensitivity due to forced aging in the same manner as in Example 1. As a result, the sample exhibited high γ value and Dmax and a small change in sensitivity due to forced aging as did Sample 1.

EXAMPLE 9

Samples 9-1 to 9-6 were prepared in the same manner as in Example 8 except that Present Compound I-88 to be incorporated in the protective layer was replaced by Compound I-83, Compound I-86, Compound I-93, Compound I-97, Compound I-100, and Compound I-102, respectively. These samples were then measured for photographic properties and subjected to a forced aging test in the same manner as in Example 8.

As a result, these samples exhibited high γ and Dmax values and a high stability upon forced aging as in Example 8.

EXAMPLE 10

A multilayer color light-sensitive material 101 was prepared by coating various layers of the undermentioned compositions onto an undercoated cellulose triacetate film support.

Composition of light-sensitive layer

The amount of each component is represented in units of g/m$^2$. However, the amount of silver halide is represented in terms of silver. The amount of sensitizing dye is represented in units of mole in terms of coated amount per mol of silver halide contained in the same layer.

1st layer (antihalation layer)

| | |
|---|---|
| Black colloidal silver | 0.2 |
| Gelatin | 1.4 |
| UV-1 | 0.02 |
| UV-2 | 0.04 |
| UV-3 | 0.04 |
| Solv-1 | 0.05 |

| 2nd layer (interlayer) | |
|---|---|
| Silver bromide grain (average grain diameter: 0.07 μm) | 0.08 |
| Gelatin | 1.1 |
| ExC-1 | 0.02 |
| ExM-1 | 0.06 |
| UV-1 | 0.03 |
| UV-2 | 0.06 |
| UV-3 | 0.07 |
| Cpd-1 | 0.1 |
| ExF-1 | 0.004 |
| Solv-1 | 0.1 |
| Solv-2 | 0.09 |

3rd layer (low sensitivity red-sensitive emulsion layer)

Silver bromoiodide emulsion (AgI: 6.3 mol %; internal high AgI type; c/s ratio: 1/1; diameter calculated in terms of sphere: 0.8 m; coefficient of variation in diameter calculated in terms of sphere: 25%; tabular grains; diameter/thickness ratio: 2; coated amount of silver: 1.5)

| | |
|---|---|
| Gelatin | 1.7 |
| ExC-2 | 0.3 |
| ExC-3 | 0.02 |
| ExS-1 | $7.1 \times 10^{-5}$ |
| ExS-2 | $1.9 \times 10^{-5}$ |
| ExS-3 | $2.4 \times 10^{-4}$ |
| ExS-4 | $4.2 \times 10^{-5}$ |
| Solv-2 | 0.03 |

4th layer (middle sensitivity red-sensitive emulsion layer)

Silver bromoiodide emulsion (AgI: 4.8 mol %, internal high AgI type; c/s ratio: 1/4; diameter calculated in terms of sphere: 0.9 μm; coefficient of variation in diameter calculated in terms of sphere: 50%; tabular particles; diameter/thickness ratio: 1.5; coated amount of silver: 1.4)

| | |
|---|---|
| Gelatin | 2.1 |
| ExC-2 | 0.4 |
| ExC-3 | 0.002 |
| ExS-1 | $5.2 \times 10^{-5}$ |
| ExS-2 | $1.4 \times 10^{-5}$ |
| ExS-3 | $1.8 \times 10^{-4}$ |
| ExS-4 | $3.1 \times 10^{-5}$ |
| Solv-2 | 0.5 |

5th layer (high sensitivity red-sensitive emulsion layer)

Silver bromoiodide emulsion (AgI: 10.2 mol %; internal high AgI type; c/s ratio: ½; diameter calculated in terms of sphere: 1.2 μm; coefficient of variation in diameter calculated in terms of sphere: 35%; tabular grains;

diameter/thickness ratio: 3.5; coated amount of silver: 2.1)

| | |
|---|---|
| Gelatin | 2.0 |
| ExC-1 | 0.06 |
| ExC-4 | 0.04 |
| ExC-5 | 0.2 |
| ExS-1 | $6.5 \times 10^{-5}$ |
| ExS-2 | $1.7 \times 10^{-5}$ |
| ExS-3 | $2.2 \times 10^{-4}$ |
| ExS-4 | $3.8 \times 10^{-5}$ |
| Solv-1 | 0.1 |
| Solv-2 | 0.3 |

6the layer (interlayer)

| | |
|---|---|
| Gelatin | 1.1 |

7th layer (low sensitivity green-sensitive emulsion layer)

Silver bromoiodide emulsion (AgI: 6.3 mol %; internal high AgI type; c/s ratio: 1/1; diameter calculated in terms of sphere: 0.8 μm; coefficient of variation in diameter calculated in terms of sphere: 25%; tabular grains; diameter/thickness ratio: 2; coated amount of silver: 0.6)

| | |
|---|---|
| Gelatin | 0.8 |
| ExM-2 | 0.3 |
| ExM-1 | 0.03 |
| ExY-1 | 0.04 |
| ExS-5 | $3.1 \times 10^{-5}$ |
| ExS-6 | $1.0 \times 10^{-4}$ |
| ExS-7 | $3.8 \times 10^{-4}$ |
| H-1 | 0.04 |
| H-2 | 0.01 |
| Solv-2 | 0.2 |

8th layer (middle sensitivity green-sensitive emulsion layer)

Silver bromoioidide emulsion (AgI: 4.8 mol %; internal high AgI type; c/s ratio: ¼; diameter calculated in terms of sphere: 0.9 μm; coefficient of variation in diameter calculated in terms of sphere: 50%; tabular grains; diameter/thickness ratio: 1.4; coated amount of silver: 1.1).

| | |
|---|---|
| Gelatin | 1.4 |
| ExM-4 | 0.2 |
| ExM-5 | 0.05 |
| ExM-1 | 0.01 |
| ExM-3 | 0.01 |
| ExY-1 | 0.02 |
| ExS-5 | $2.0 \times 10^{-5}$ |
| ExS-6 | $7.0 \times 10^{-5}$ |
| ExS-7 | $2.6 \times 10^{-4}$ |
| H-1 | 0.07 |
| H-2 | 0.02 |
| Solv-1 | 0.06 |
| Solv-2 | 0.4 |

9th layer (high sensitivity green-sensitive emulsion layer)

Silver bromoiodide emulsion (AgI: 10.2 mol %; internal high AgI type; c/s ratio: ½; diameter calculated in terms of sphere: 1.2 μm; coefficient of variation in diameter calculated in terms of sphere: 38%, tabular grains: diameter/thickness ratio: 4; coated amount of silver: 2.1)

| | |
|---|---|
| Gelatin | 2.2 |
| ExC-2 | 0.02 |
| ExM-5 | 0.1 |
| ExM-1 | 0.05 |
| ExS-5 | $3.5 \times 10^{-5}$ |
| ExS-6 | $8.0 \times 10^{-5}$ |
| ExS-7 | $3.0 \times 10^{-4}$ |
| Solv-1 | 0.08 |
| Solv-2 | 0.7 |

10th layer (yellow filter layer)

| | |
|---|---|
| Yellow colloidal silver | 0.08 |
| Gelatin | 1.0 |
| Cpd-1 | 0.1 |

11th layer (low sensitivity blue-sensitive emulsion layer)

Silver bromoiodide emulsion AgI: 9.0 mol %; internal high AgI type; c/s ratio: ½; diameter calculated in terms of sphere: 0.75 μm; coefficient of variation in diameter calculated in terms of spheres: 21%; octahedron grains; diameter/thickness ratio: 1; coated amount of silver: 0.3)

| | |
|---|---|
| Gelatin | 1.3 |
| ExY-2 | 0.7 |
| H-1 | 0.03 |
| H-2 | 0.01 |
| Solv-2 | 0.3 |

12th layer (middle sensitivity blue-sensitive emulsion layer)

Silver bromoiodide emulsion (AgI: 10.2 mol %; internal high AgI type; c/s ratio: ½; diameter calculated in terms of sphere: 1.0 μm; coefficient of variation in diameter calculated in terms of sphere: 30%; tabular grains; diameter/thickness ratio: 3.5; coated amount of silver: 0.4)

| | |
|---|---|
| Gelatin | 0.7 |
| ExY-2 | 0.1 |
| ExS-8 | $2.2 \times 10^{-4}$ |
| H-1 | 0.01 |
| H-2 | 0.005 |
| Solv-2 | 0.05 |

13th layer (high sensitivity blue-sensitive emulsion layer)

Silver bromoiodide emulsion (AgI: 9.8 mol %; internal high AgI type; c/s ratio: ½; diameter calculated in terms of sphere: 1.8 μm; coefficient of variation in diameter calculated in terms of sphere: 55%; tabular grains; diameter/thickness ratio: 4.5; coated amount of silver: 0.8)

| | |
|---|---|
| Gelatin | 0.7 |
| ExY-2 | 0.2 |
| ExS-8 | $2.3 \times 10^{-4}$ |
| Solv-2 | 0.07 |

14th layer (1st protective layer)

| | |
|---|---|
| Gelatin | 0.9 |
| UV-4 | 0.1 |
| UV-5 | 0.2 |

-continued
| | |
|---|---|
| H-1 | 0.02 |
| H-2 | 0.005 |
| Solv-3 | 0.03 |
| Cpd-2 | 0.7 |
15th layer (2nd protective layer)
| | |
|---|---|
| Emulsion of a finely divided silver bromide grain (average grain size: 0.07 μm) | 0.1 |
| Gelatin | 0.7 |
| H-1 | 0.2 |
| H-2 | 0.05 |
ExS-1
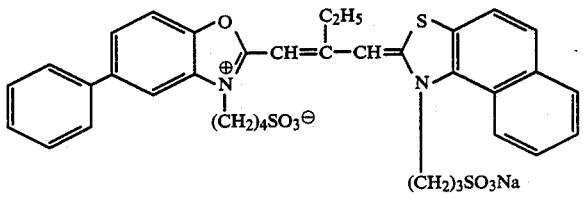
ExS-2
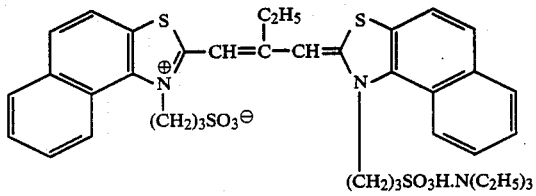
ExS-3
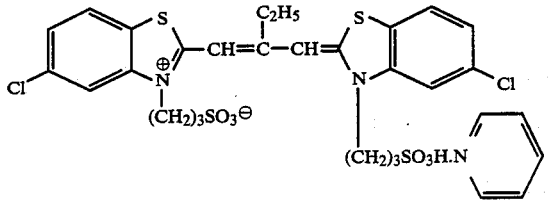
ExS-4
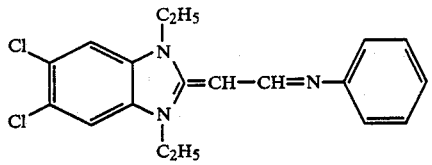
ExS-5
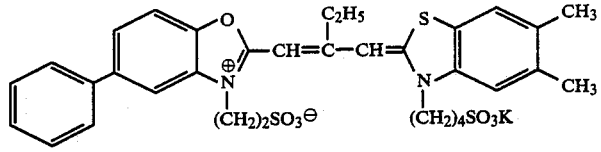
ExS-6
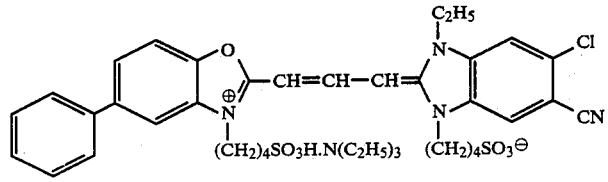
ExS-7
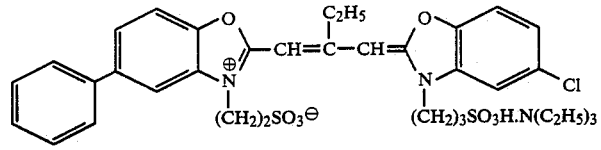

-continued
ExS-8
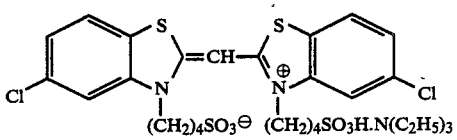
ExC-1
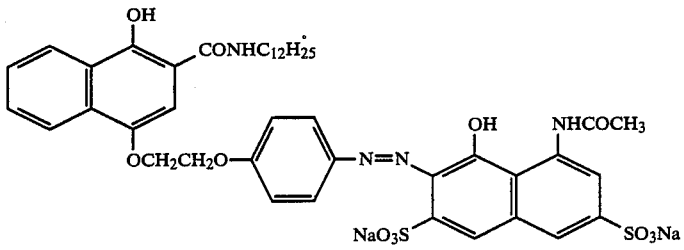
ExC-2
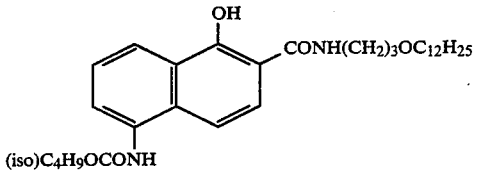
ExC-3
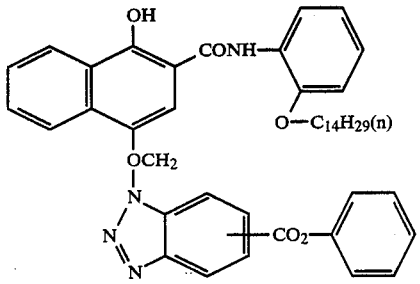
ExC-4
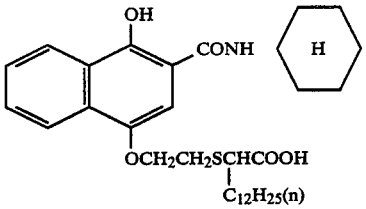
ExC-5
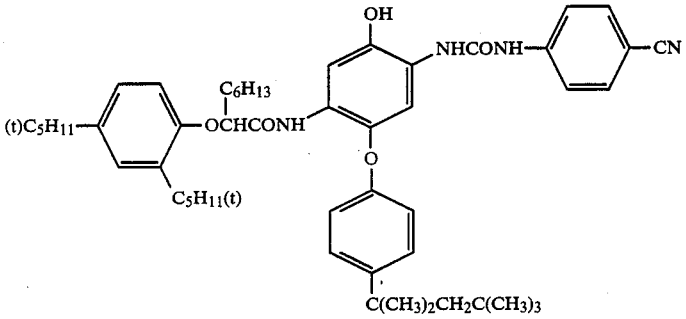

-continued
ExM-1
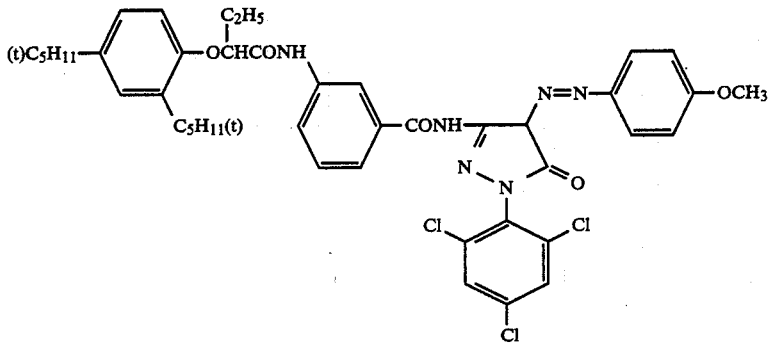
ExM-2
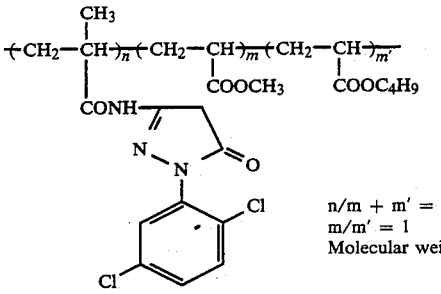
n/m + m' = 1
m/m' = 1
Molecular weight: about 40,000
ExM-3
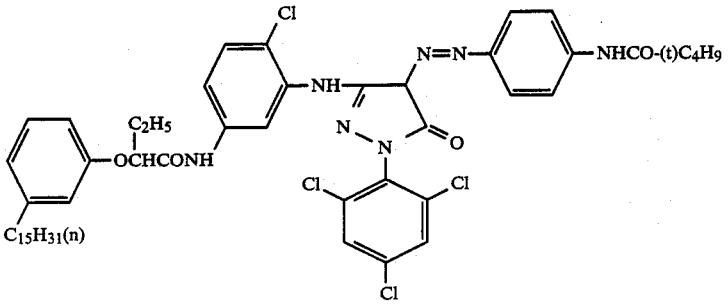
ExM-4
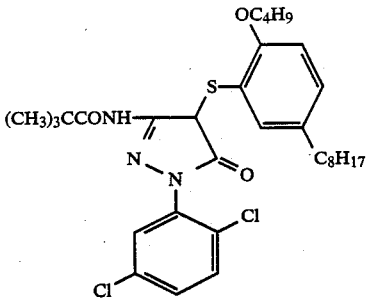
ExM-5
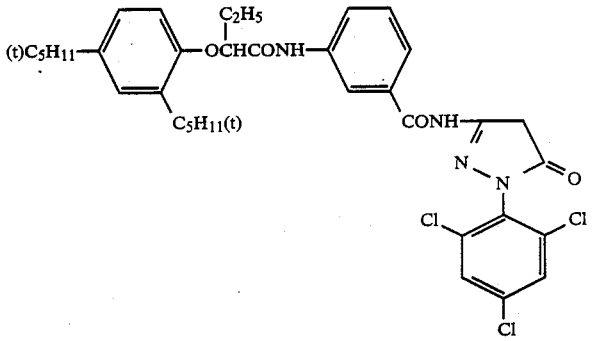

-continued
ExY-1
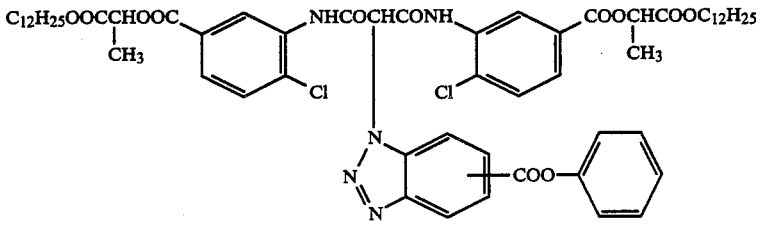
ExY-2
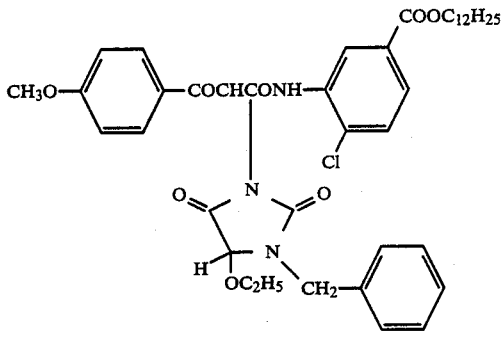
UV-1
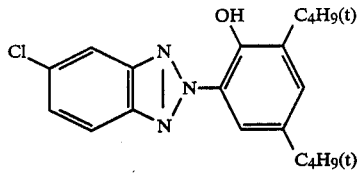
UV-2
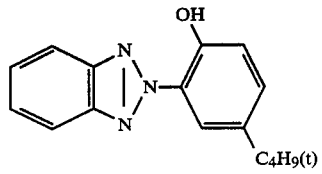
UV-3
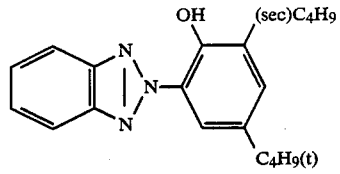
UV-4
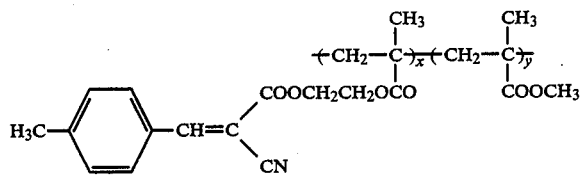
Ratio of x/y = 7/3 (wt.)
UV-5
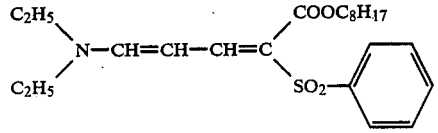
ExF-1
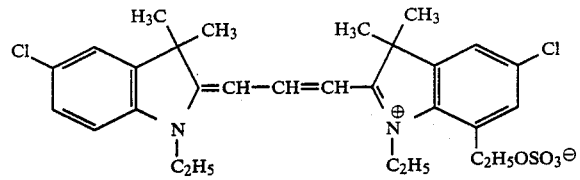

-continued

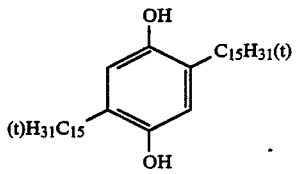

Cpd-1

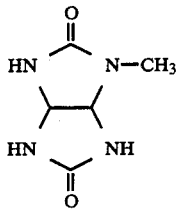

Cpd-2

Solv-1: Di-n-butylphthalate
Solv-2: Tricresylphosphate
Solv-3: Trihexylphosphate

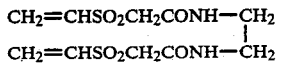

H-1

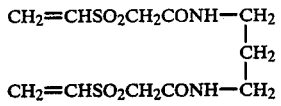

H-2

Preparation of Sample 102

Sample 102 was prepared in the same manner as in Sample 101 except that the yellow colloidal silver to be incorporated in the 10th layer was replaced by Compound A of the undermentioned formula as a comparative compound in an amount of 0.2 g.

Compound A

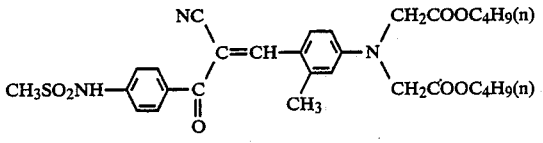

(Yellow dye described in Japanese Patent Application (OPI) No. 205,934/86)

Preparation of Samples 103 to 105

Samples 103 to 105 were prepared in the same manner as in Sample 102 except that Compound A to be incorporated in the 10th layer was replaced by the present compound in the equimolecular amount as shown in Table 7 and Compound V-(3) was used in an amount of 0.30 g as a reducing agent together with Cpd-1.

Compound V-(3)

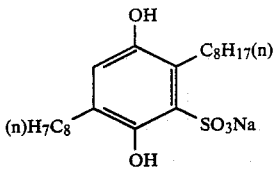

Samples 101 to 105 thus obtained were exposed to white light through a wedge, and then subjected to the following processing steps:

| Step | Processing steps: Processing time | Processing temp. |
|---|---|---|
| Color development | 3 min. 15 sec. | 38° C. |
| Bleaching | 1 min. 00 sec. | 38° C. |
| Blixing (Bleach fixing) | 3 min. 15 sec. | 38° C. |
| Rinse (1) | 40 sec. | 35° C. |
| Rinse (2) | 1 min. 00 sec. | 35° C. |
| Stabilizing | 40 sec. | 38° C. |
| Drying | 1 min. 15 sec. | 55° C. |

The composition of the processing solutions will be shown hereinafter.

| | (unit: g) |
|---|---|
| Color developing solution | |
| Diethylenetriaminepentaacetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-Ethyl-N-β-hydroxyethylamino)-2-methylaniline sulfate | 4.5 |
| Water to make | 1.0 l |
| pH | 10.05 |
| Bleaching solution | |
| $NH_4[Fe(III)(EDTA)].2H_2O$ {Ammonium iron (III) ethylenediaminetetraacetate dihydrate} | 120.0 |
| EDTA.2Na (Disodium ethylenediaminetetraacetate) | 10.0 |
| Ammonium bromide | 100.0 |
| Ammonium nitrate | 10.0 |
| Bleach accelerator | 0.005 mol |

-continued

| | (unit: g) |
|---|---|
| 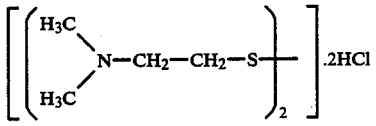 | |
| Ammonia water (27%) | 15.0 ml |
| Water to make | 1.0 l |
| pH | |
| Blixing solution | |
| $NH_4[Fe(III)(EDTA)].2H_2O$ | 50.0 |
| EDTA.2Na | 5.0 |
| Sodium sulfite | 12.0 |
| 70% aqueous solution of ammonium thiosulfate | 240.0 ml |
| Ammonia water (27%) | 6.0 ml |
| Water to make | 1.0 l |
| pH | 7.2 |

Rinsing Water

Tap water (i.e., city water) was allowed to pass through a mixed bed type column filled with an H-type strongly-acidic cationic exchange resin (Amberlite IR-120B manufactured by Rohm & Haas) and an OH-type anionic exchange resin (Amberlite IR-400 manufactured by Rohm & Haas) so that the concentration of calcium and magnesium ions was reduced to 3 mg/l or less. Sodium dichlorinated isocyanurate and sodium sulfate were added to the water thus processed in amounts of 20 mg/l and 150 mg/l, respectively.

The pH value of the solution was in the range of 6.5 to 7.5.

| Stabilizing solution | (unit: g) |
|---|---|
| Formaline | 2.0 ml |
| Polyoxyethylene-p-monononylphenylether (average polymerization degree: 10) | 0.3 |
| Disodium ethylenediaminetetraacetate | 0.05 |
| Water to make | 1.0 l |
| pH | 5.0 to 8.0 |

The sample thus prepared was measured for yellow and magenta densities. The results are shown in Table 7.

The present sample exhibits a high sensitivity in the green-sensitive layer and a low Dmin of yellow dye. This is probably because the present compound exhibits a sharp absorption in the long wavelength range as compared to colloidal silver, and is excellent in decolorability upon development as compared to Compound A, leaving less color residue after development.

TABLE 7

| Sample No. | Compound No. | Sensitivity of Green-sensitive Layer* | Dmin of Yellow Sensitivity** |
|---|---|---|---|
| 101 (comparative) | — | ±0 | ±0 |
| 102 (comparative) | A | +0.09 | +0.10 |
| 103 (invention) | 75/76(1/1) | +0.12 | +0.01 |
| 104 (invention) | 77 | +0.10 | +0.01 |
| 105 (invention) | 77/78(2/1) | +0.09 | ±0 |

*Relative value of log E of the exposure at which fog +0.15 is obtained.
**Difference from the value of Sample 101

EXAMPLE 11

Preparation of Sample 111

Sample 111 was prepared in the same manner as in Sample 101 except that the colloidal silver to be incorporated in the 1st layer was replaced by Present Compounds I-82, I-81, and I-79 in amounts of $5\times10^{-4}$ mole/m$^2$, respectively, and Compound V-(1) of the undermentioned formula was used as a reducing agent in an amount of 0.30 g. These compounds were used in the form of an emulsified dispersion as in the UV absorber to be together incorporated in the sample.

Compound V-(1)

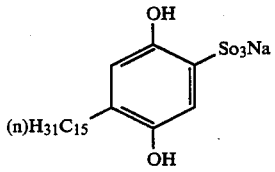

Sample 111 thus prepared and Sample 101 were exposed to light at 20 CMS, and then subjected to the following development and other processing:

| Step | Processing steps: Processing Time | Processing Temp. |
|---|---|---|
| Color development | 2 min. 30 sec. | 40° C. |
| Blixing | 3 min. 20 sec. | 40° C. |
| Rinse (1) | 20 sec. | 35° C. |
| Rinse (2) | 20 sec. | 35° C. |
| Stabilizing | 20 sec. | 35° C. |
| Drying | 60 sec. | 65° C. |

The composition of the processing solutions is shown hereinafter.

| Color developing solution | |
|---|---|
| Diethylenetriaminepentaacetic acid | 2.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-[N-Ethyl-N-(β-hydroxyethyl)amino]-2-methylaniline sulfate | 4.5 g |
| Water to make | 1.0 l |
| pH | 10.0 |
| Blixing solution | |
| $NH_4[Fe(III)(EDTA)].2H_2O$ | 50.0 g |
| EDTA.2Na | 5.0 g |
| Sodium sulfite | 12.0 g |
| 70% aqueous solution of ammonium thiosulfate | 260.0 ml |
| Acetic acid (98%) | 5.0 ml |
| Bleach accelerator | 0.01 mol |
| 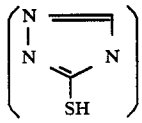 | |
| Water to make | 1.0 l |
| pH | 6.0 |

Rinsing water

Tap water allowed to pass through a mixed bed type column filled with an H-type strongly-acidic cationic exchange resin (Amberlite IR-120B manufactured by Rohm & Haas) OH type anionic exchange resin (Amberlite IR-400 manufactured by Rohm & Haas) so that the concentration of calcium and magnesium ions was reduced to 3 mg/l or less. Sodium dichlorinated isocyanurate and sodium sulfate were added to the water thus processed in amounts of 20 mg/l and 1.5 g/l, respectively.

The pH value of the solution was in the range of 6.5 to 7.5.

| Stabilizing solution | |
|---|---|
| Formaline (37%) | 2.0 ml |
| Polyoxyethylene-p-monononylphenylether (averge polymerization degree: 10) | 0.3 g |
| EDTA.2Na | 0.05 g |
| Water to make | 1.0 l |
| pH | 5.0 to 8.0 |

These samples thus processed were measured for the amount of residual silver by means of fluorescent X-ray. As a result, Sample 111 comprising the present compound showed a lower amount of residual silver.

Thus, it has been found that a light-sensitive material can le more easily desilvered by using the present compound instead of the colloidal silver to be incorporated in the antihalation layer.

In the present silver halide photographic material, the present light absorbing compound represented by formula (I has advantage in that it selectively dyes the layer in which it is to be incorporated and is not substantially diffused into the other layers. Thus, the present light absorbing compound represented by formula (I) provides a silver halide photographic material excellent in effects of filtering light, adjusting sensitivity, improving safelight safety, and inhibition of light-fog due to static electricity.

A layer containing the present compound can be easily decolored and eluted upon photographic processing and thus does not exert an adverse effect on the photographic properties of the light-sensitive material.

In the present invention, the layer containing the present compound has little interaction with a binder such as gelatin or a coating aid, improving the coating properties.

Furthermore, even if processing with a reducing agent is conducted, the present compound does not exert an adverse effect such as stain on the light-sensitive material.

Moreover, the present silver halide photographic material provides images having an improved sharpness. A photograph produced from the present silver halide photographic material can withstand a prolonged storage without generating stain or causing any deterioration in photographic properties.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer and at least one hydrophilic colloid layer which contains a compound represented by formula (I):

$$\text{PWR}—(\text{Time})_t\text{LA} \qquad \text{(I)}$$

wherein PWR represents a group which undergoes reduction to release $(\text{Time})_t$LA; Time represents a group which releases LA upon reaction following release of $(\text{Time})_t$LA from PWR; t represents an integer of 0 or 1; and LA represents a group having a maximum light absorption in a wavelength range of 310 nm or more, said material having a hydrophilic colloid layer substantially free of the compound represented by formula (I) provided between said hydrophilic colloid layer containing the compound represented by formula (I) and said at least one silver halide emulsion layer, wherein said silver halide emulsion layer contains a high contrast imparting hydrazine derivative.

2. A silver halide photographic material as claimed in claim 1, wherein one of said other hydrophilic colloid layers substantially free of the compound represented by formula (I) is provided between said at least one silver halide emulsion layer in said silver halide photographic material and one of said other hydrophilic colloid layers containing the compound represented by formula (I), and at least one of said hydrophilic colloid layers or at least one other hydrophilic colloid layer contains a hydrazine derivative.

3. A silver halide photographic material as claimed in claim 1, wherein the compound represented by formula (I) is represented by formula (II):

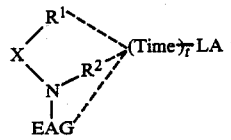

wherein

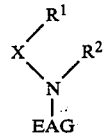

corresponds to PWR defined in the formula (I); $(\text{Time})_t$LA is bonded to at least one of $R^1$, $R^2$ and EAG; X represents an oxygen atom (—O—), sulfur atom (—S—), or nitrogen-containing group $$(-\overset{\overset{R^3}{|}}{N}-);$$

EAG represents a group which accepts electrons from a reducing substance and is bonded to a nitrogen atom; and $R^1$, $R^2$, and $R^3$ each represents a group other than a hydrogen atom or a mere bond.

4. A silver halide photographic material as claimed in claim 3, wherein the compound represented by formula (I) is represented by formula (III):

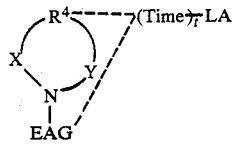

(III)

wherein

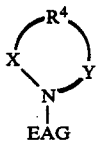

corresponds to PWR defined in the formula (I); $(Time)_t$LA is bonded to at least one of $R^4$ and EAG; Y represents a divalent connecting group; X represents an oxygen atom (—O—), a sulfur atom (—S—) or a nitrogen-containing group

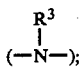

$R^4$ represents an atomic group which is bonded to X and Y to form a nitrogen-containing 5- to 8-membered monocyclic or condensed heterocyclic ring; Time represents a group which releases LA upon reaction triggered by N-X cleavage; t represents an integer of 0 or 1, with the proviso that when t is 0, Time represents a mere bond; EAG represents a group which accepts electrons from a reducing substance and is bonded to a nitrogen atom; and $R^3$ represents a group other than a hydrogen atom or a mere bond.

5. A silver halide photographic material as claimed in claim 3, wherein X is an oxygen atom.

6. A silver halide photographic material as claimed in claim 1, wherein the compound of the formula (I) is incorporated in a light-insensitive layer located outside the farthest light-sensitive layer from the support.

7. A silver halide photographic material as claimed in claim 1, wherein the compound of the formula (I) is incorporated in a light-insensitive layer located between the support and the nearest light-sensitive layer to the support.

8. A silver halide photographic material as claimed in claim 1, wherein the compound of formula (I) is incorporated in an antihalation layer located between a protective layer and the emulsion layer located farthest from the support, or in an antihalation layer located between the support and the emulsion layer closest to the support.

9. A silver halide photographic material as claimed in claim 1, wherein said hydrophilic colloid layer substantially free of the compound represented by formula (I) is an inter gelatin layer and said light-sensitive emulsion layer contains a hydrazine derivative.

10. A silver halide photographic material as claimed in claim 9, wherein the hydrazine derivative is represented by formula (IV):

$$R_0\text{—NHNH—CHO} \qquad \text{(IV)}$$

(IV) wherein $R_0$ represents an aliphatic or aromatic group.

11. A silver halide photographic material as claimed in claim 9, wherein the hydrazine derivatives contains a nondiffusion group or silver halide adsorbing group.

12. A silver halide photographic material as claimed in claim 9, wherein the hydrazine derivative is incorporated in the light-sensitive emulsion layer and the compound of the formula (I) is incorporated in a layer located between the surface protective layer or the support and the emulsion layer.

13. A silver halide photographic material as claimed in claim 1, wherein the silver halide emulsion contains a silver halide grain having an average grain size of 0.02 to 0.15 μm.

14. A silver halide photographic material as claimed in claim 1, wherein the hydrazine derivative is represented by formula (IV):

$$R_0\text{—NHNH—CHO} \qquad \text{(IV)}$$

(IV) wherein $R_0$ represents an aliphatic or aromatic group.

15. A method for forming super high contrast images, which comprises imagewise exposing a silver halide photographic material to light, and then developing the silver halide photographic material with a developing solution having a pH of 11.0 to 12.3 and containing 0.15 mol/l or more of sulfite ions, wherein said silver halide photographic material comprises a support having provided thereon at least one silver halide emulsion layer, at least one hydrophilic colloid layer or silver halide emulsion layer other than said at least one emulsion layer contains a compound represented by formula (I):

$$\text{PWR—}(\text{Time})_t\text{LA} \qquad \text{(I)}$$

(I) wherein PWR represents a group which undergoes reduction to release $(Time)_t$LA: Time represents a group which releases LA upon reaction following release of $(Time)_t$LA from PWR; t represents an integer of 0 or 1; and LA represents a group having a maximum light absorption in a wavelength range of 310 nm of more, and having a hydrophilic colloid layer substantially free of the compound represented by formula (I) provided between any hydrophilic colloid layer or silver halide emulsion layer containing the compound represented by formula (I) and said at least one silver halide emulsion layer.

16. A method for forming super high contrast images as claimed in claim 15, wherein said silver halide emulsion layer contains a hydrazine derivative, and said hydrazine derivative is represented by formula (IV):

$$R_0\text{—NHNH—CHO} \qquad \text{(IV)}$$

(IV) wherein $R_0$ represents an aliphatic or aromatic group.

17. A silver halide photographic material comprising a support having thereon two or more silver halide emulsion layers wherein:

at least one of said silver halide emulsion layers contains a high contrast imparting hydrazine derivative;

at least one hydrophilic colloid layer or a silver halide emulsion layer other than said silver halide emulsion layer containing said hydrazine derivative contains a compound represented by formula (I):

$$\text{PWR—}(\text{Time})_t\text{LA} \qquad \text{(I)}$$

wherein PWR represents a group which undergoes reduction to release $(Time)_t$LA: Time represents a group which releases LA upon reaction following release of $(Time)_t$LA from PWR; t represents an integer of 0 or 1; and LA represents a group having a maximum light absorption in a wavelength range of 310 nm or more; and a hydrophilic colloid layer substantially free of said compound represented by formula (I) is provided between any hydrophilic colloid layer or silver emulsion layer containing the compound represented by formula (I) and said at least one silver halide emulsion layer containing said hydrazine derivative.

18. A silver halide photographic material as claimed in claim 17, wherein the hydrazine derivative is represented by formula (IV):

$$R_0\text{—NHNH—CHO} \qquad \text{(IV)}$$

(IV) wherein $R_0$ represents an aliphatic or aromatic group.

* * * * *